US012753981B2

(12) United States Patent
Narayanan et al.

(10) Patent No.: US 12,753,981 B2
(45) **Date of Patent: *Oct. 6, 2026**

(54) DESIGNS AND APPLICATIONS OF A LOW-DRAG, HIGH-EFFICIENCY MICROCHANNEL POLYMER HEAT EXCHANGER

(71) Applicant: THE REGENTS OF THE UNIVERSITY OF CALIFORNIA, Oakland, CA (US)

(72) Inventors: Vinod Narayanan, Davis, CA (US); Erfan Rasouli, Sacramento, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 5 days.

This patent is subject to a terminal disclaimer.

(21) Appl. No.: 18/771,285

(22) Filed: Jul. 12, 2024

(65) Prior Publication Data

US 2024/0410662 A1 Dec. 12, 2024

Related U.S. Application Data

(63) Continuation-in-part of application No. 17/148,359, filed on Jan. 13, 2021, now Pat. No. 12,066,197.
(Continued)

(51) Int. Cl.
*F28D 9/00* (2006.01)
*F28F 3/02* (2006.01)
(Continued)

(52) U.S. Cl.
CPC ..... *F28F 21/065* (2013.01); *F28D 9/0037* (2013.01); *F28F 3/022* (2013.01); *F28F 3/08* (2013.01)

(58) Field of Classification Search
CPC . F24F 1/0067; F24F 1/077; F25B 9/02; F25B 30/02; F28F 3/022; F28F 3/048;
(Continued)

(56) References Cited

U.S. PATENT DOCUMENTS 12,066,197 B2 8/2024 Narayanan
2008/0283220 A1 11/2008 Martin
(Continued)

FOREIGN PATENT DOCUMENTS

CN 10344749 3/2014
CN 103644749 B * 9/2015
(Continued)

OTHER PUBLICATIONS

Narayanan, Vinod, et al., "Thermal Applications of Microchannel Flows", Encyclopedia of Aerospace Engineering, Wiley Online Library, Chapter eae613, 2013, pp. 1-16.
(Continued)

*Primary Examiner* — Harry E Arant
(74) *Attorney, Agent, or Firm* — O'BANION & RITCHEY LLP; John P. O'Banion

(57) ABSTRACT

Designs and applications of a polymer heat exchanger that includes a set of polymer plates with internal flow passages configured to carry a first gas or liquid. The set of plates is organized into a stack, wherein consecutive plates in the stack are separated by fins to form intervening flow passages for a second gas or liquid. The system includes a first liquid or gas flow pathway, which flows from an inlet, through the internal flow passages, to a first liquid or gas outlet. It also includes a second liquid or gas flow pathway, which flows from an inlet, through the intervening second gas or liquid passages, to an outlet. The first liquid or gas flow pathway flows in a direction opposite to a direction of the second
(Continued)

liquid or gas flow pathway to provide a counterflow design that optimizes heat transfer between the two flow pathways.

9 Claims, 41 Drawing Sheets

Related U.S. Application Data

(60) Provisional application No. 62/960,625, filed on Jan. 13, 2020.

(51) Int. Cl.
*F28F 3/08* (2006.01)
*F28F 21/06* (2006.01)

(58) Field of Classification Search
CPC ..... F28F 2250/106; F28F 2255/143; F28F 2260/02; F28F 3/10; F28F 2250/10; F28D 9/0037
See application file for complete search history.

(56) References Cited

U.S. PATENT DOCUMENTS

| | | | | |
|---|---|---|---|---|
| 2010/0229585 | A1 | 9/2010 | Bradford | |
| 2014/0355633 | A9 | 12/2014 | Geschwandner | |
| 2017/0211889 | A1 | 7/2017 | Schwalm | |
| 2019/0107342 | A1 | 4/2019 | Romanin | |
| 2020/0238452 | A1 | 7/2020 | Rutkowski | |
| 2020/0400385 | A1* | 12/2020 | Van Bael | F28D 20/02 |

FOREIGN PATENT DOCUMENTS

| | | | |
|---|---|---|---|
| CN | 107314699 | A | 11/2017 |
| CN | 207180437 | U | 4/2018 |
| JP | S60205193 | A * | 10/1985 |
| JP | 2020071008 | A | 5/2020 |
| WO | 9924772 | A1 | 5/1999 |

OTHER PUBLICATIONS

T'Joen, et al., "A review on polymer heat exchangers for HVAC&R applications", International Journal of Refrigeration, vol. 32, 2009, pp. 763-779.
Emergent Coils, https://cdn.shopify.com/s/files/1/0028/4753/9266/files/24x24_-_PR.pdf?47691194689317828, Jun. 25, 2018, 1 page.
Patel, A.B., et al., Science Direct, vol. 40, Issue 2, Feb. 1, 2000, pp. 91-98.
Harris, Chad, et al., "Fabrication, modeling, and testing of micro-cross-flow heat exchangers," in Journal of Microelectromechanical Systems, vol. 11, No. 6, Dec. 2002, pp. 726-735.
Malik, T, et al., "Suitability of Polymer Heat Exchangers for Air Conditioning Applications", University of Illinois at Urbana-Champaign, Project #148, Mar. 2005, pp. 1-24.
Cheng, Lixin, et al., "Experimental Study of Heat Transfer and Pressure Drop Characteristics of Air/Water and Air-Steam/Water Heat Exchange in a Polymer Compact Heat Exchanger", Heat Transfer Engineering, vol. 26, 2005, pp. 18-27.
Park, Younggil, et al., "Polymer-Tube-Bundle Heat Exchanger for Liquid to-Gas Applications", Purdue University, School of Mechanical Engineering, International Refrigeration and Air Conditioning, Jul. 14-17, 2008, pp. 1-9.
Chen, Li, et al., "Experimental investigation of plastic finned-tube heat exchangers, with emphasis on material thermal conductivity", Science Direct, vol. 33, Issue 5, Jul. 2009, pp. 922-928.
Smith, Kevin Michael, et al., "Development of a plastic rotary heat exchanger for room-basedventilation in existing apartments", Energy and Buildings, vol. 107, Nov. 15, 2015, pp. 1-10.
Ghosh, Bidisha, et al., "Design and Investigation into the Thermal and Mechanical Performance of a Polymer Composite Prototype Gas-Liquid Heat Exchanger", International Journal of Thermal and Environmental Engineering, vol. 11, No. 1, 2016, pp. 51-59.

* cited by examiner

DESIGNS AND APPLICATIONS OF A LOW-DRAG, HIGH-EFFICIENCY MICROCHANNEL POLYMER HEAT EXCHANGER

CROSS-REFERENCE TO RELATED APPLICATIONS

This application is a continuation-in-part of U.S. patent application Ser. No. 17/148,359 filed on Jan. 13, 2021, incorporated herein by reference in its entirety, now U.S. Pat. No. 12,066,197 issued on Aug. 20, 2024 which claims priority to, and the benefit of, U.S. provisional patent application Ser. No. 62/960,625 filed on Jan. 13, 2020, incorporated herein by reference in its entirety.

STATEMENT REGARDING FEDERALLY SPONSORED RESEARCH OR DEVELOPMENT

This invention was made with Government support under N00014-17-1-2811 awarded by the Office of Naval Research, and under DE-AR0001758 awarded by the Department of Energy. The Government has certain rights in the invention.

NOTICE OF MATERIAL SUBJECT TO COPYRIGHT PROTECTION

A portion of the material in this patent document may be subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

BACKGROUND

1. Technical Field

The disclosed embodiments generally relate to the design of heat exchangers for heating and cooling applications. More specifically, the disclosed embodiments relate to the design of a high efficiency polymer heat exchanger with microscale flow passages, which is suitable for 3D printing and injection molding manufacturing processes.

2. Background Discussion

Conventional air conditioning systems consume a large amount of energy and also suffer from refrigerant leakage issues. Refrigerant leakage produces detrimental effects because commonly used refrigerants, such as R-22, have high global warming potentials (GWPs). For this reason, governmental agencies have put into place various regulations and incentives to phase down the use of high GWP refrigerants and to move toward the use of low GWP refrigerants.

Low GWP refrigerants (which include HFC-32, HFC-152a, natural refrigerants such as ammonia and hydrocarbons such as propane) provide significant environmental benefits; however, they are flammable. Hence, in the interest of safety, they are best kept in hermetically, factory-sealed heat pump packages outside of a building. With this approach, a secondary fluid, such as water, is needed to transfer heat between an air handler (AH) located inside of the building, and a refrigeration system containing the low GWP refrigerant located outside of the building. In a typical finned-tube heat exchanger (FTHX), which is commonly used in such systems, a cross-counter flow configuration is used, wherein water flows in a perpendicular direction to the air-flow in tubes, and fins surrounding the tubes are used to enhance surface area between the tubes and the air. Such a cross-counter flow configuration achieves less heat-transfer efficiency than other possible designs, but is easier and more economical to manufacture.

Considering recent advances in manufacturing techniques, what is needed is a heat exchanger for use in heating and cooling systems, which provides high heat-transfer efficiency at low pressure drop (fan power) and is also economical to manufacture.

BRIEF SUMMARY

The disclosed embodiments relate to a system that implements a polymer heat exchanger with microscale flow passages. The system includes a set of plates comprised of a polymer that includes internal microscale flow passages, which are configured to carry a liquid. The set of plates is organized into a stack, wherein consecutive plates in the stack are separated by fins to form intervening air passages. The system includes a liquid flow pathway, which flows from a liquid inlet, through the internal microscale flow passages in the stack of plates, to a liquid outlet. It also includes an airflow pathway, which flows from an airflow inlet, through the intervening air passages between the consecutive plates in the stack of plates, to an airflow outlet. The liquid flow pathway flows in a direction opposite to a direction of the airflow pathway to provide a counterflow design that optimizes heat transfer between the liquid flow pathway and the airflow pathway.

Although this polymer heat exchanger (HX) provides advantages when used in low GWP refrigerant systems, use of this HX is not limited to low GWP refrigerant systems. In general, any air conditioning system that provides heating or cooling load to indoor spaces via heated or chilled liquid (water or glycol) can benefit from this HX. For example, there exist roof top central chillers, which are located in commercial buildings, hospitals, hotels, etc., that provide chilled water to buildings for cooling indoor air. There also exist central gas fired or solar water heaters that provide hot water. In these types of systems, forced air heating and/or cooling systems direct chilled water or hot water through conventional finned tube heat exchangers (FTHX) to condition the indoor air. Our new polymer HX can be used to replace these FTHXs to improve the overall efficiency and lower pressure drop and hence fan power.

In some embodiments, the system is used in industrial processes to efficiently extract low grade waste heat from gaseous heat sources such as steam and flue gas at temperatures below 100° C. to a liquid, which could be corrosive.

In some embodiments, the system is used to measure the flow rate of air by measuring a pressure drop across the heat exchanger (HX), wherein the pressure drop is used to continuously monitor the state of the HX to determine whether it needs to be serviced.

In some embodiments, in a heating and/or cooling split systems where the heat transfer liquid is directed to small HX units located in different zones of an indoor space while the air flow is provided by a central fan, real-time flow rate measurement across the HXs can serve as a useful monitoring tool to ensure balanced air flow distribution throughout the indoor space by sending flow rate feedback to the integrated duct dampers. In addition to enhancing user comfort and energy saving, this feature can be used to provide continuous HVAC commissioning rather than one time commissioning that might not be done properly.

In some embodiments, the fins that separate consecutive plates in the stack of plates are formed by protrusions, which are manufactured onto outer surfaces of the set of plates.

In some embodiments, the fins that separate consecutive plates are configured to be one or more of: straight, interrupted and contoured.

In some embodiments, the internal microscale flow passages within the set of plates include arrays of microscale pin fins to facilitate heat transfer and liquid flow distribution.

In some embodiments, pins that comprise the array of microscale pins are configured to be one or more of: circular, airfoil-shaped and twisted.

In some embodiments, the polymer heat exchanger is part of a heating and/or cooling system for a building. This heating and/or cooling system includes an external heat pump located outside of the building, which uses a low global warming potential (GWP) refrigerant. It also includes a refrigerant-to-liquid heat exchanger located outside of the building, which exchanges heat between the low GWP refrigerant from the external heat pump and a heat-transfer liquid. It additionally includes the polymer heat exchanger located inside the building, which exchanges heat between the heat-transfer liquid from the refrigerant-to-liquid heat exchanger and air, which flows through a heating and/or cooling system in the building.

In some embodiments, each plate in the set of plates is designed to be fabricated through an injection molding process, wherein a top surface and/or a bottom surface of the plate are formed through injection molding, and the top surface and the bottom surface are bonded together to form the plate, which includes the internal microscale flow passages.

In some embodiments, each plate in the set of plates is designed to be manufactured through an additive manufacturing process.

In some embodiments, each plate in the set of plates includes features that form a plenum, wherein when plates in the set of plates are stacked together, the plena in the individual plates form a continuous plenum, which is configured to carry liquid from the liquid inlet to the internal microscale flow passages, and from the internal microscale flow passages to the liquid outlet.

In some embodiments, the cross-sectional shape of the continuous plenum, which is the only blunt object in the air stream, can be contoured like (but is not limited to) a teardrop or airfoil shape to minimize drag forces and consequently reduce airflow pressure losses while passing across the heat exchanger. (Note that our system does not include any cross-flow blunt objects in the air stream, such as tubes in a finned tube HX. The only objects in cross-flow are the low-drag plena for scale up. This feature of the HX that lends to a low pressure drop.)

In some embodiments, the stacked set of plates forms a heat exchanger module that provides a duct for airflow for the airflow pathway, wherein the system includes multiple heat exchanger modules, which are stacked in one or more dimensions orthogonal to a direction of the airflow to form a larger duct assembly.

In heating and/or cooling split systems, single or multiple heat exchanger modules, which are stacked in one or more dimensions orthogonal to a direction of the airflow, can be plumbed into the ducts carrying the airflow into different indoor space zones.

In some embodiments, the liquid in the polymer heat exchanger comprises water or glycol.

In some embodiments, the internal microscale flow passages in the set of plates are 0.25 mm to 1.0 mm or less in width.

The disclosed embodiments also provide a process for fabricating a polymer heat exchanger with microscale flow passages. During this process, a set of plates is fabricated using a polymer, wherein the set of plates includes internal microscale flow passages, which are configured to carry a liquid. Next, the set of plates is organized into a stack, wherein consecutive plates in the stack are separated by fins to form intervening air passages. The process also involves forming a liquid flow pathway, which flows from a liquid inlet, through the internal microscale flow passages in the stack of plates, to a liquid outlet. The process additionally involves forming an airflow pathway, which flows from an airflow inlet, through the intervening air passages between the consecutive plates in the stack of plates, to an airflow outlet. The liquid flow pathway flows in a direction opposite to a direction of the airflow pathway to provide a counter-flow design that optimizes heat transfer between the liquid flow pathway and the airflow pathway.

In some embodiments, an additive manufacturing process is used to fabricate each plate in the set of plates.

BRIEF DESCRIPTION OF THE DRAWINGS

FIG. 21A depicts a charging mode and FIG. 21B depicts a discharge mode.

FIG. 22A depicts a charging mode, FIG. 22B depicts a discharge mode, and FIG. 22C depicts a discharging mode to cool air in an enclosed space.

DETAILED DESCRIPTION

Discussion

Figure 1:
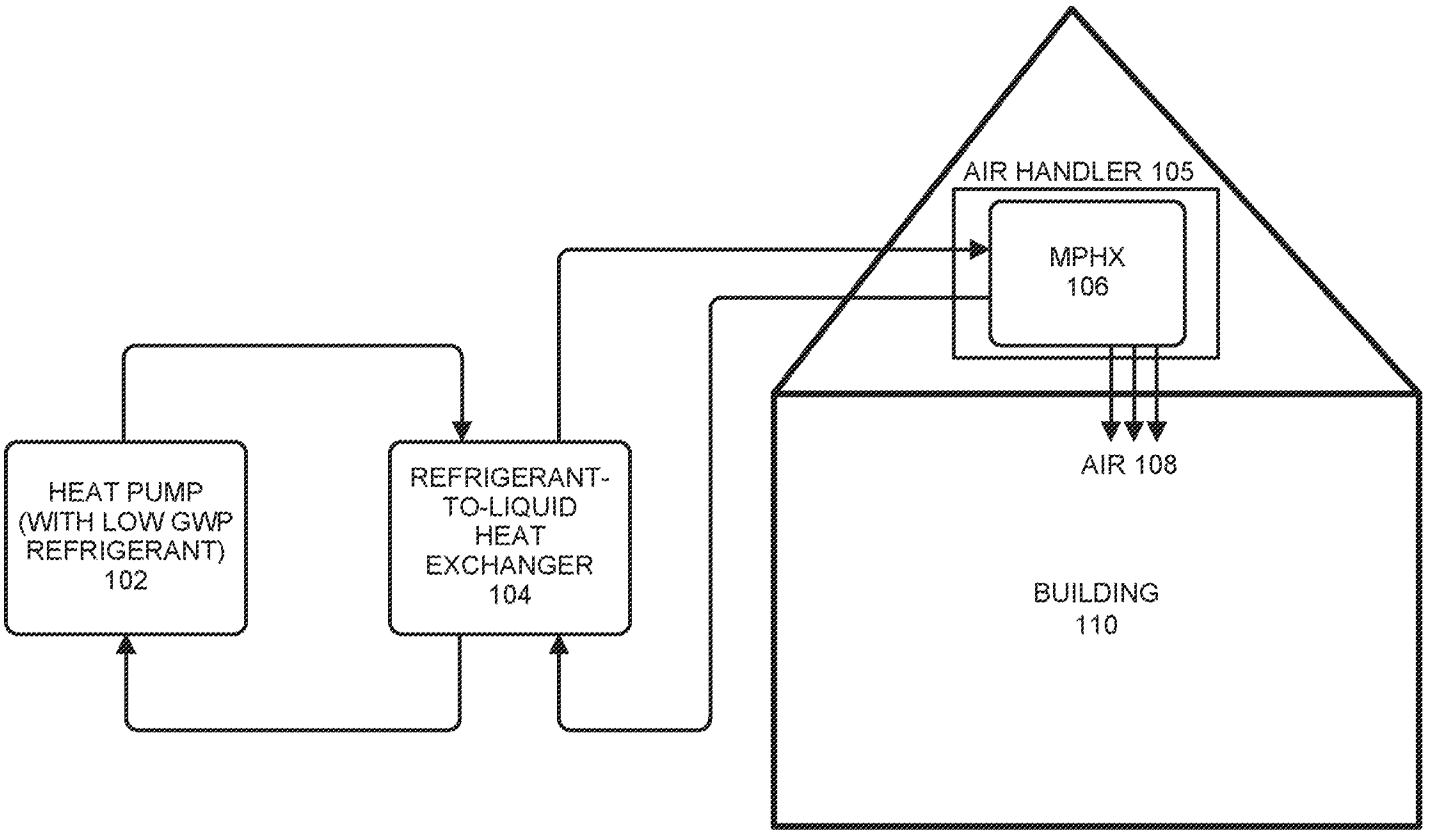
FIG. 1 illustrates an exemplary centralized heating and cooling system, which includes an external heat pump with a low GWP refrigerant in accordance with the disclosed embodiments.

Referring to FIG. 1, a modern heating and/or cooling system for a building includes an external heat pump 102 located outside of the building, which uses a low global warming potential (GWP) refrigerant. It also includes a refrigerant-to-liquid heat exchanger 104 located outside of the building, which exchanges heat between the low GWP refrigerant from the external heat pump 102 and the water. It additionally includes an air handler 105 with a microchannel polymer heat exchanger (MPHX) 106 located inside the building, which exchanges heat between the water from the refrigerant-to-liquid heat exchanger 104 and internal air 108, which flows through a heating and/or cooling system in the building 110.

Figure 2A:
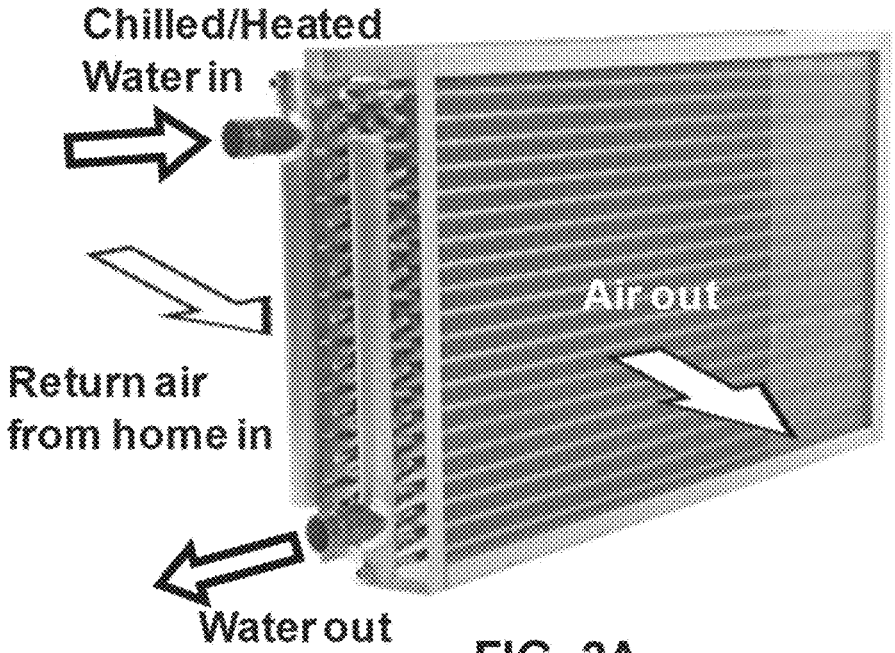
FIG. 2A (Prior Art)
FIG. 2A illustrates a conventional air-to-water heat exchanger.

Heat exchangers (HXs) can be classified as "counterflow" or "crossflow" depending on the direction of the passage of fluid within the HX. In a counterflow HX, the most efficient configuration, hot and cold fluids flow in opposite directions. The performance of a HX is defined in terms of "effectiveness," which is the ratio of actual exchanged heat to the maximum possible heat transfer rate. The maximum exchanged heat rate would be attained in an infinitely long counterflow HX. Thus, a higher effectiveness HX can transfer the same amount of heat in a smaller size. Note that the HX flow configuration does not matter for a refrigerant-to-air evaporator HX, wherein the refrigerant undergoes a phase change (boiling), as the effectiveness is independent of the refrigerant side because the temperature is saturated. However, the configuration of a water-to-air HX, such as MPHX 106, is important in determining its effectiveness. As is illustrated in FIG. 2A, in a typical finned-tube water coil HX (FTHX), which exists in conventional air handlers, a cross-counter flow configuration is used wherein water flows perpendicular to air-flow in tubes, wherein fins are used around the tubes on the air side to enhance surface area. Such a cross-counter flow configuration is less effective than counterflow but is easier to manufacture. In fact, the effectiveness of current state-of-the-art chilled water-to-air HX, with chilled water inlet temperature of 45° F. is only up to 0.7 under typical operating conditions.

FTHXs are also prone to performance degradation due to either air-side cloggage by dirt and/or dust, or water-side pollutants that cause corrosion and deposition of dissolved minerals on copper tubes. There are also numerous incidents of leakage of refrigerant or water from FTHXs due to severe corrosion. Note that organic acids and even regular household cleaners, solvents, paints, and carpet glue can travel into the air conditioning system and pass across the copper coil in the AH. The condensate on the coil provides a suitable environment for the mix of chemicals to initiate a reaction (known as formicary corrosion) with copper, which forms holes that branch into tunnels, and can penetrate into the tube wall resulting in leakage.

Section 1—MPHX Configurations

Figure 2B:
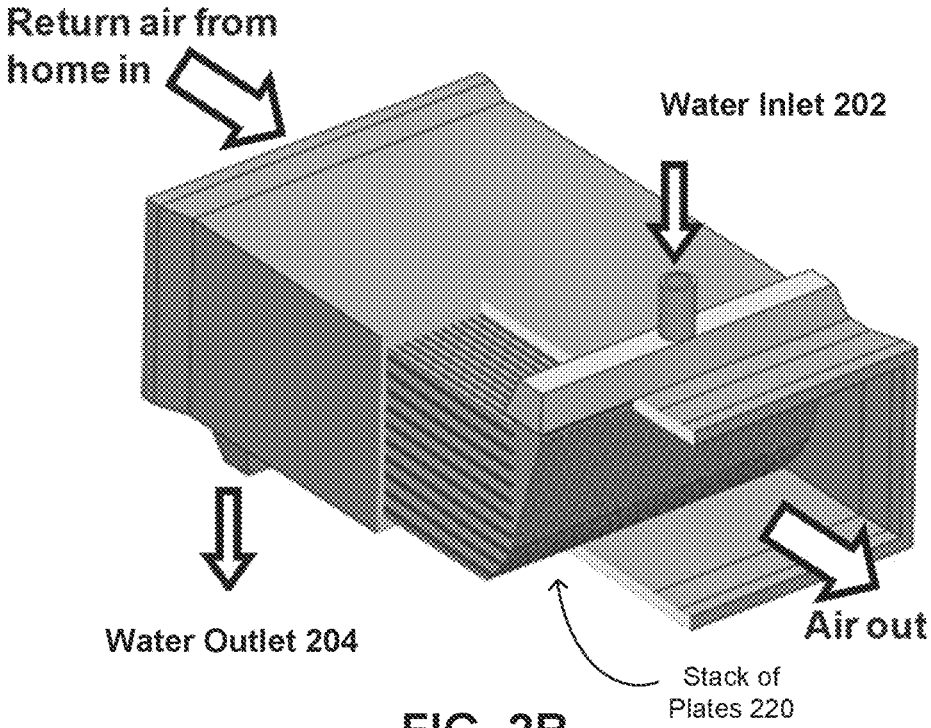
FIG. 2B illustrates a polymer heat exchanger with microscale flow passages in accordance with the disclosed embodiments.
Figure 2D:
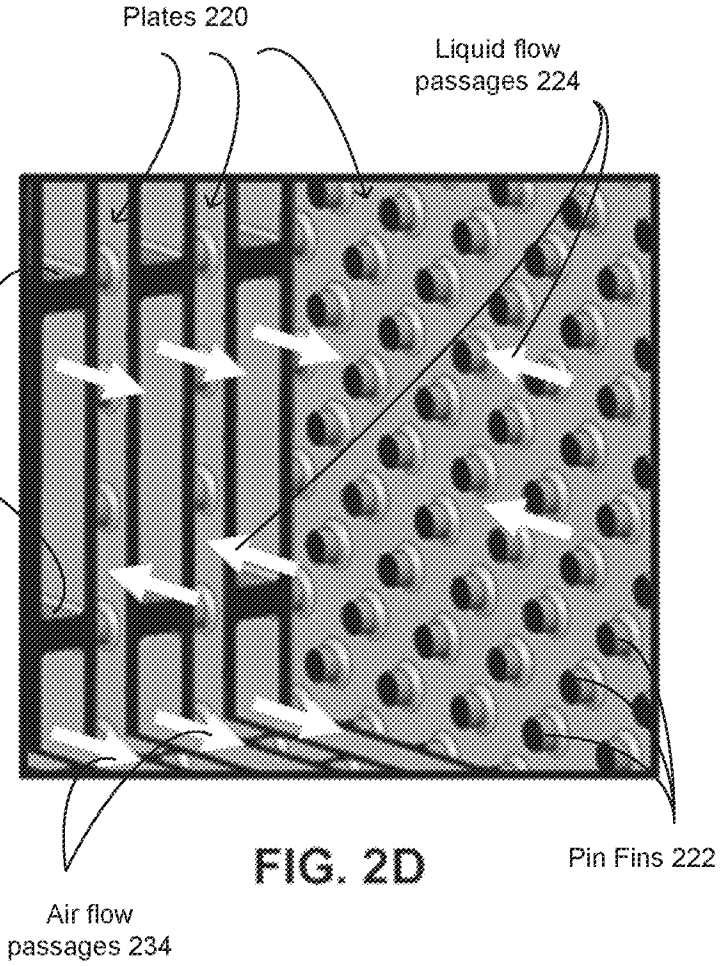
FIG. 2D illustrates internal channel details for the polymer heat exchanger in accordance with the disclosed embodiments.
Figure 2C:
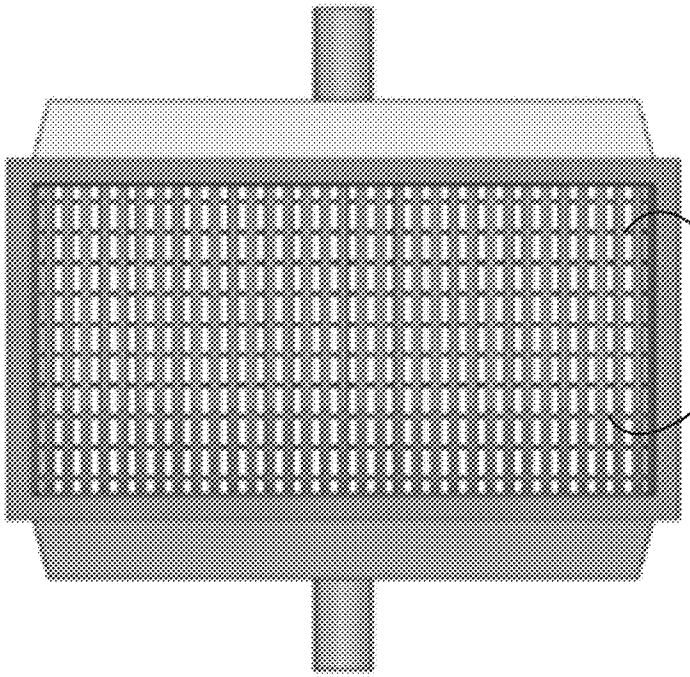
FIG. 2C presents a front view of the polymer heat exchanger in accordance with the disclosed embodiments.

Our new microchannel polymer heat exchanger (MPHX) design is illustrated in FIG. 2B. (A front view of the printed MPHX showing honeycomb air passages appears in FIG. 2C.) In contrast to a cross-flow finned tube design, a plate-type design is used wherein each fin in the traditional finned tube heat exchanger becomes a "water plate" 220 through which water flows directly. As depicted in the cut-away view of the plates in FIG. 2D, the MPHX comprises several water plates 220 spaced a certain distance (Sp) apart and connected to distributer and collector water manifolds. The water manifolds are located on either end of the water plates 220, and water is directed into each plate through designated openings and is distributed by using elongated flow distribution structures at the inlet and exit regions (e.g., water inlet 202 and water outlet 204 in FIG. 2B). Note that the water stream flows through an array of microscale pin fins 222 within each plate 220. A pin fin architecture (see detail in FIG. 2D) is used for the microscale regions since it leads to a higher heat transfer rate and better flow distribution than parallel microscale flow passages. As seen in FIGS. 2B and 2D, the plates are linked together using common inlet and exit headers. Return air flows around and in between the plates. To enhance the heat transfer coefficient on the air side, fin structures are designed on the outer surface of the water plates (e.g., air fins 232 in FIG. 2D). (See also FIGS. 2B and 2C.)

Several important parameters play a role in determining the overall size of the MPHX, such as cross-sectional dimensions of the duct carrying return air, water plate spacing, fin spacing, water plate pin fin geometry design, hot and cold flow inlet temperatures, heat load capacity, MPHX material, and 3D printing technology limitations.

Small-Scale MPHX Design

Figure 3B:
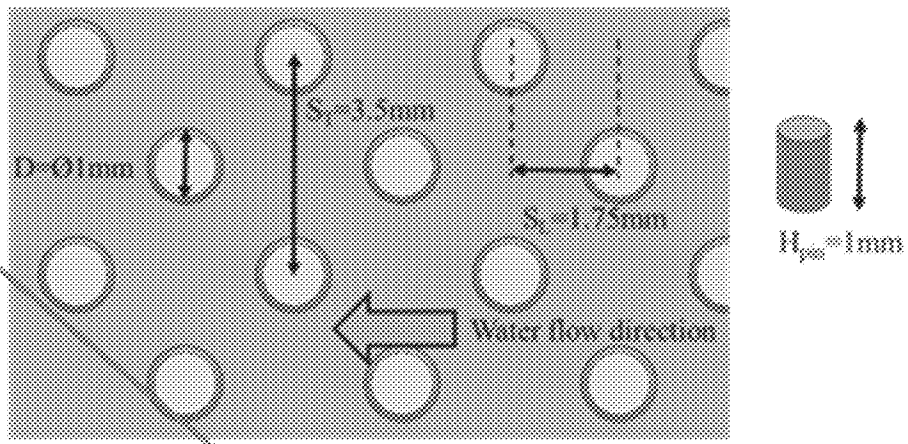
FIG. 3B illustrates pin fin dimensions and spacings for the water plate in accordance with the disclosed embodiments.
Figure 3A:
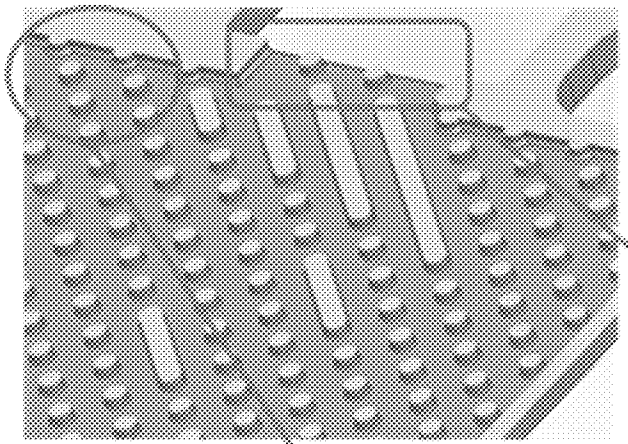
FIG. 3A illustrates the internal architecture of a single water plate in accordance with the disclosed embodiments.

Based on the general concept of the MPHX, a small-scale unit was designed, fabricated and characterized. The design of the water plate is important for the structural integrity of the MPHX. The headers and water plates were designed to enable good flow distribution and withstand the internal water loop pressure. As shown in FIG. 3A, within each water plate microchannel two types of microstructures provide structural support against internal system pressure, wherein the system is designed for a water loop pressure of 10 bar. The microstructures in the inlet and outlet regions of a water plate are designed such that flow is distributed uniformly along the width of the plate. The rest of the water plate is comprised of a pin array. The design of micro pin fins along the length of the cold plate is important in enhancing heat transfer and determining subsequent water pressure drop.

Figure 3C:
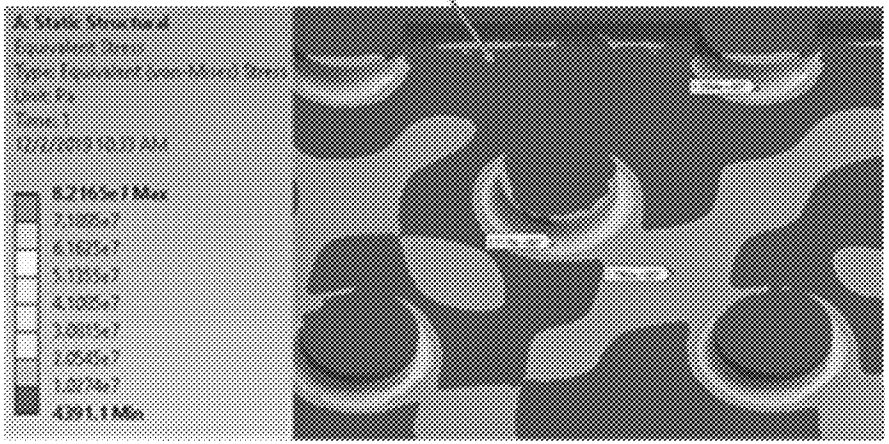
FIG. 3C illustrates equivalent Von-Mises stress contours within the pin array region in accordance with the disclosed embodiments.
Figure 3D:
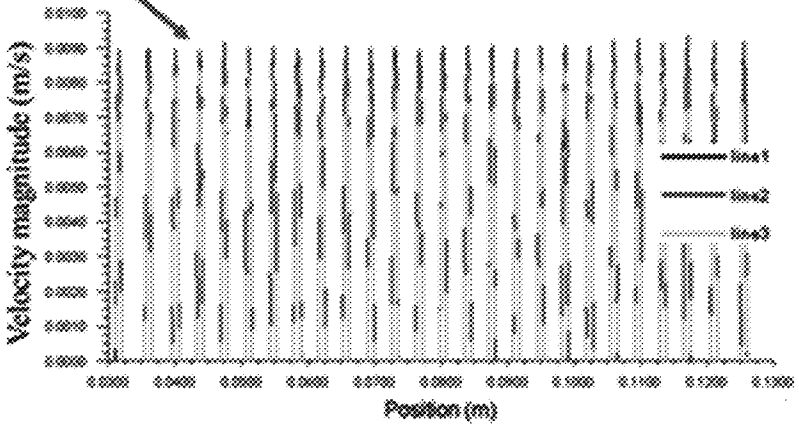
FIG. 3D presents a graph of velocity magnitude at the inlet of the water plate assembly in accordance with the disclosed embodiments.
Figure 4A:
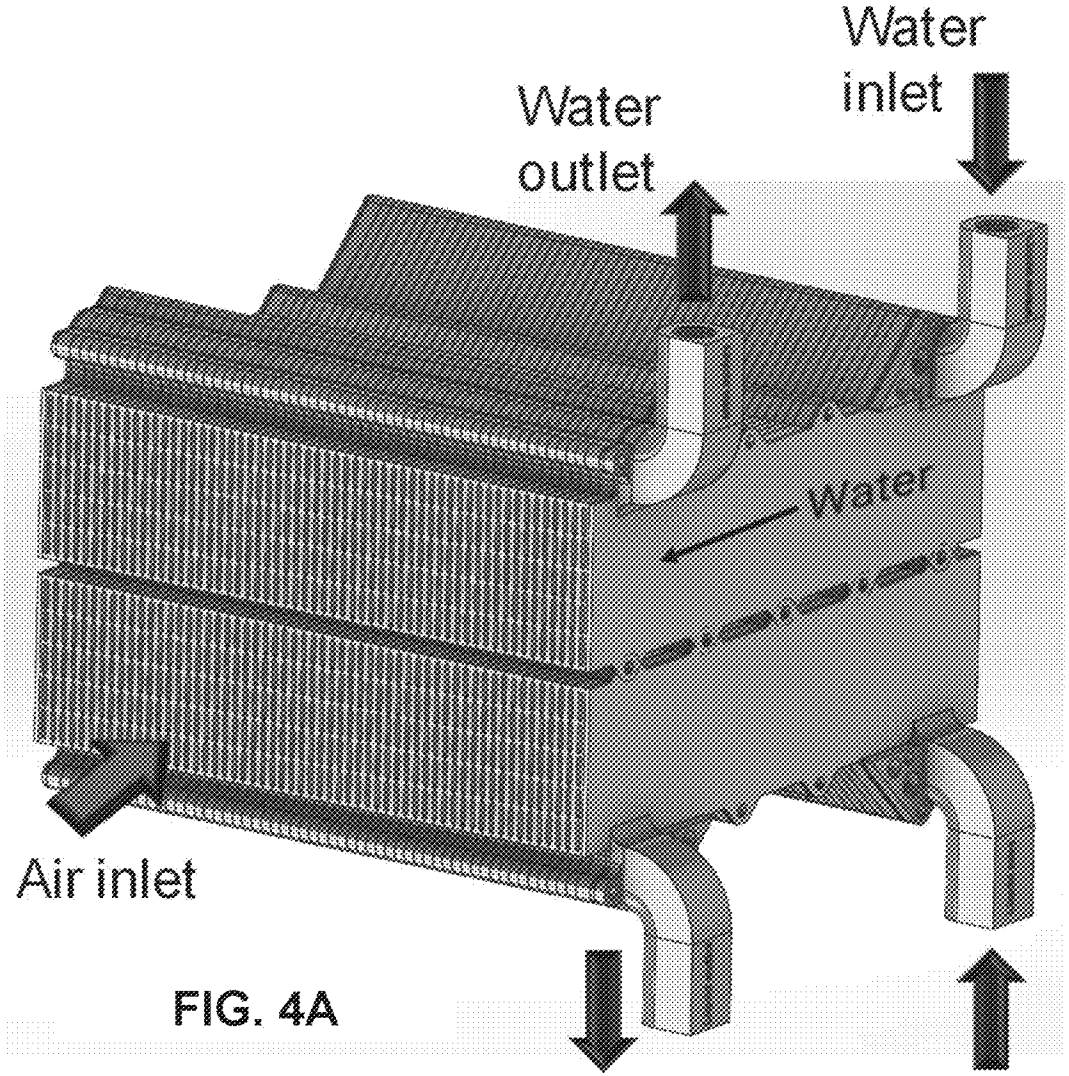
FIG. 4A illustrates a 3D printed polymer heat exchanger in with microscale flow passages with integrated plena in each plate that interconnect together to form a single inlet and exit plenum accordance with the disclosed embodiments.
Figure 4B:
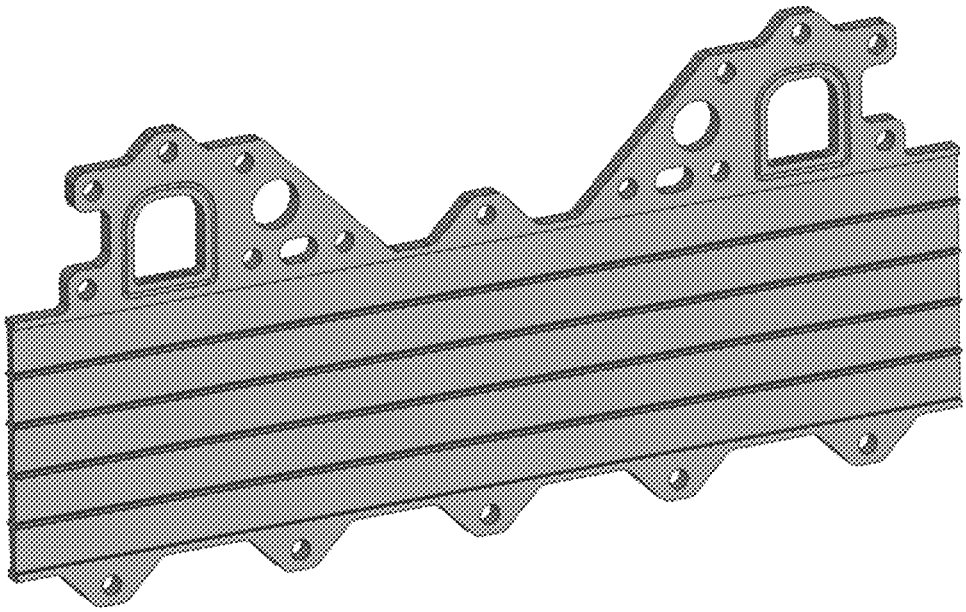
FIG. 4B illustrates a 3D printed water plate for a polymer heat exchanger with microscale flow passages in accordance with the disclosed embodiments.
Figure 4C:
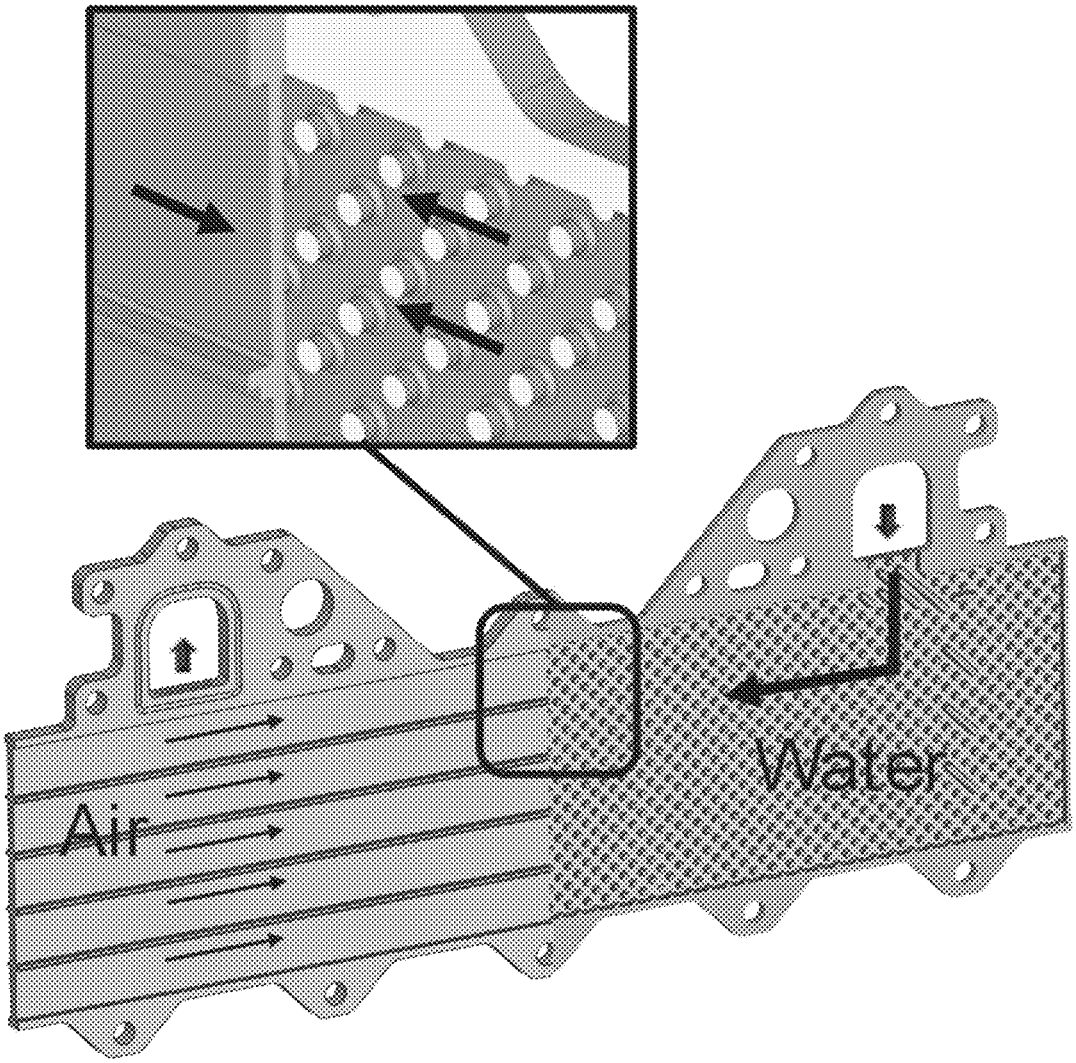
FIG. 4C presents a cut-away view of a 3D printed water plate for a polymer heat exchanger with microscale flow passages in accordance with the disclosed embodiments.
Figure 5A:
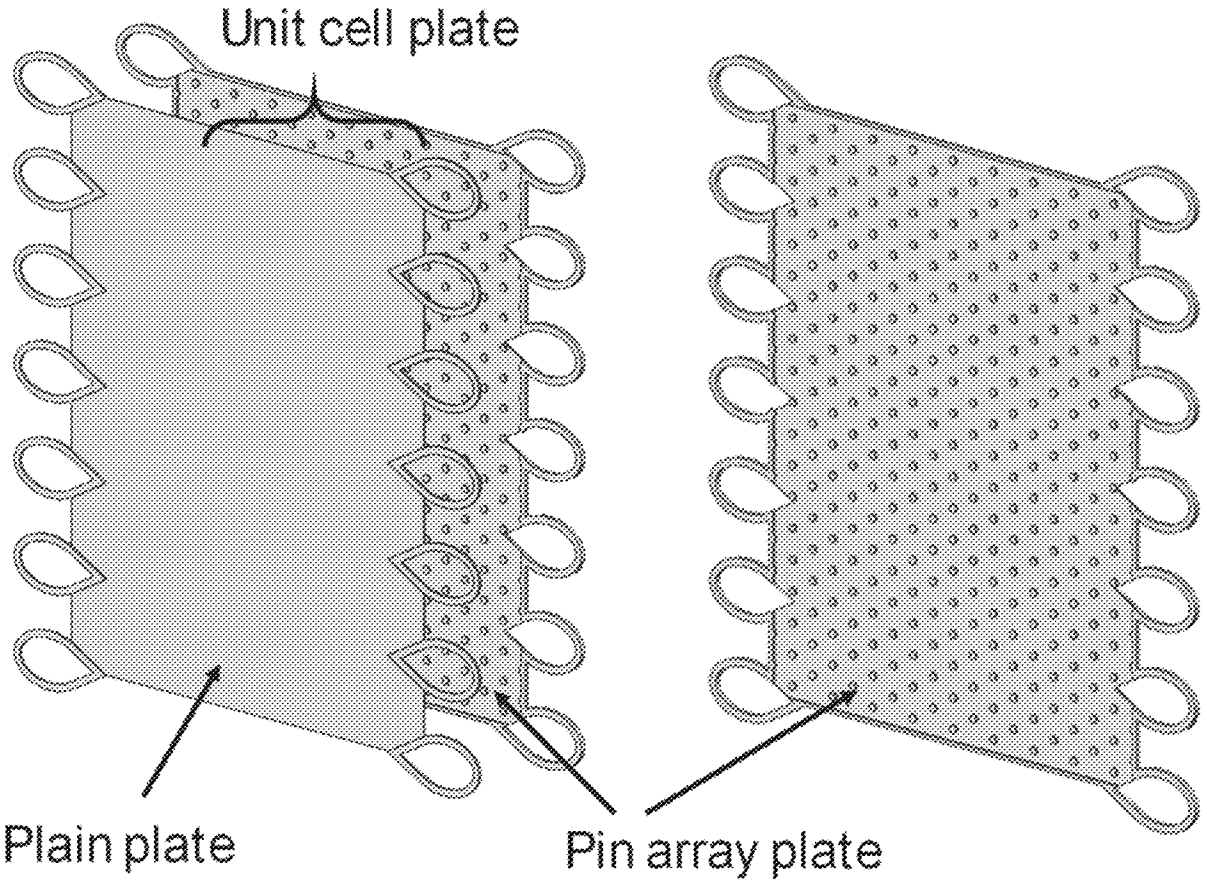
FIG. 5A illustrates an injection-molded unit cell plate for a polymer heat exchanger with microscale flow passages in accordance with the disclosed embodiments.
Figure 5B:
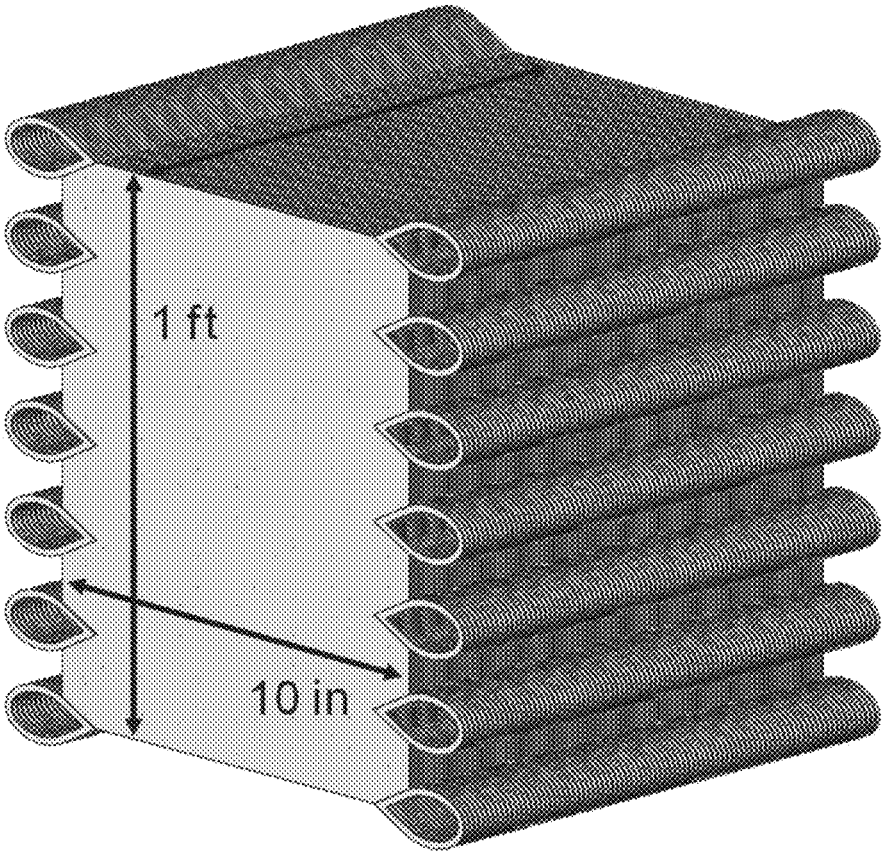
FIG. 5B illustrates how injection-molded unit cell plates are stacked together to form a polymer heat exchanger module in accordance with the disclosed embodiments.
Figure 5C:
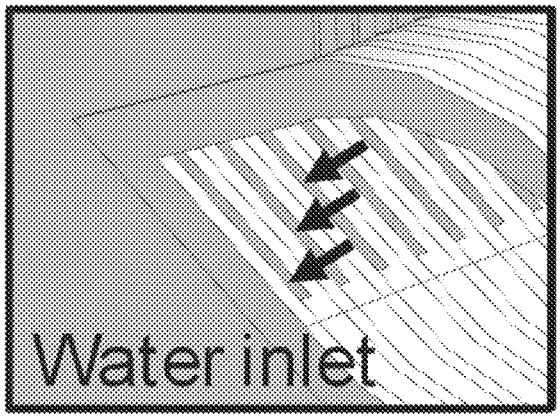
FIG. 5C presents a detailed view illustrating water inlets in a plenum, which is part of a polymer heat exchanger module formed by stacking injection-molded unit cell plates in accordance with the disclosed embodiments.
Figure 5D:
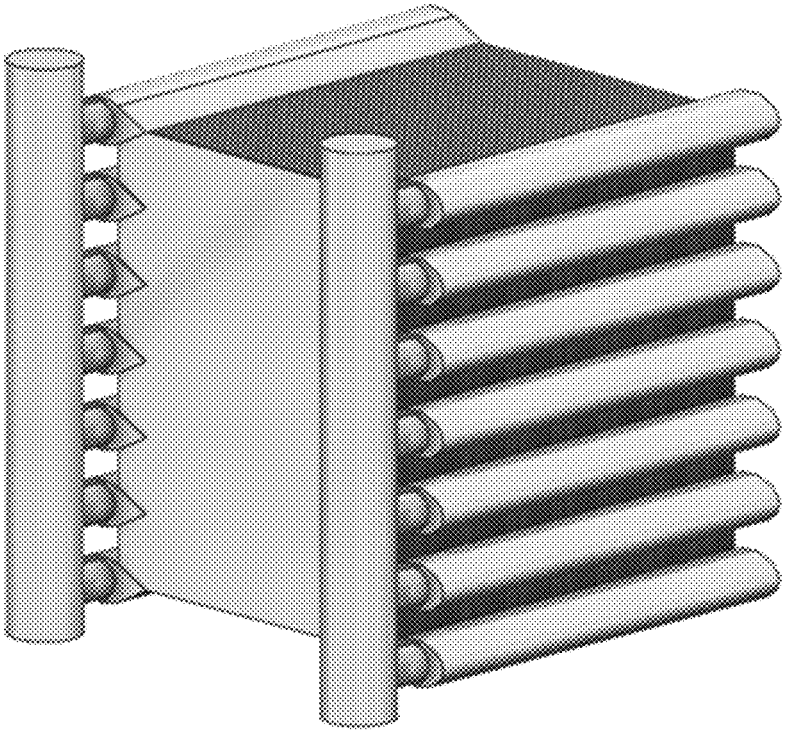
FIG. 5D illustrates how the polymer heat exchanger module illustrated in FIG. 5C is connected to water inlet and outlet pipes to form a module in accordance with the disclosed embodiments.
Figure 5E:
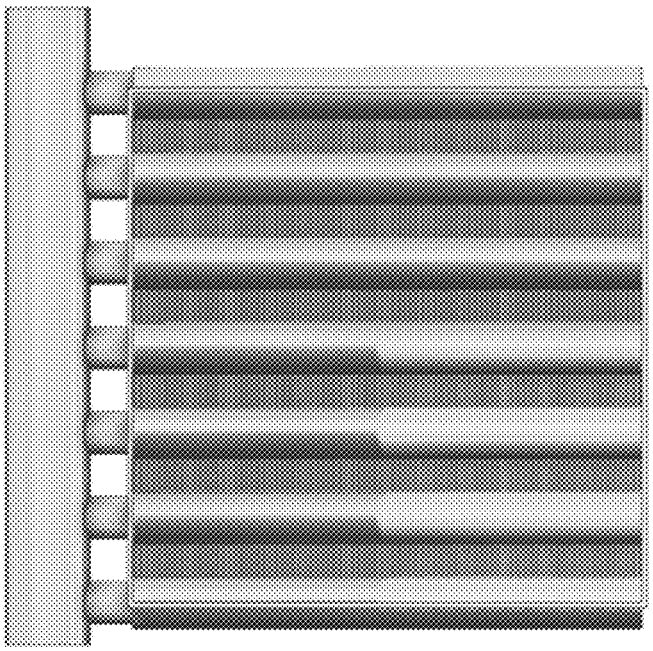
FIG. 5E presents a view through the duct of the polymer heat exchanger module illustrated in FIG. 5D in accordance with the disclosed embodiments.
Figure 5F:
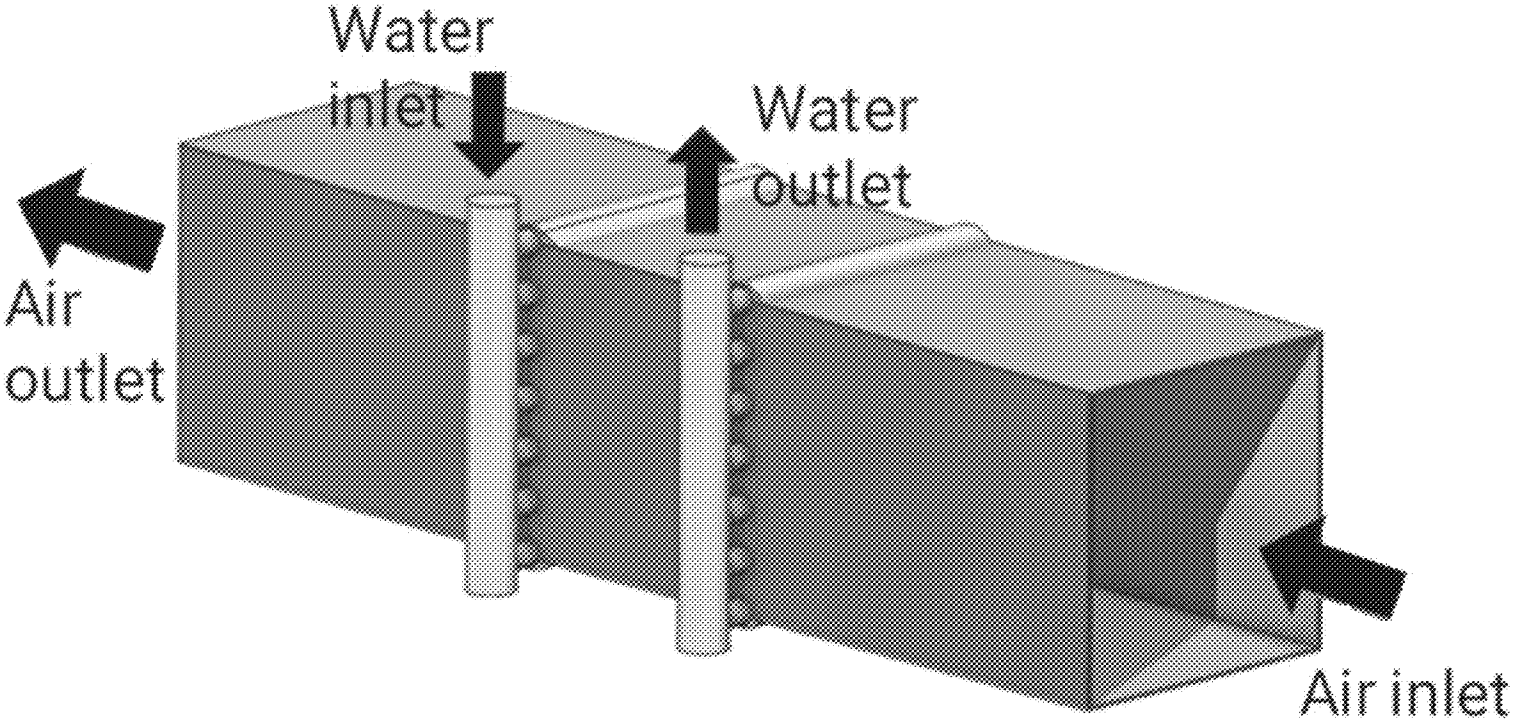
FIG. 5F illustrates how the polymer heat exchanger module illustrated in FIG. 5D is connected to an air inlet and an air outlet in accordance with the disclosed embodiments.
Figure 5H:
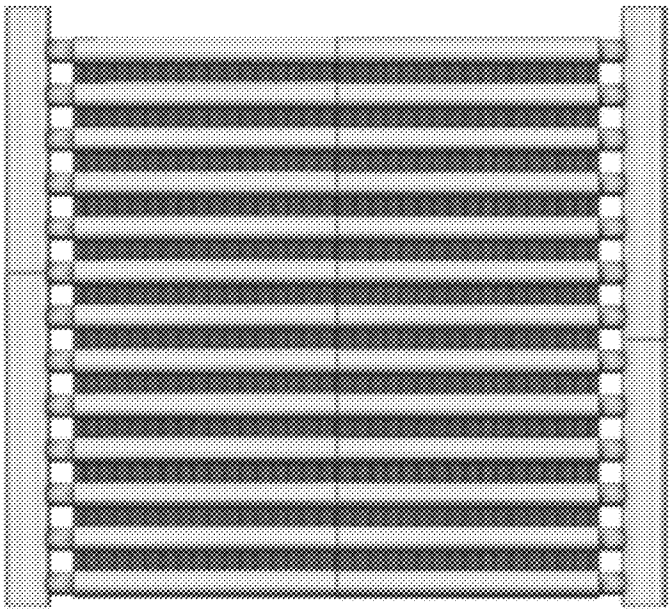
FIG. 5H presents a view through the duct of the larger polymer heat exchanger module illustrated in FIG. 5G in accordance with the disclosed embodiments.
Figure 5G:
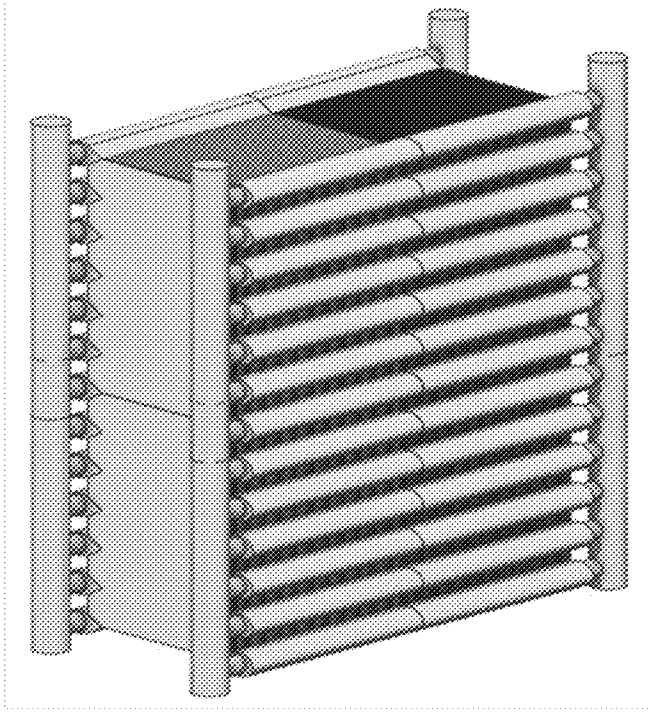
FIG. 5G illustrates how four of the polymer heat exchanger modules illustrated in FIG. 5D can be connected to form a larger polymer heat exchanger in accordance with the disclosed embodiments.

In order to arrive at a viable header and plate design capable of withstanding an internal pressure of 10 bar while having uniform flow distribution, structural and computational CFD analyses were iteratively performed. First, mechanical integrity simulations were performed. An absolute pressure of 10 bar was imposed on all the internal surfaces, while the outer exposed surfaces were left at atmospheric pressure (1 bar). The resulting selected pin fin dimensions following several iterations are shown in FIG. 3B. The corresponding stress values on pin fins due to 10 bar internal pressure is shown in FIG. 3C. The tensile yield strength of EPX 82 resin at 20° C. is 82 MPa. The mechanical simulations showed that the equivalent stress almost everywhere within the water plate was below 50 MPa. Upon verification of the structural aspects of the design, CFD simulations were performed to ensure uniform flow distribution from the header into each water plate and across the plates. For the lower limit (worst-case scenario for flow distribution) inlet mass flow rate to each water plate of ~0.04 g/s, the velocity magnitude at the inlet of the water plate assembly (26 plates to form a 4 in wide MPHX) is shown in FIG. 3D. As shown in FIG. 3A, two pin fins are located at the inlet region for structural integrity. These pins divide the incoming stream into three sections. FIG. 3D presents a graph illustrating the velocity magnitude of the cell elements located on three lines that connect the centerline of corresponding open sections on water plate assembly. High velocity magnitudes belong to those cell elements located in mid distance from two adjacent walls, and by moving toward the walls due to no-slip boundary conditions, the velocity decreases to zero value. The overall velocity magnitude profile shown in FIG. 3D indicates acceptable distribution of flow from the header into the water plate assembly.

Small-Scale MPHX Fabrication

A Continuous Liquid Interface Production (CLIP) 3D printing technique was used to fabricate a small-scale MPHX. In this technique, the 3D model of the MPHX was projected in a successive series of UV images from part cross section through an oxygen-permeable window into a reservoir containing UV-curable resin. As a sequence of UV images was projected, the projected cross sections of MPHX solidified layer by layer while the build platform was pulling out the solid body. Advantages of this printing technique include: short print time; capability of printing complex geometries with internal porosity; better mechanical properties even at higher temperatures (cyanate ester resin with 231° C. heat deflection temperature); and very fine resolution pixels as low as 75 μm (Carbon3D 2019). The small-scale MPHX was fabricated using UMA 90 (urethane methacrylate) resin.

Process of Operating an MPHX

Figure 6:
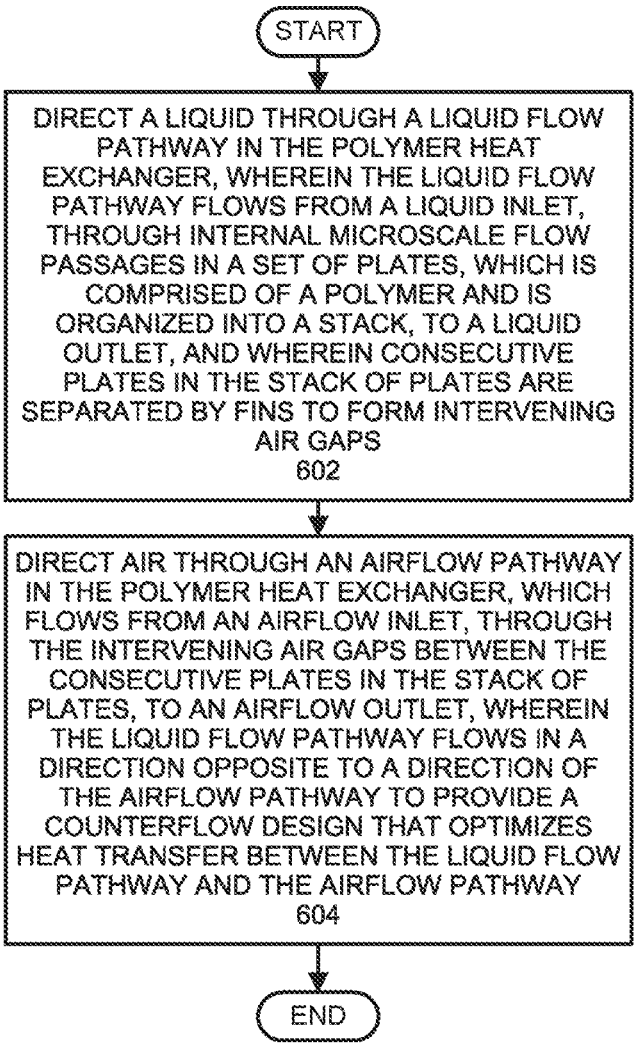
FIG. 6 presents a flow chart illustrating a process for operating a polymer heat exchanger with microscale flow passages in accordance with the disclosed embodiments.

FIG. 6 presents a flow chart illustrating a process for operating an MPHX in accordance with the disclosed embodiments. This process involves directing a liquid through a liquid flow pathway in the polymer heat exchanger, wherein the liquid flow pathway flows from a liquid inlet, through internal microscale flow passages in a set of plates (e.g., liquid flow passages 224 of FIG. 2D), which is comprised of a polymer and is organized into a stack, to a liquid outlet, and wherein consecutive plates in the stack of plates are separated by fins to form intervening air passages (step 602). The process also involves directing air through an airflow pathway in the polymer heat exchanger, which flows from an airflow inlet, through the intervening air passages between the consecutive plates in the stack of plates (e.g., air flow passages 234 of FIG. 2D), to an airflow outlet, wherein the liquid flow pathway flows in a direction opposite to a direction of the airflow pathway to provide a counterflow design that optimizes heat transfer between the liquid flow pathway and the airflow pathway (step 604).

Fabrication Process

Figure 7:
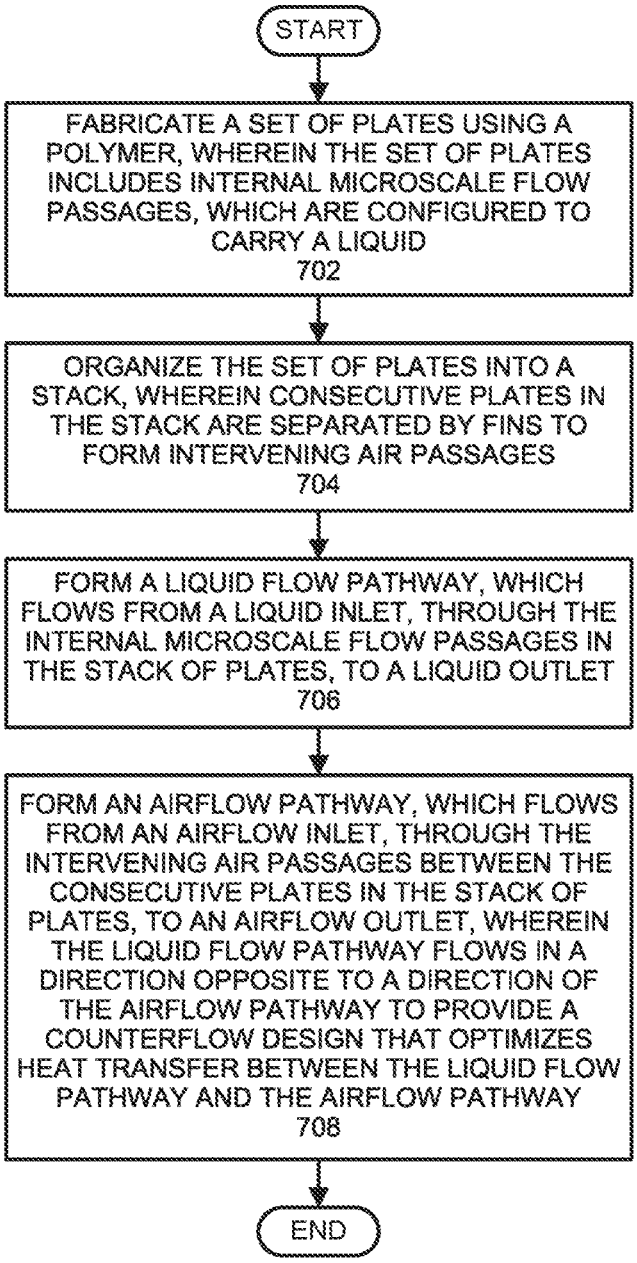
FIG. 7 presents a flow chart illustrating a process for fabricating a polymer heat exchanger with microscale flow passages in accordance with the disclosed embodiments.

FIG. 7 presents a flow chart illustrating a process for fabricating a polymer heat exchanger with microscale flow passages in accordance with the disclosed embodiments. This process involves fabricating a set of plates using a polymer, wherein the set of plates includes internal microscale flow passages, which are configured to carry a liquid (step 702). Next, the process organizes the set of plates into a stack, wherein consecutive plates in the stack are separated by fins to form intervening air passages (step 704). The process also involves forming a liquid flow pathway, which flows from a liquid inlet, through the internal microscale flow passages in the stack of plates, to a liquid outlet (step 706). The process additionally involves forming an airflow pathway, which flows from an airflow inlet, through the intervening air passages between the consecutive plates in the stack of plates, to an airflow outlet, wherein the liquid flow pathway flows in a direction opposite to a direction of the airflow pathway to provide a counterflow design that optimizes heat transfer between the liquid flow pathway and the airflow pathway (step 708).

Various Liquid Plate Designs

Figure 8A:
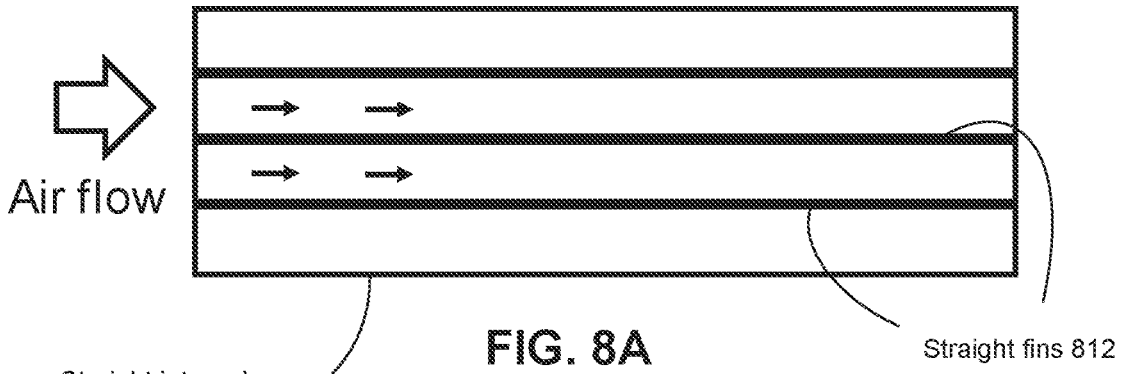
FIG. 8A illustrates a variant of a liquid plate design with straight internal passages and straight external fins stretched along the length of a plate in accordance with the disclosed embodiments.

A number of variations of the liquid plate designs are possible. For example, FIG. 8A illustrates a variant of the liquid plate design, which has straight internal passages 802 and straight external fins 812 stretched along the length of a plate.

Figure 8B:
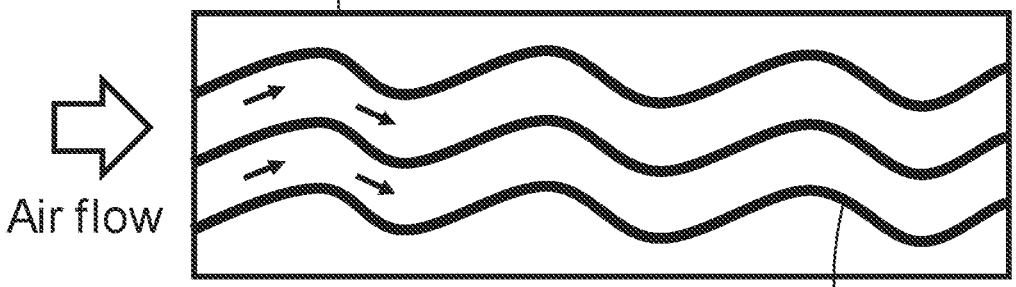
FIG. 8B illustrates a variant of liquid plate design, which has straight internal passages and curvy external fins, in accordance with the disclosed embodiments.

In contrast, FIG. 8B illustrates a variant of the liquid plate design, which has straight internal passages 802 and curvy (e.g., contoured) external fins 814. This design increases the length of the air passages, which leads to a longer residence time for the air. Hence, this design enhances heat transfer with the tradeoff of increasing the pressure drop on the air passage side.

Figure 8C:
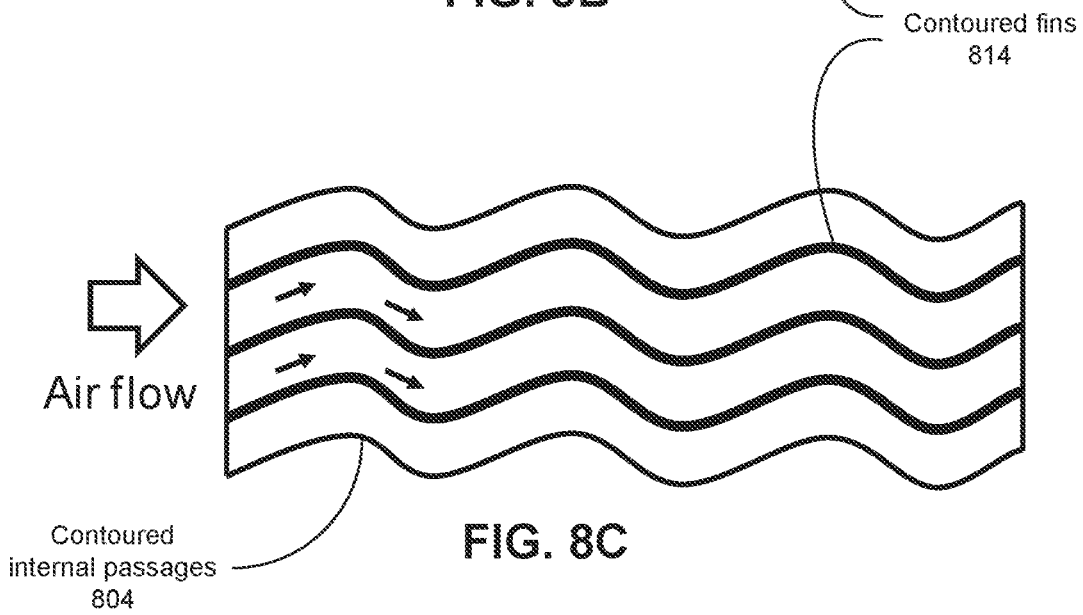
FIG. 8C illustrates a variant of water plate design, which has countered internal passages with conformal external fins that are similarly contoured, in accordance with the disclosed embodiments.

FIG. 8C illustrates a variant of liquid plate design, which has contoured internal passages 804 with conformal external fins 814 that are similarly contoured. This design increases both air and liquid passage lengths while keeping both flow streams in fully counter-flow order. Note that this design increases residence time in both liquid and air streams, which are flowing in counter directions. Hence, this design enhances heat transfer with the tradeoff of increasing pressure drop in both the air and liquid sides.

Figure 9:
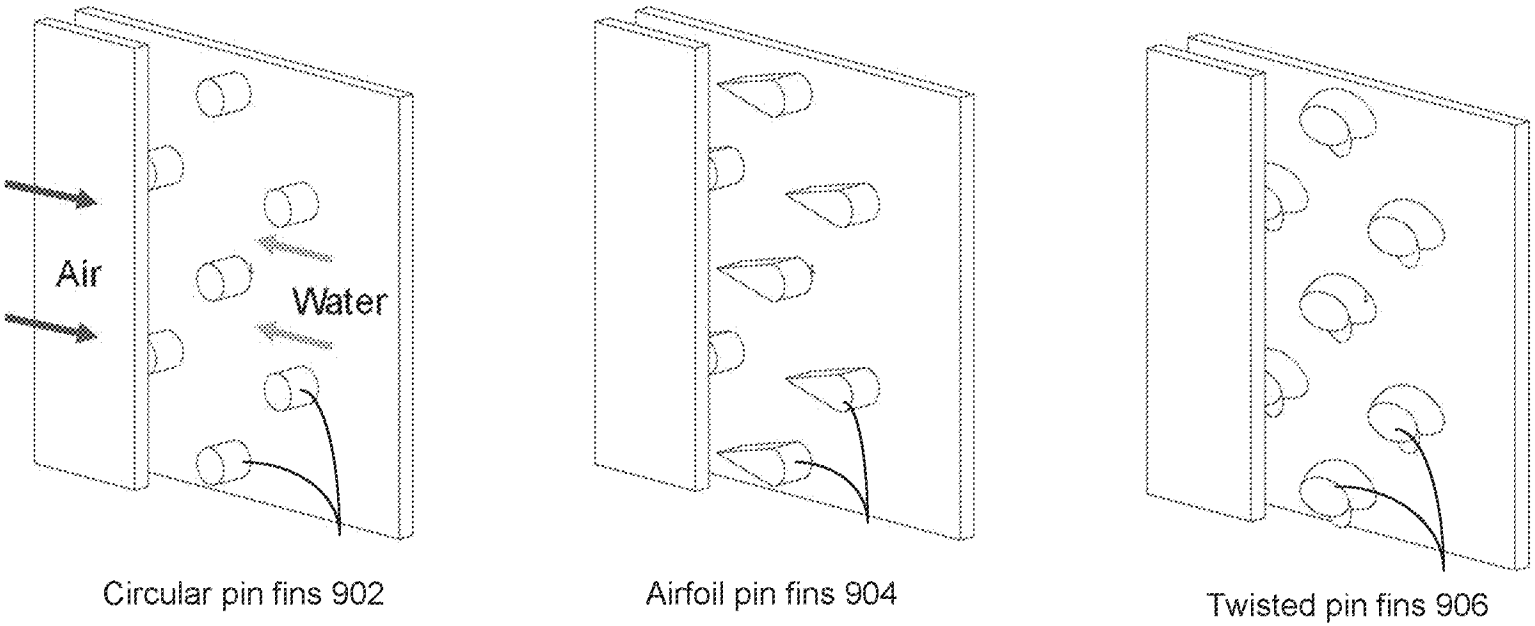
FIG. 9 illustrates variants of liquid plates with different pin fin shapes that can enhance heat transfer and/or reduce pressure drop on the liquid side in accordance with the disclosed embodiments.

Finally, FIG. 9 illustrates three variations of liquid plates with different pin fin shapes that enhance heat transfer and/or reduce pressure drop on the liquid side in accordance with the disclosed embodiments. As illustrated in FIG. 9, the liquid plates can have pin fin shapes that are circular 902, airfoil-shaped 904 or twisted 906.

Section 2—Exemplary MPHX Applications

Figure 10:
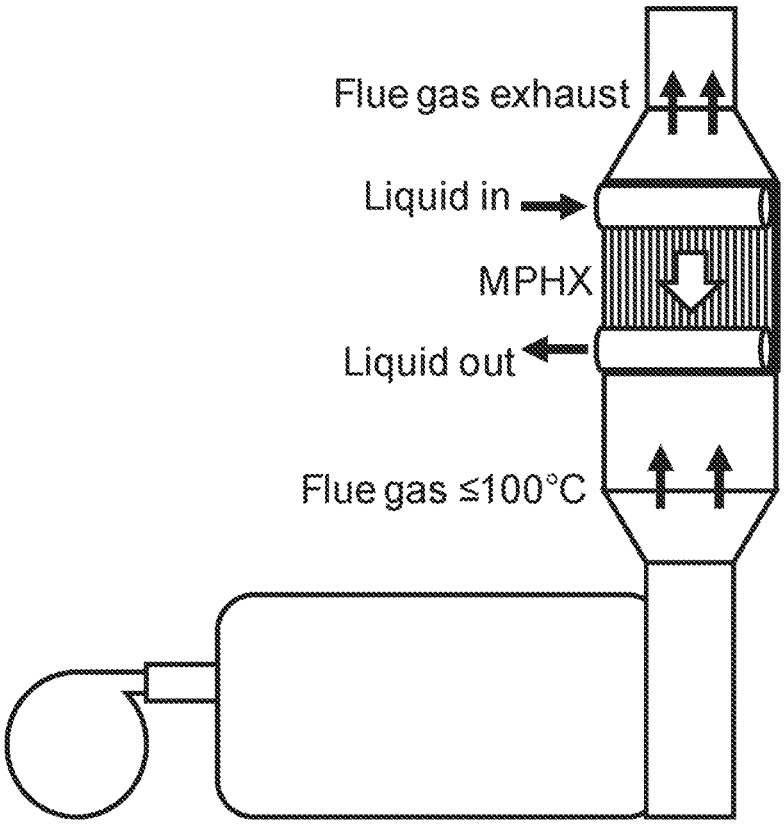
FIG. 10 illustrates an exemplary waste heat recovery system for an industrial process in accordance with the disclosed embodiments.
Figure 11:
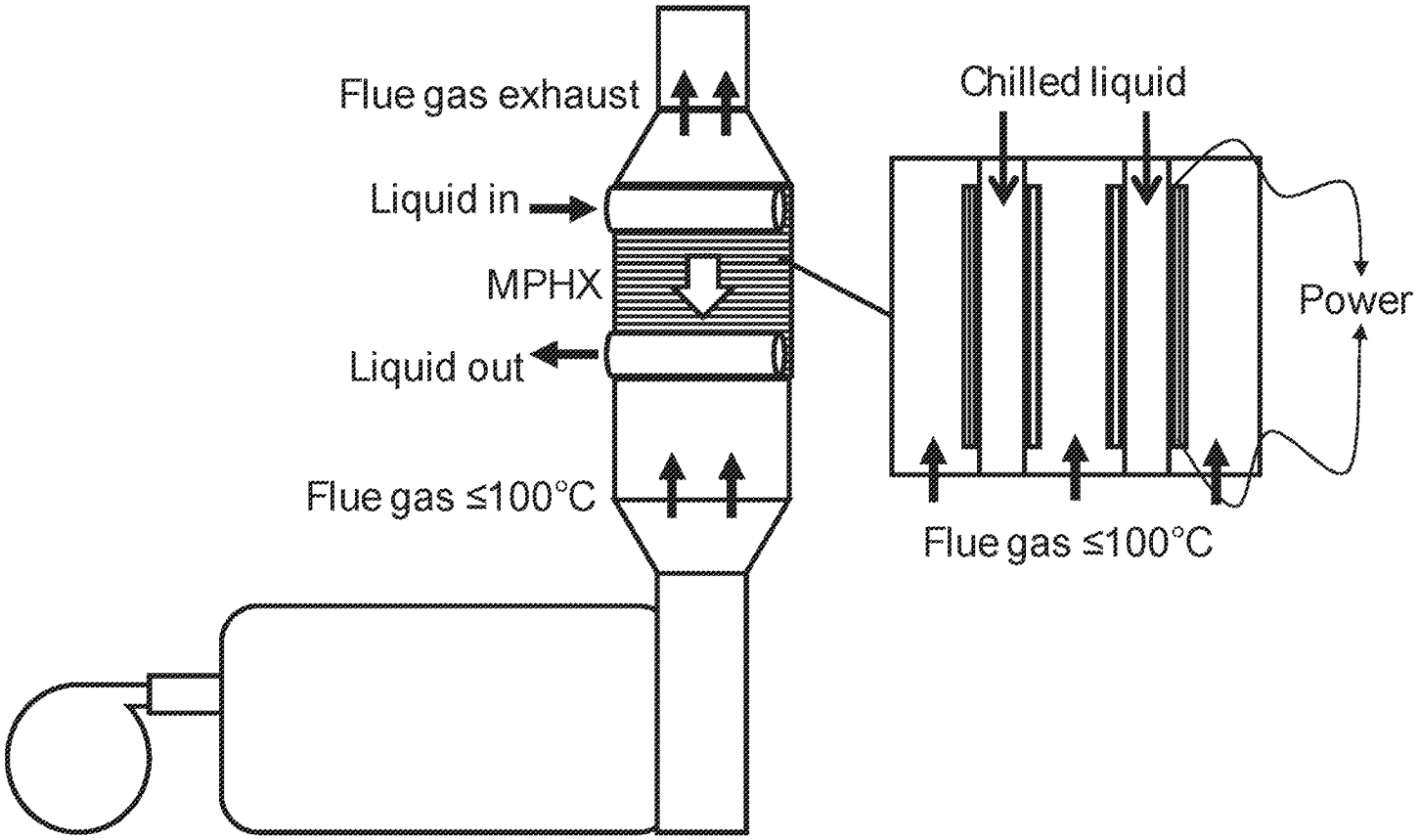
FIG. 11 illustrates an exemplary waste heat recovery system for an industrial process, which is integrated with thermoelectric device, in accordance with the disclosed embodiments.
Figure 12:
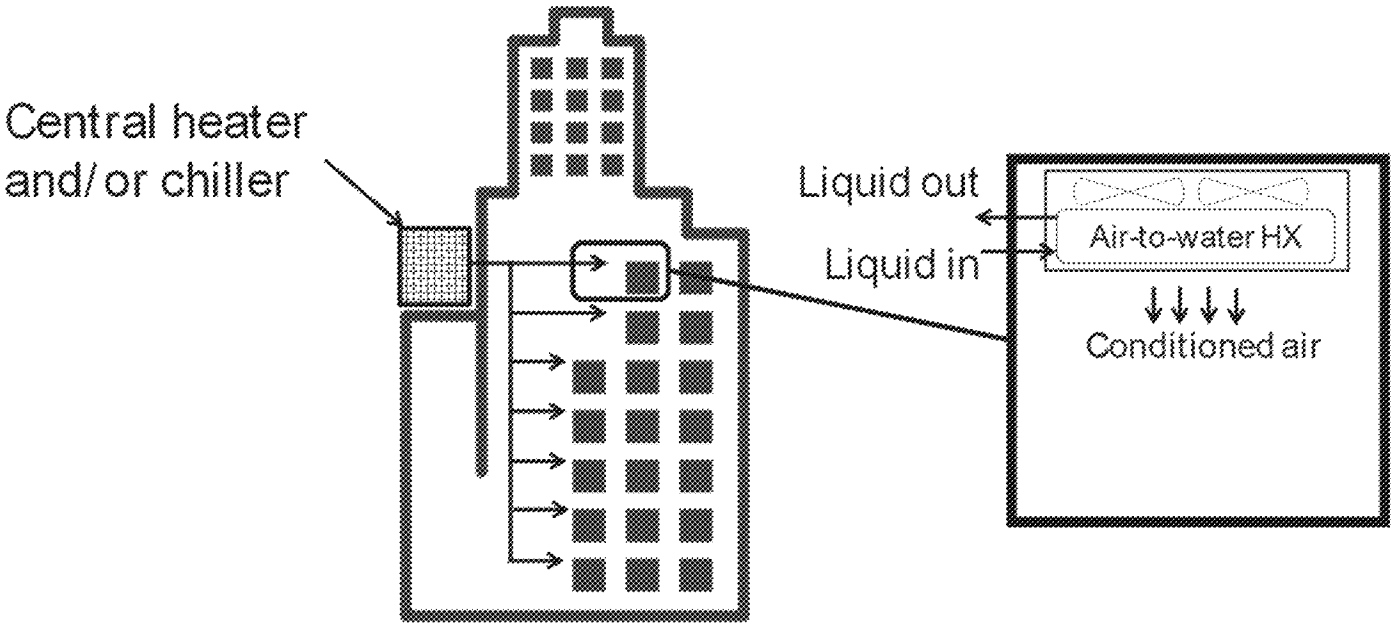
FIG. 12 illustrates an exemplary air conditioning system integrated with a central heater and/or chiller in a commercial building that provides hot and/or chilled liquid (water or glycol) to the building for air conditioning in accordance with the disclosed embodiments.
Figure 13:
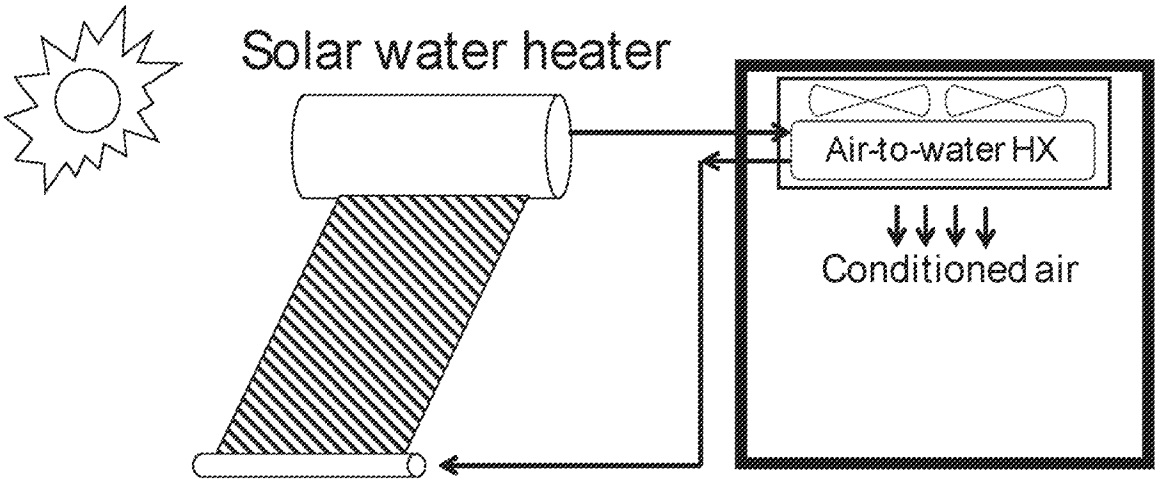
FIG. 13 illustrates an exemplary heating system integrated with a solar water heater in accordance with the disclosed embodiments.

The disclosed heat exchanger can also be used in different applications. For example, FIG. 10 illustrates using the heat exchanger to perform waste heat recovery for an industrial process. FIG. 11 illustrates a variation of the heat exchanger illustrated in FIG. 10, wherein the heat exchanger is integrated with a thermoelectric device that operates based on the Peltier effect. In another application, FIG. 12 illustrates an exemplary air conditioning system, which is integrated with a central heater and/or chiller, with a heat exchanger that operates in a commercial building and provides hot and/or chilled liquid (water or glycol) to the building for air conditioning purposes. FIG. 13 illustrates an exemplary heating system that includes a heat exchanger, which is integrated with a solar water heater. Finally, our heat exchanger design can also be used in automotive applications, for example in a radiator.

In the discussion that follows, the phrases "disclosed heat exchanger", "heat exchanger according to this disclosure", and their equivalents, are used interchangeably to refer to the polymer heat exchanger described in Section 1 above. The following discussion presents designs and applications of the disclosed heat exchanger, where fluids may vary, dimensions of flow passages may vary, interconnections to other equipment may vary, a porous membrane may be included in various implementations, operational modes may vary, the heat exchange may be integrated with a thermal storage medium in some implementations, among other variations and implementations. In each of the designs and applications described, the mechanical configuration of the heat exchanger will be the same, substantially the same, or a slight variation of the polymer heat exchanger described above, and any differences will be pointed out in the description below. Additionally, the phrases "internal passages" and "internal flow passages" are intended to refer to the same passages, and the phrases "intervening passages" and "intervening flow passages" are intended to refer to the same passages. In some embodiments, liquid or gas may flow through either type of passage. In some embodiments, a thermal energy storage material may be positioned within or around the intervening flow passages.

Figure 14:
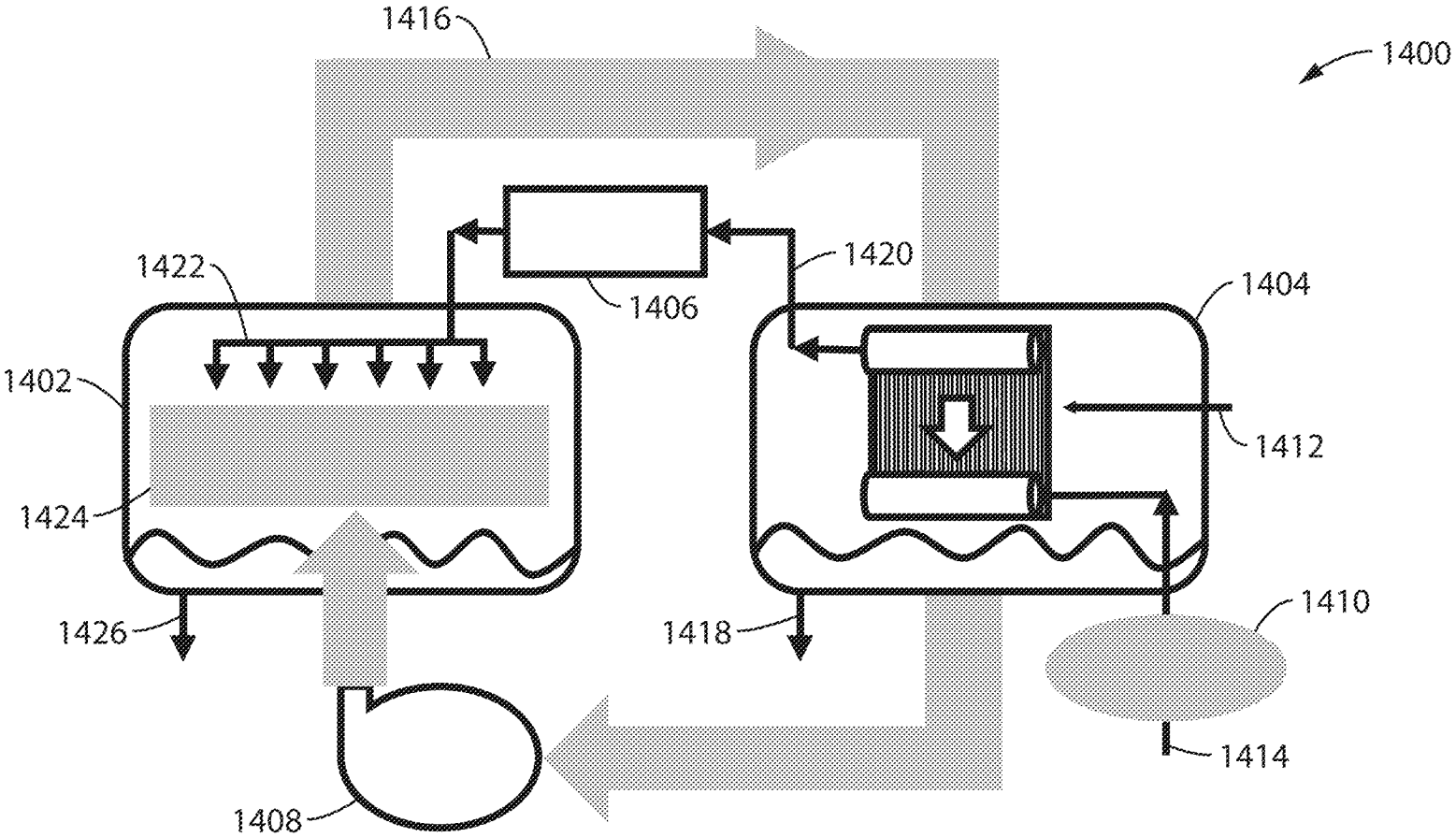
FIG. 14 illustrates an exemplary humidification/de-humidification desalination system employing a polymer heat exchanger according to an embodiment of the present disclosure.

FIG. 14 illustrates an embodiment of a humidification/de-humidification desalination system 1400 that employs a polymer heat exchanger according to this disclosure. Such a system typically comprises a humidification chamber 1402, a dehumidification chamber 1404, a heater 1406, a blower 1408, and a pump 1410. The disclosed heat exchanger 1412 is located within the dehumidification chamber 1404. In such a system, cool seawater or brine 1414 is pumped through the liquid passages (internal flow passages) of the disclosed heat exchanger 1412, while humid air 1416 is directed in a counterflow configuration through the air flow passages (intervening flow passages). The humid air 1416 condenses while passing through the air flow passages and the desalinated water condensate 1418 is collected at the bottom of the de-humidification chamber. The brine or seawater 1420 flowing through the liquid passages of the heat exchanger gets warmer due to the addition of the heat of condensation. This warm brine or seawater 1420 is further heated in the heater 1406 before being sprayed by a sprayer 1422 onto an evaporation medium 1424 located within the humidification chamber. The blower 1408 circulates air through the evaporative medium and the evaporated vapor is conveyed along with air as moist air into the de-humidification chamber. Concentrated brine 1126 is collected at the bottom of the humidification chamber.

Figure 15:
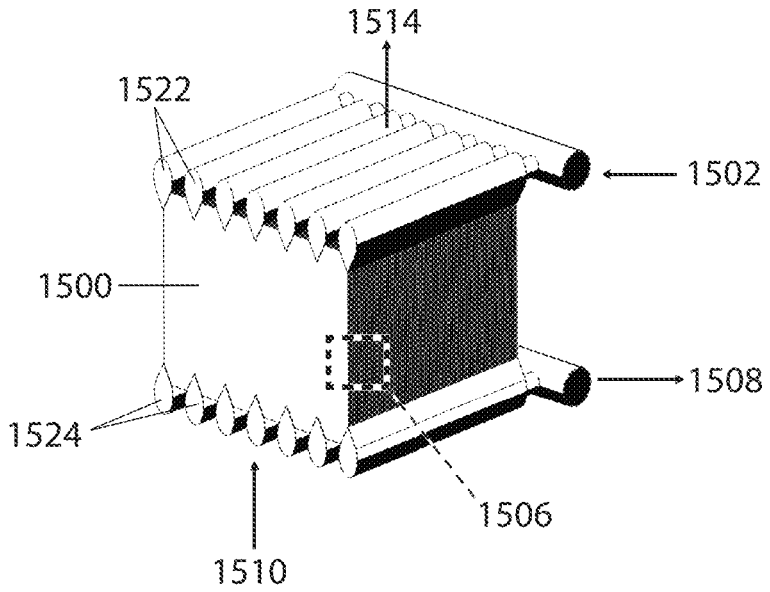
FIG. 15 illustrates an exemplary polymer heat exchanger with a porous membrane according to an embodiment of the present disclosure.
Figure 15:
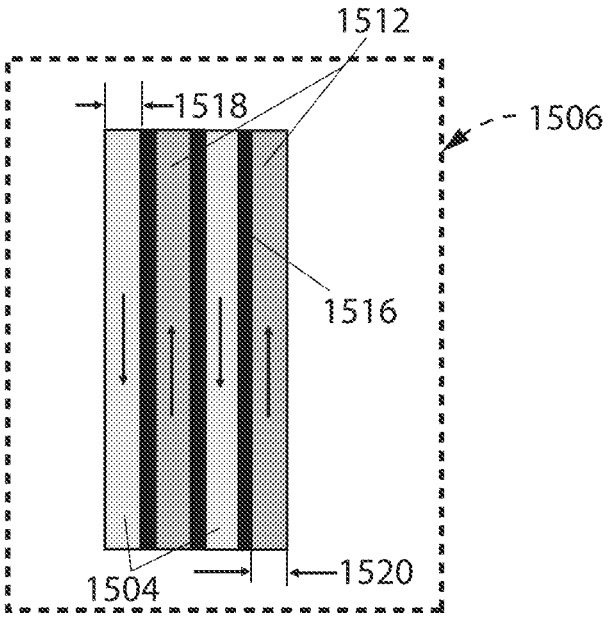

FIG. 15 illustrates an alternative embodiment 1500 of the disclosed polymer heat exchanger that includes a porous membrane. In this embodiment, a first liquid or a first gas enters an inlet 1502, flows through the internal flow passages 1504 formed by the plate stack 1506, and exits an outlet 1508. A second liquid or a second gas enters an inlet 1510, flows through the intervening flow passages 1512 in a direction opposite the flow of the first liquid or first gas, and exits an outlet 1514. The plate walls are comprised of a hydrophobic porous membrane 1516 that permits transport of mass and heat from one stream to the other across the porous hydrophobic membrane 1516. A sample width dimension 1518 for the internal flow passages can range, for example, from about 0.5 mm to about 10 mm and a sample width dimension 1520 for the intervening flow passages can range, for example, from about 0.5 mm to about 10 mm. Also shown for context are the inlet plena 1522 and exit plena 1524 for the first liquid or first gas.

It will be appreciated that four possible fluid pairs can occur in this embodiment as follows:

(1) a first liquid can engage in heat and mass transfer with a second gas;
(2) a first liquid can engage in heat and mass transfer with a second liquid;
(3) a first gas can engage in heat and mass transfer with a second gas; and
(4) a first gas can engage in heat and mass transfer with a second liquid (the same fluid combination as in (1)).

Figure 16:
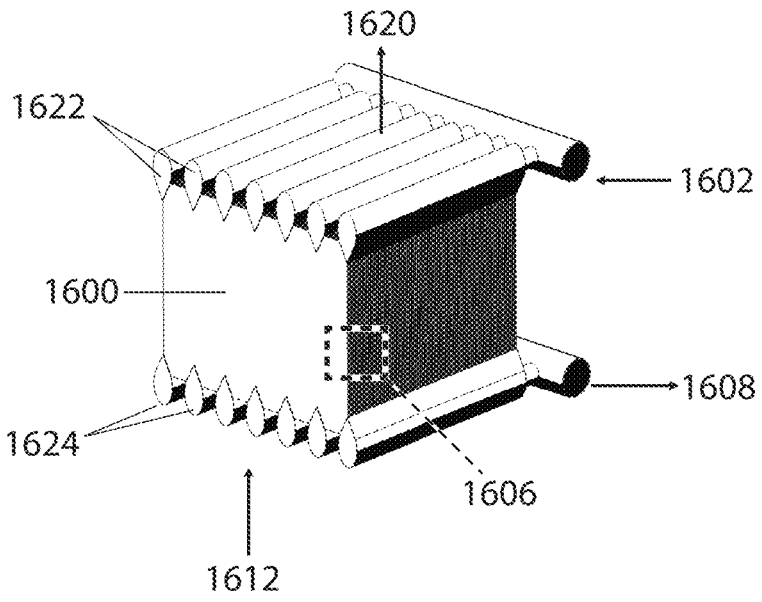
FIG. 16 illustrates the polymer heat exchanger of FIG. 15 configured for direct evaporative cooling according to an embodiment of the present disclosure.
Figure 16:
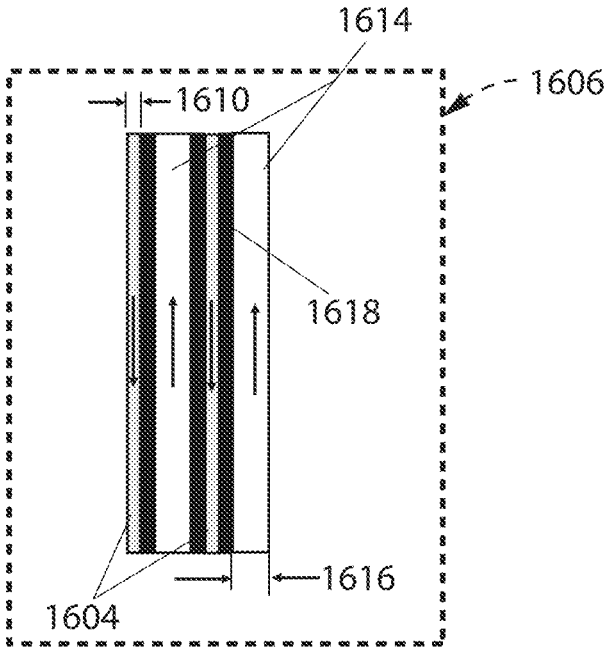

Referring to FIG. 16, the liquid-gas fluid combination (e.g., (1) or (4)) above could be used in applications such as, but not limited to, direct evaporative cooling. In FIG. 16, the polymer heat exchanger 1600 is the same construct as the polymer heat exchanger 1500 except for dimensions and type of fluids that flow through the polymer heat exchanger. In this embodiment, water enters the polymer heat exchanger through a water inlet 1602, flows through the internal flow passages 1604 formed by the plate stack 1606, and exits a water outlet 1608. The width dimension 1610 of these internal "liquid" flow passages can range, for example, from about 10 micrometers to about 0.5 mm. A low humidity hot air stream enters the polymer heat exchanger through an air inlet 1612 and flows through intervening "air" flow passages 1614 in an opposite direction to water flow. The width dimension 1616 of the intervening air flow passages can range, for example, from about 0.5 mm to about 10 mm. The air flow and water flow streams are separated by a porous membrane 1618 that wicks liquid water across the membrane. The wicked water evaporates by absorbing energy from the hot air stream. The air stream cools in the process and exits the air outlet 1620 with lower temperature and higher humidity. Also shown for context are the inlet plena 1622 and exit plena 1624 for the water.

Figure 17:
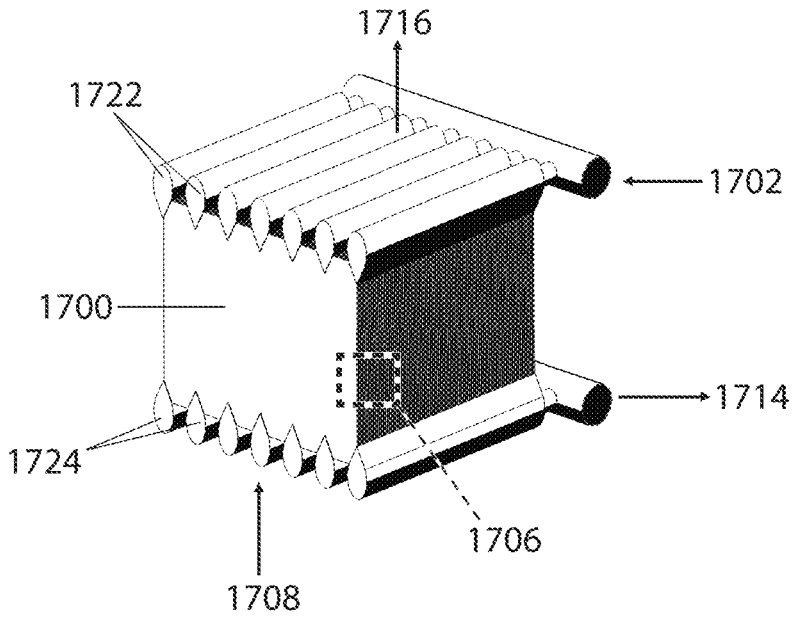
FIG. 17 illustrates the polymer heat exchanger of FIG. 15 configured for direct contact membrane distillation according to an embodiment of the present disclosure.
Figure 17:
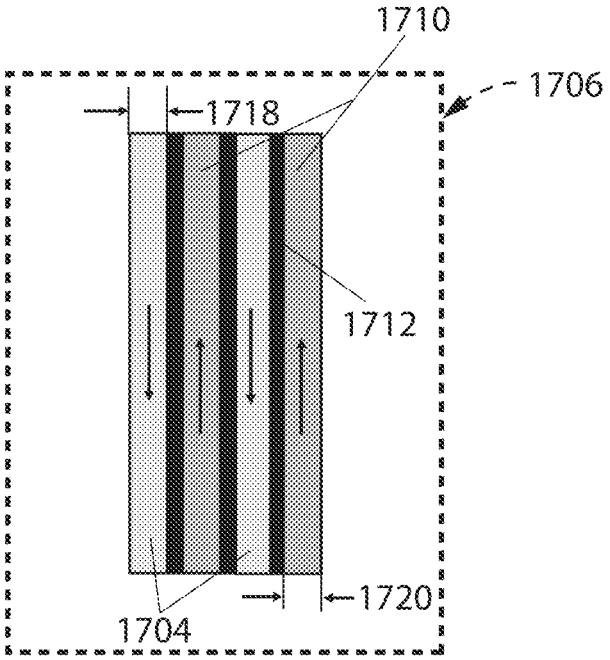

Referring to FIG. 17, the liquid-liquid fluid combination (e.g., (2) above) can be used in applications such as direct contact membrane distillation. In FIG. 17, the polymer heat exchanger 1700 is the same construct as the polymer heat exchanger 1500 except for dimensions and type of fluids that flow through the polymer heat exchanger. In this embodiment, a warm brine or seawater would enter an inlet 1702 and flow through the internal "liquid" flow passages 1704 formed by the plate stack 1706. Cool permeate would enter an inlet 1708 and flow through the intervening "permeate" flow passages 1710 in the opposite direction of the flow of warm brine. A hydrophobic porous membrane 1712 separates the brine and permeate streams. While the warm brine flows through the internal flow passages, water vapor permeates through the porous membrane and condenses in the cooler permeate stream. The hydrophobicity of the membrane allows for only vapor transport through the membrane and separates the two liquid streams on either side. Accordingly, the brine is cooled and exits the outlet 1714 and warm permeate exits the outlet 1716. The width dimension 1718 of the internal "liquid" flow passages 1704 can range, for example from about 0.1 mm to about 10 mm. The width dimension 1720 of the intervening "permeate" flow passages can range, for example, from about 0.1 mm to about 10 mm. Also shown for context are the inlet plena 1722 and exit plena 1724 for the brine.

Figure 18:
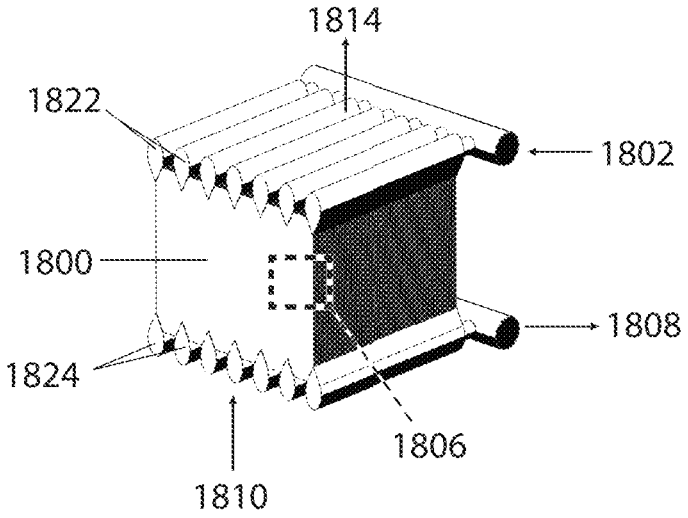
FIG. 18 illustrates the polymer heat exchanger of FIG. 15 configured for energy recovery ventilation according to an embodiment of the present disclosure.
Figure 18:
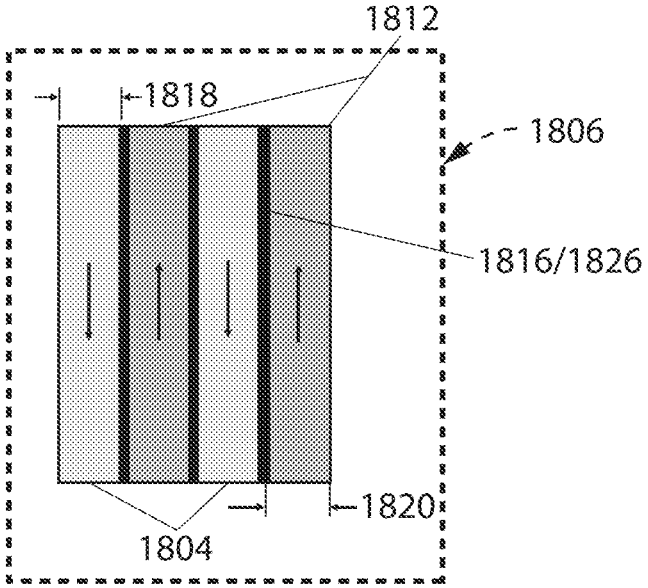

Referring to FIG. 18, the gas-to-gas combination (e.g., (3) above) can be used in applications such as Energy Recovery Ventilation (ERV). Energy recovery ventilators are used to reduce the heating or cooling load of buildings in winter or summer seasons respectively. In humid climates, during the summer, an ERV exchanges heat and moisture between the hot and humid outdoor air and the cooler and less humid indoor air. The resulting exchange results in warm, less humid air entering the air conditioning unit, thereby reducing the sensible and latent heat load on the cooling system. In wintertime, cool and dry outdoor air enters the ERV and exchanges moisture and heat with warmer and more humid air from the indoor environment. The resulting exchange results in warmer and more humid air entering the heat pump or furnace unit, thereby reducing the energy that needs to be added to condition the outdoor air. The most common configuration for membrane-based ERVs is cross flow.

The polymer exchanger 1800 in this embodiment permits a more efficient counter-flow configuration for an ERV. In FIG. 18, the polymer heat exchanger 1800 is the same construct as the polymer heat exchanger 1500 except for dimensions and type of fluids that flow through the polymer heat exchanger.

In the embodiment shown in FIG. 18, a first air stream would enter an inlet 1802, flow through the internal flow passages 1804 formed by the plate stack 1806, and exit an outlet 1808. A second air stream would enter an inlet 1810, flow through the intervening flow passages 1812 in an opposite direction to the direction of flow of the first air stream, and exit an outlet 1814. The membrane 1816 separating the two air streams can be comprised of porous polymers or natural materials such as cellulose and is designed for high permeability to water vapor. The width dimension 1818 of the internal flow passages and the width dimension 1820 of the intervening flow passages can both in the range of about 0.5 mm to about 10 mm. The smaller dimension would permit better heat and mass exchange efficiency and a compact device but at the expense of an increased pressure drop and flow power. Also shown for context are the inlet plena 1822 and exit plena 1824 for the first air stream.

In a slight variation of the preceding configuration, air streams flow through both the internal flow passages as well as the intervening flow passages in a counter flow, but the membrane separating the two air streams is non-porous (i.e., solid). In this embodiment, the non-porous membrane 1826 separates the two air streams and only heat is exchanged between the two air streams. The device is hence called a Heat Recovery Ventilator (HRV), which is a particular implementation of the ERV in which only heat and no vapor is exchanged between the two air streams.

Figure 19A:
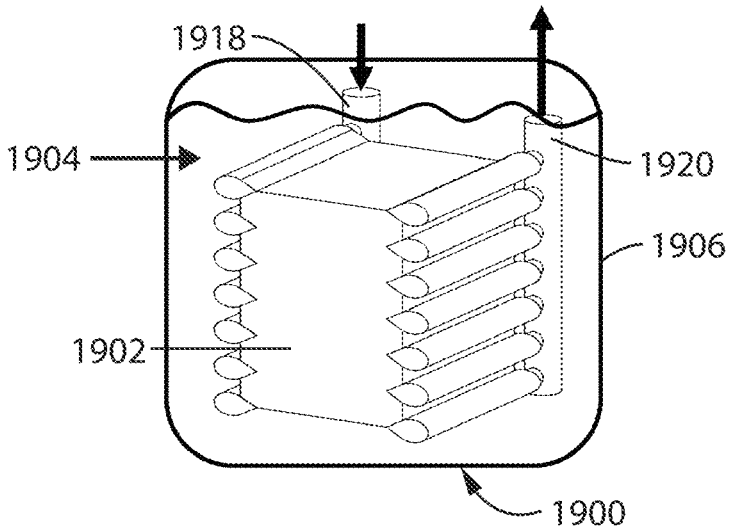
FIG. 19A and FIG. 19B illustrate an exemplary thermal energy storage system employing a polymer heat exchanger placed within a thermal energy storage medium according to an embodiment of the present disclosure.
Figure 19B:
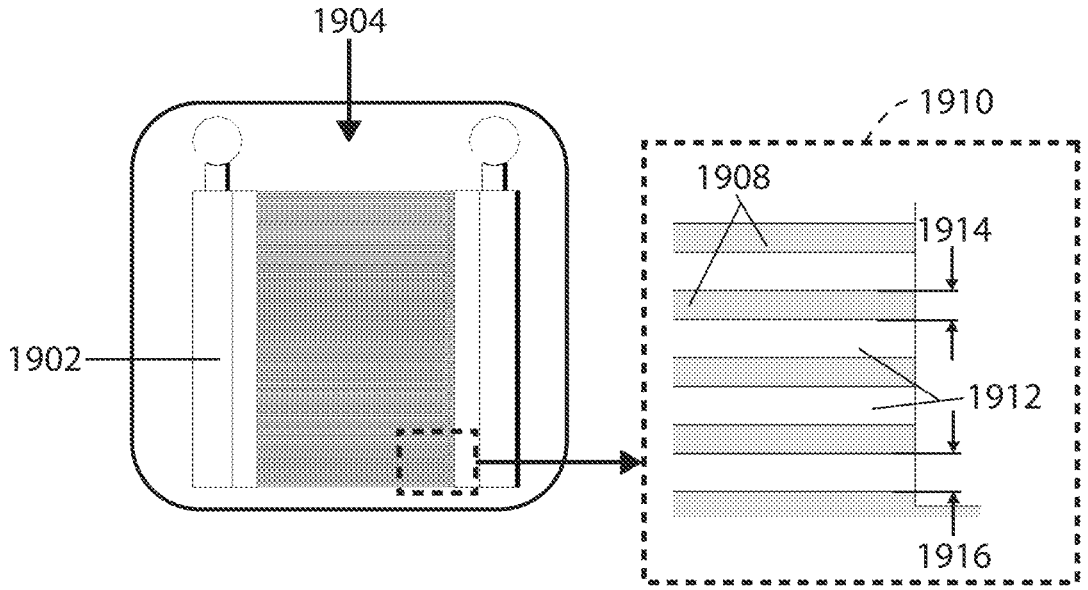

FIG. 19A and FIG. 19B illustrate a thermal energy storage system 1900 that combines a polymer heat exchanger according to this disclosure with a thermal energy storage medium. In this embodiment, the disclosed heat exchanger 1902 is immersed in a thermal energy storage medium 1904 contained in a thermal energy storage tank 1906 such that the intervening flow passages 1908 are covered with the thermal energy storage medium 1904. From the top view of the thermal energy storage system in FIG. 19B and associated detail 1910, the internal "liquid" flow passages 1912 and the intervening "thermal storage medium" passages 1908 can be seen in greater detail. The width dimension 1914 of the intervening flow passages 1908 may range from about 0.1 mm to about 50 mm, depending on the properties of the thermal energy storage material. For example, the passage width could be larger for a higher thermal conductivity thermal storage material. The width dimension 1916 of the internal "liquid" flow passages may range from about 0.1 mm to about 5 mm. The thermal energy storage medium 1904 can be a solid, a liquid, or a phase change material. The temperature range of thermal energy storage material can be as low as about −200° C. to as high as about 300° C. depending on the particular polymers used in the heat exchanger 1902.

The thermal energy storage medium can be used for hot thermal energy storage or cold thermal energy storage. In the case of a hot thermal energy storage system, during the charging mode, hot liquid enters the heat exchanger 1902 through the liquid inlet 1918, flows through the internal "liquid" flow passages 1912, and heats up the thermal energy storage medium 1904 in a charging mode of operation before exiting the heat exchanger through the liquid outlet 1920. In a discharging mode, cooler liquid enters the liquid inlet 1918 and picks up thermal energy from the thermal energy storage medium 1904 while flowing through the internal "liquid" flow passages 1912, thereby heating the liquid and cooling the thermal storage medium before exiting the liquid outlet 1920 as a hot liquid. By way of example, and not of limitation, the heated liquid can be directed to a process or used for heating a built environment.

Similarly, in a cold thermal storage system, cooler liquid enters the internal "liquid" flow passages 1912 through the liquid inlet 1918 in a charging mode. This liquid cools the thermal energy storage medium 1904 before exiting through the liquid outlet 1920 as a warmer liquid. In a discharging mode, warmer liquid enters the internal "liquid" flow passages 1912 through the liquid inlet 1918. The cold thermal energy storage medium exchanges heat with the warmer liquid flowing through the internal "liquid" flow passages 1912 thereby cooling down the liquid. The cooled liquid then exits the heat exchanger through the liquid outlet 1920 and can be used, for example, in process cooling or to cool a built environment. If the thermal energy storage medium 1904 is a phase change material (PCM), the material melts or freezes, respectively, when heat is added to the material or extracted from it by the liquid flowing through the internal "liquid" flow passages 1912.

Three exemplary applications for the thermal energy storage system will now be described. It will be appreciated, however, that other applications are possible and would be apparent to those skilled in the art.

Figure 20A:
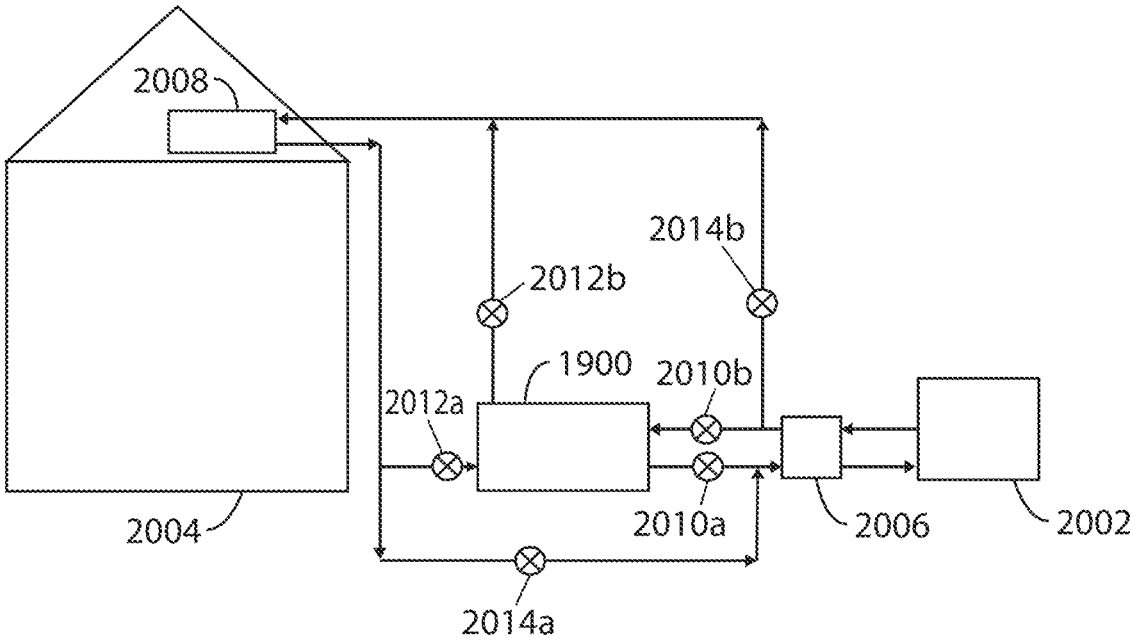
FIG. 20A illustrates the thermal energy system of FIG. 19A and FIG. 19B configured as a component in a building heating and cooling system according to an embodiment of the present disclosure.

In the first exemplary application, depicted in FIG. 20A through FIG. 20D, the disclosed thermal energy storage system 1900 can be a part of a heating and cooling system for a building. The building can be of any type, including, but not limited to, residential single family, residential multi-family, commercial, office, or a datacenter. The thermal energy storage system can also be used in an automobile, ship, locomotive, or aircraft heating and cooling system. FIG. 20A depicts one embodiment of the application for residential heating and cooling in which the thermal energy storage system 1900 is coupled with a heat pump 2002 located outside the building 2004. The heating and cooling system comprises the heat pump 2002, a refrigerant-to-liquid heat exchanger 2006, the disclosed thermal energy storage system 1900, one or more liquid-to-air heat exchanger(s) 2008 located within the building, and three pairs of control valves 2010*a*, 2010*b*, 2012*a*, 2012*b*, and 2014*a*, 2014*b*, respectively. The control valves can be used to direct the liquid from the refrigerant-to-liquid heat exchanger in different paths depending on the modes of operation discussed below.

The application is described for a cold thermal energy storage system for use in summer season; however, it can be appreciated that a similar description can be envisioned for hot thermal storage for use in winter season. The thermal energy storage medium 1904 used for thermal energy storage would differ for summer or winter; the rest of the system would remain identical.

Figure 20B:
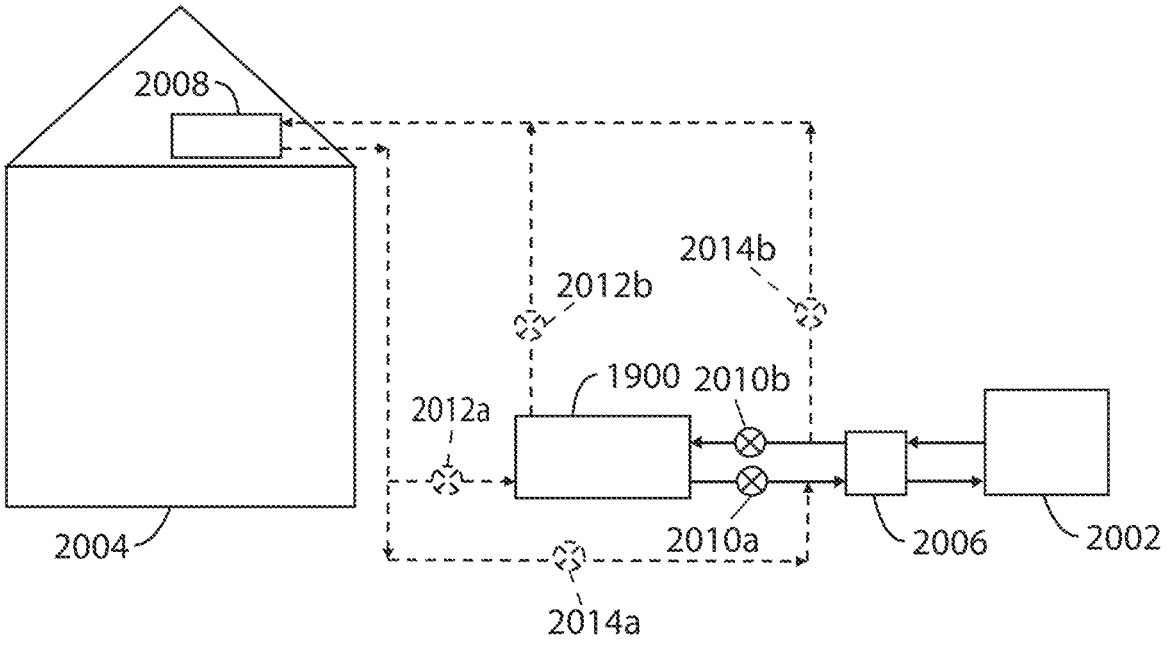
FIG. 20B illustrates a charging mode configuration for the heating and cooling system shown in FIG. 20A according to an embodiment of the present disclosure.

During the charge mode illustrated in FIG. 20B, the control valve pair 2010*a*, 2010*b* is open, and the control valve pair 2012*a*, 2012*b* and the control valve pair 2014*a*, 2014*b* are closed. The heat pump 2002, operating in a cooling mode, would cool the liquid within the refrigerant-to-liquid heat exchanger 2006, which operates as the evaporator heat exchanger of the heat pump. The chilled liquid would enter the disclosed thermal energy storage system 1900 through the liquid inlet 1918 and flow through the internal "liquid" flow passages 1912 of the polymer heat exchanger that is embedded within the thermal energy storage medium, thereby cooling the thermal energy storage medium prior to exiting the thermal energy storage system 1900 through the liquid outlet 1920. If the thermal energy storage were a PCM, the PCM would solidify during the charging process. The warmer liquid would be routed back to the refrigerant-to-liquid heat exchanger 2006 in a closed loop.

Figure 20C:
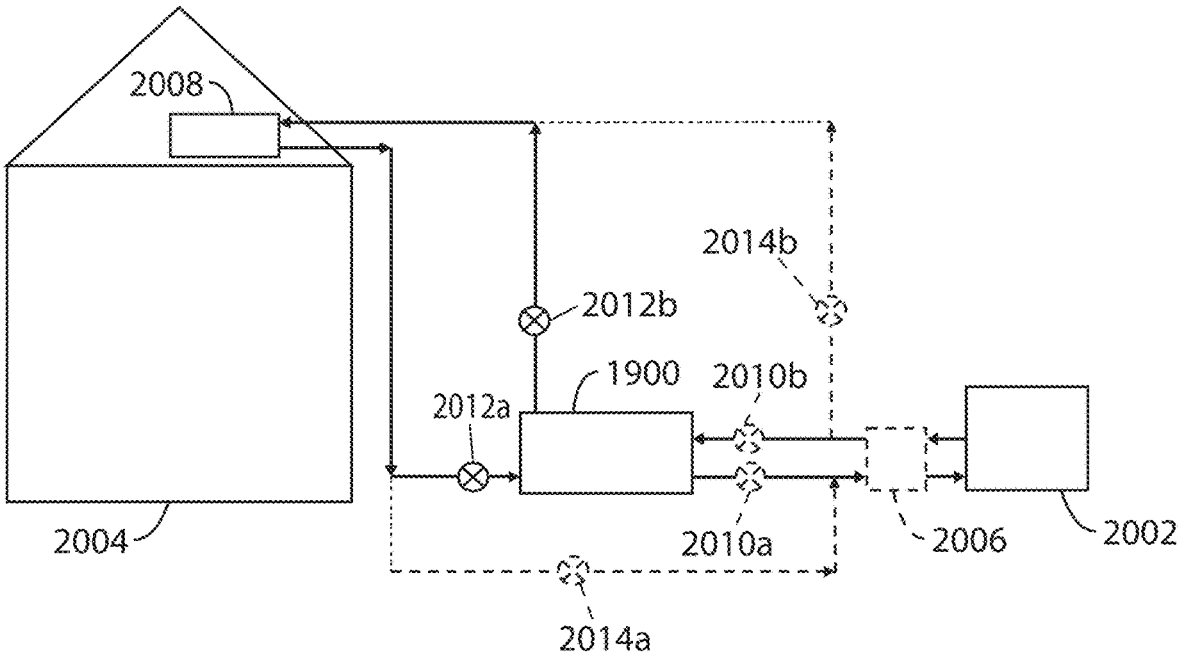
FIG. 20C illustrates a discharge mode configuration for the heating and cooling system shown in FIG. 20A according to an embodiment of the present disclosure.
Figure 20D:
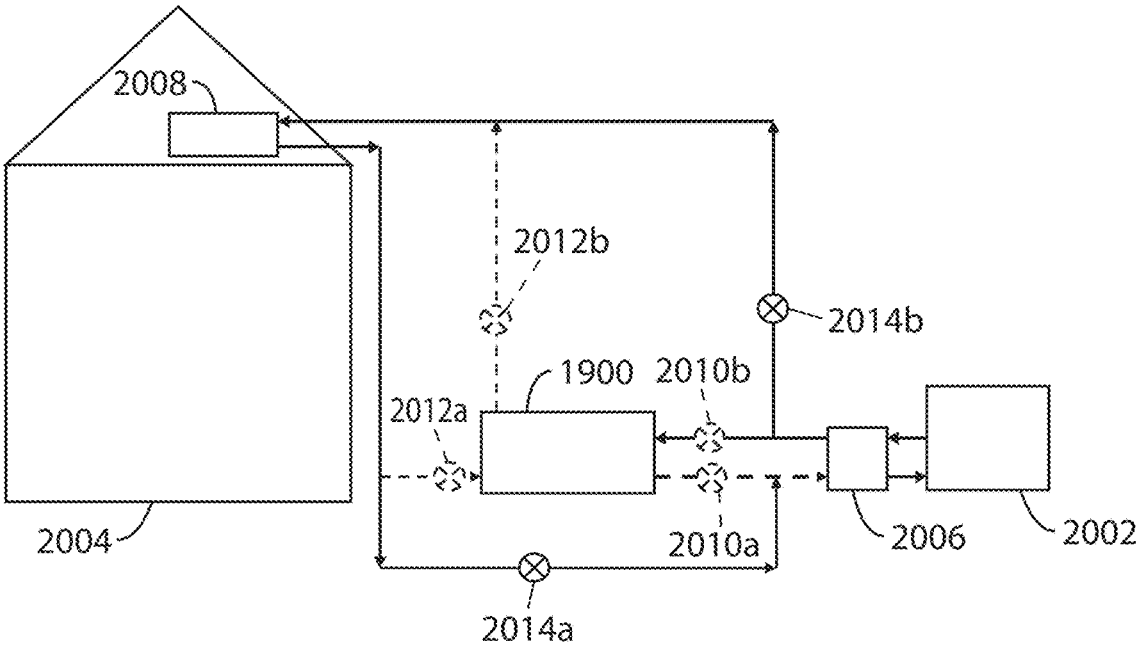
FIG. 20D illustrates a bypass mode configuration for the heating and cooling system shown in FIG. 20A according to an embodiment of the present disclosure.

During the discharge mode illustrated in FIG. 20C, the control valve pair 2012*a*, 2012*b* is open and the control valve pairs 2010*a*, 2010*b* and 2014*a*, 2014*b* are closed. The thermal energy storage system 1900 is hence coupled to the liquid-to-air heat exchanger 2008 in the building. Liquid flowing through the internal "liquid" flow passages 1912 of the heat exchanger within the thermal energy storage system 1900 would be routed through the liquid-to-air heat exchanger 2008, where it would cool down the air in the building 2004. In the process of this heat exchange in the liquid-to-air heat exchanger 2008, the liquid would get warmer and be circulated back to the cold thermal energy storage system 1900 through the liquid inlet 1918 to be cooled again. The process would repeat until the thermal energy storage medium 1904 has been discharged. If the thermal energy storage were a PCM, the PCM would melt during the discharging process. Once the thermal energy storage system 1900 has been discharged, the bypass mode illustrated in FIG. 23 is activated by opening the control valve pair 2014*a*, 2014*b* and closing the control valve pair 2010*a*, 2010*b* and the control valve pair 2012*a*, 2012*b*. Thus, in the bypass mode, the thermal energy storage system 1900 would be bypassed and cold liquid is directly routed from the refrigerant-to-liquid heat exchanger 2006 to the liquid-to-air heat exchanger 2008 within the building 2004.

Note that a thermal energy storage system 1900, such as in the configuration illustrated in FIG. 20A through FIG. 20D can be used to shift the electrical load of the heat pump 2002 from hours where the electricity demand is high to times where it is lower. Alternately, or in conjunction with the electricity demand, the heating and cooling system can be operated in response to greenhouse gas emissions signal with the aim of reducing the emissions, or emissions and cost. In locations where electric utility rates are tied to time of use, the thermal energy storage system can help reduce operating cost of the cooling/or heating system. For example, in the cooling season, if the electricity demand is high in the late evening hours, the cooling system would operate in the discharge mode of the thermal energy storage system 1900. In doing so, the heat pump can be turned off during the times of peak electricity demand, thereby shifting the electrical load away from these hours. The thermal energy storage system can be charged at nighttime when the electricity demand is low.

Another important mode of operation of the heating and cooling system is in the wintertime during defrost mode. In wintertime operation, hot refrigerant from the heat pump 2002 would heat the liquid within the refrigerant-to-liquid heat exchanger 2006, which would then in turn charge the thermal energy storage system 1900. Control valves 2010*a*, 2010*b* would be open during charging. Once the thermal energy storage system is charged, the system can be used in the discharge mode. When the outdoor air is very cold, frost formation occurs in the outdoor heat exchanger of the heat pump. This frost formation reduces the operational efficiency of the heat pump, and in many cases makes it such that the heat pump cannot be operated. Hence, the heat pump needs to be operated in reverse to melt the frost formed in the outdoor heat exchanger, before the heat pump can be operated once again to heat the building. In a heating and cooling system without the disclosed thermal energy storage system 1900, such a defrost mode would result in cold air being blown into the building 2004 through the liquid-to-air heat exchanger 2008. Here, however, the discharge mode of operation can be used while the heat pump is being defrosted.

Figure 21A:
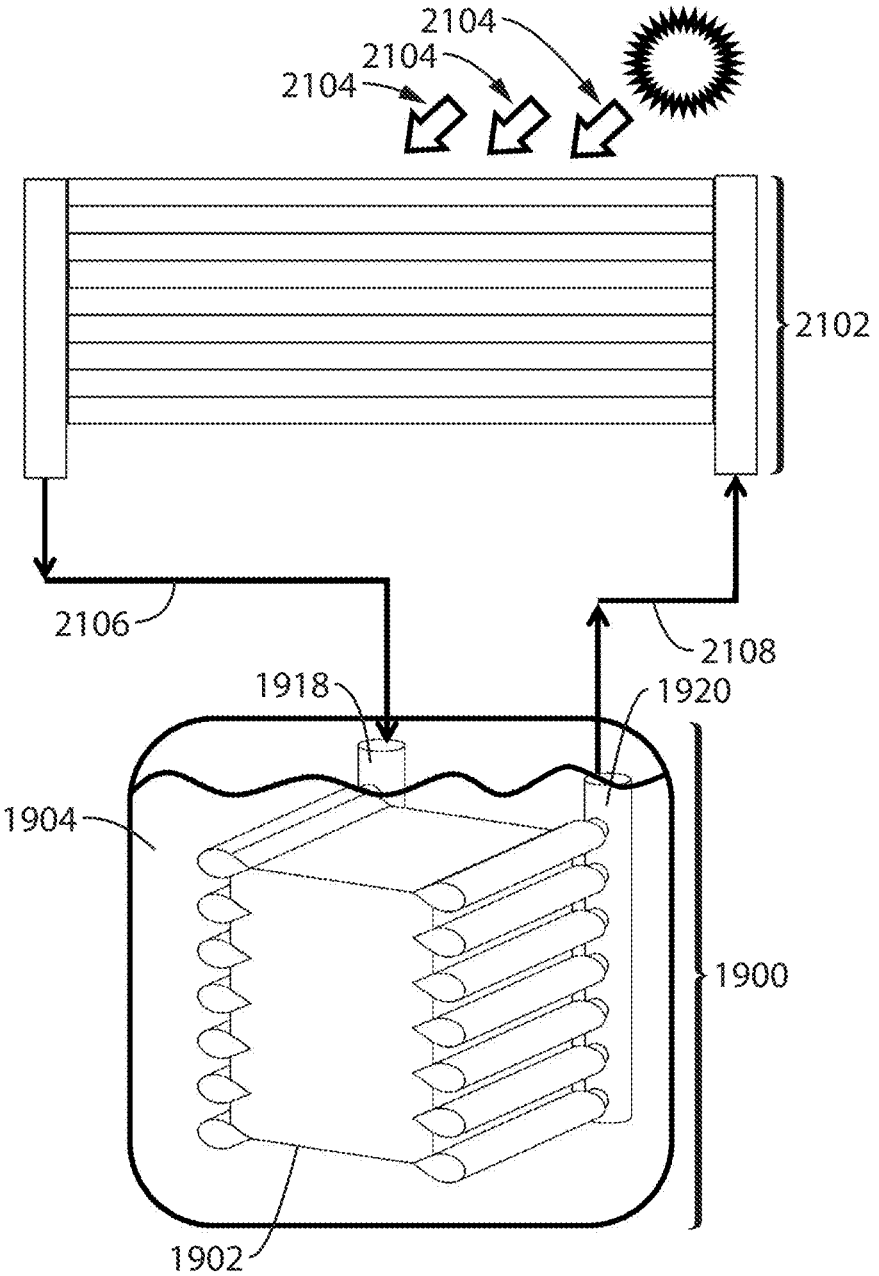
FIG. 21A and FIG. 21B illustrate the thermal energy system of FIG. 19A and FIG. 19B configured as a component in a solar liquid heating system according to an embodiment of the present disclosure.
Figure 21B:
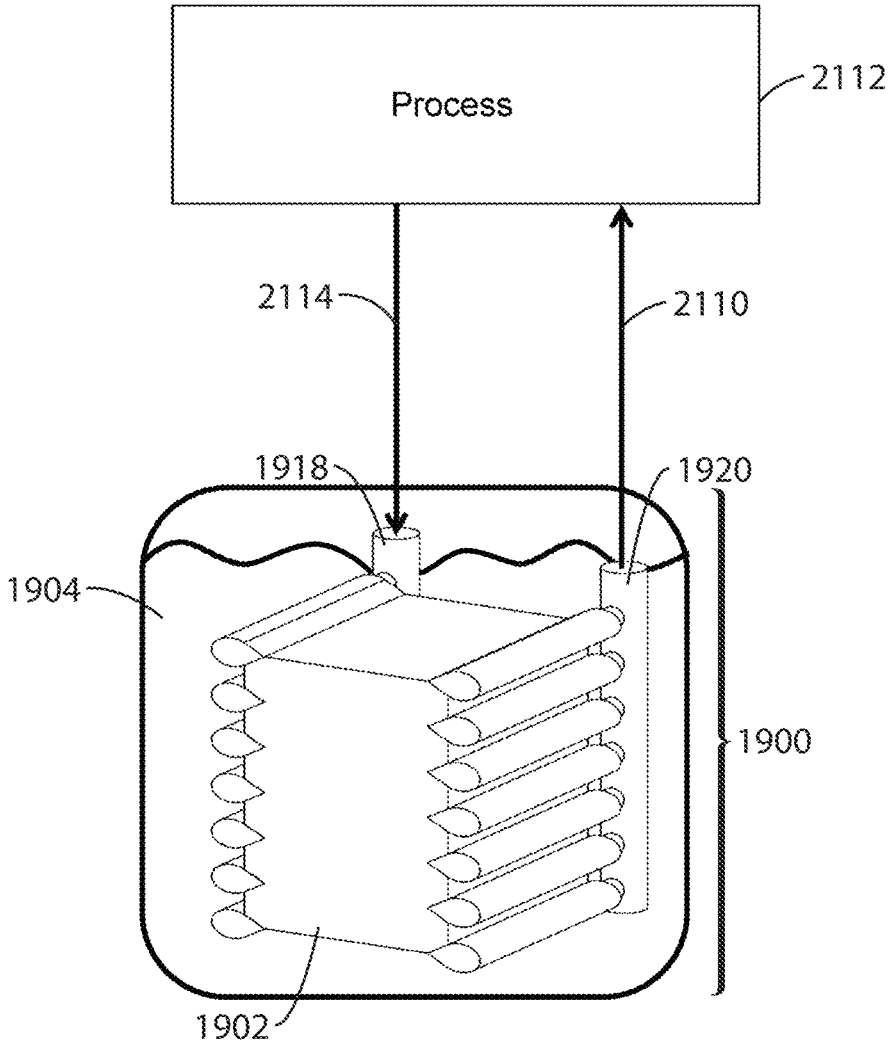

Referring now to FIG. 21A and FIG. 21B, a second exemplary application of the thermal energy storage system 1900 is in a solar liquid heating system wherein the thermal energy storage system is coupled to solar liquid heater panels 2102. In this application, the thermal energy storage system 1900 stores heat (i.e., hot thermal energy storage).

During the charging mode illustrated in FIG. 21A, the solar thermal panels 2102 are heated by incident sunlight 2104. The heat transfer liquid flowing through the panels gets heated and this heated liquid 2106 enters the "hot" liquid inlet 1918 and flows through the internal "liquid" flow passages 1912 of the polymer heat exchanger 1902, thereby heating the thermal energy storage medium 1904. The cold liquid 2108 exits the polymer heat exchanger 1902 through the "cold" liquid outlet 1920 and circulates back through the solar liquid heater panels 2102.

During the discharge mode illustrated in FIG. 21B, liquid flowing through the internal "liquid" flow passages 1912 of the polymer heat exchanger 1902 extracts heat from the thermal energy storage medium 1904 and exits the thermal energy storage system through the "hot" liquid outlet 1920. The heated liquid 2110 can then be routed to a process 2112 that requires thermal energy such as, but not limited to, pasteurization, sterilization, drying, distillation or regeneration. The heated liquid can also be routed to the built environment to provide heating. The cooled liquid 2114 is routed back into the thermal energy storage system through the "cold" liquid inlet 1918.

Figure 22A:
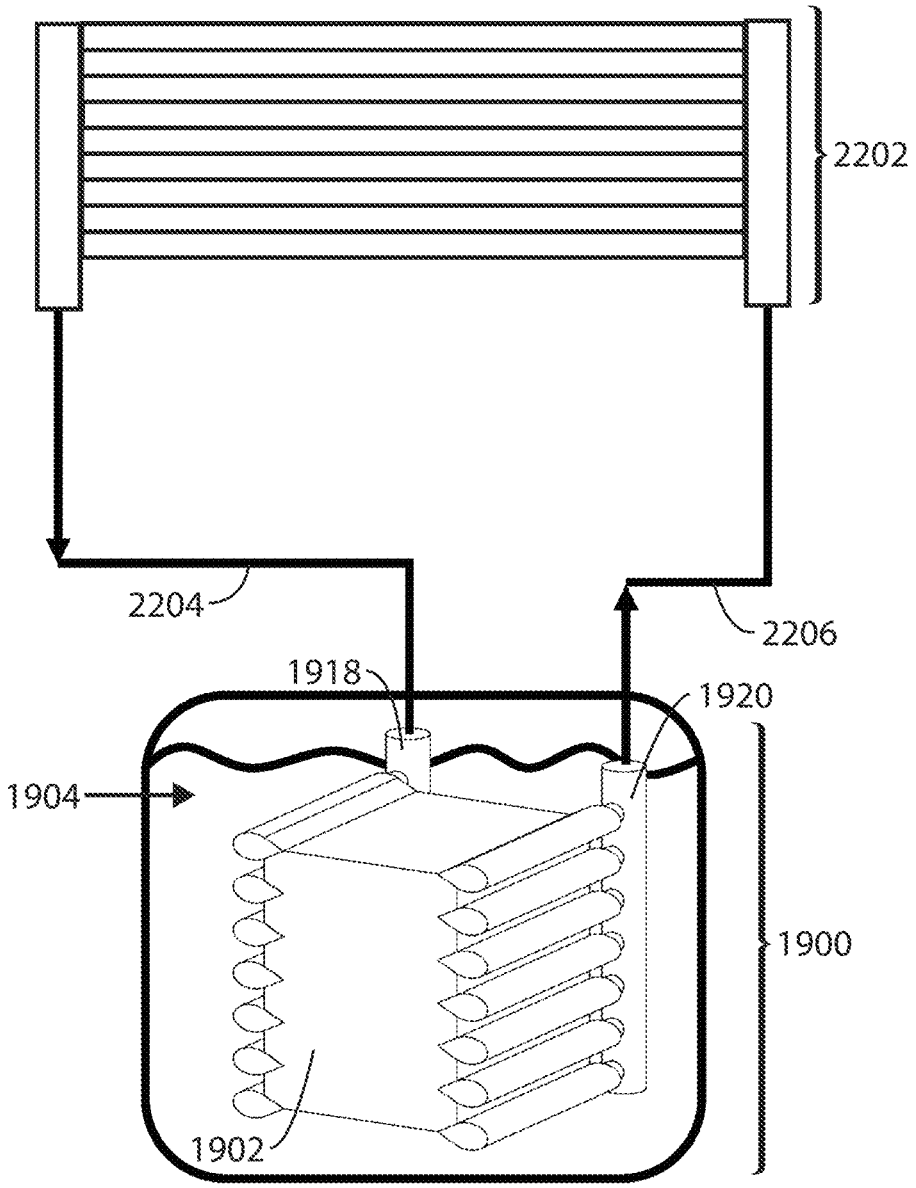
FIG. 22A through FIG. 22C illustrate the thermal energy system of FIG. 19A and FIG. 19B configured as a component in a radiative cooling system according to an embodiment of the present disclosure.
Figure 22B:
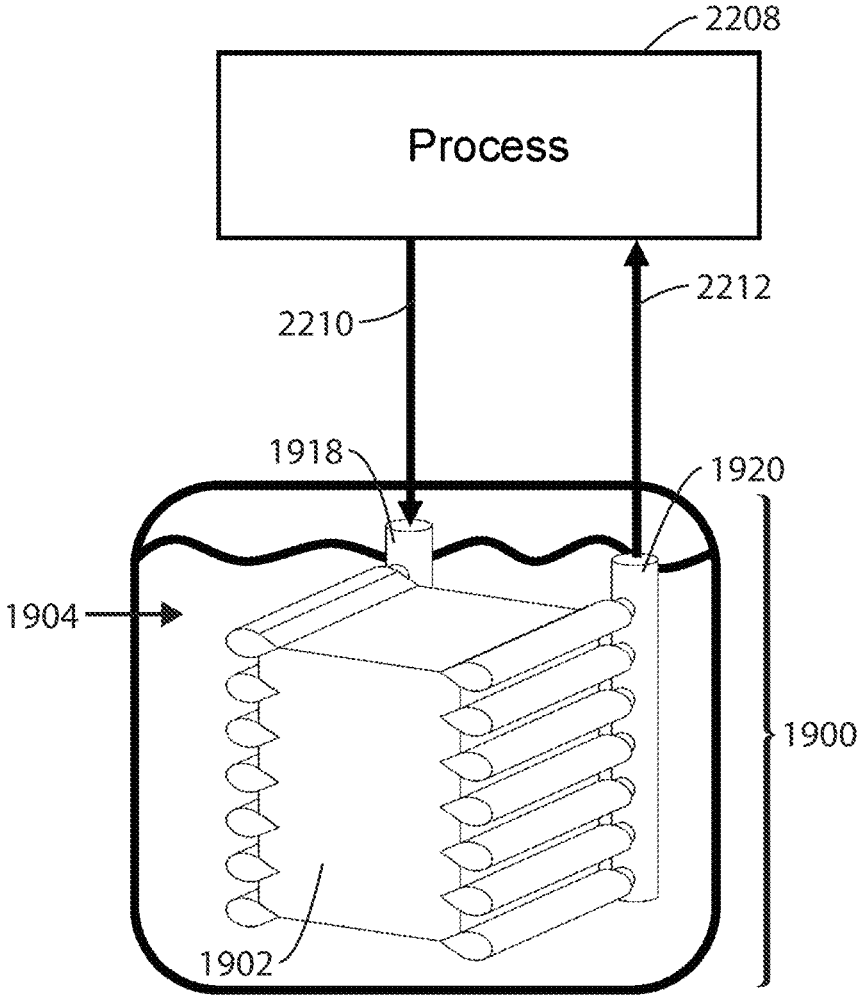
Figure 22C:
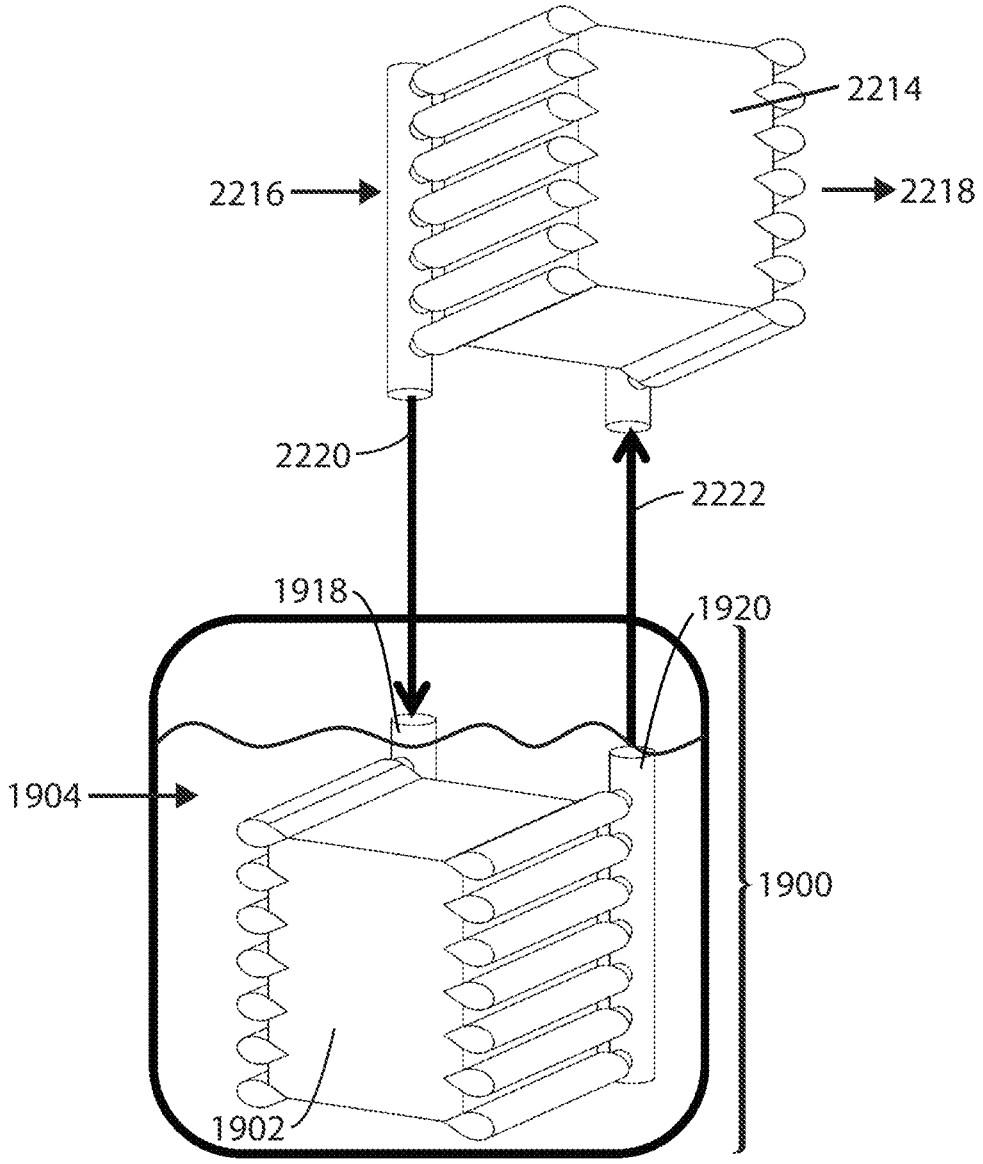

A third example of an application for the disclosed thermal energy storage system 1900 is in a radiatively-cooled thermal energy storage system illustrated in FIG. 22A through FIG. 22C. In this system, during the charge mode illustrated in FIG. 22A, thermal energy storage system 1900 is coupled to radiatively cooled panels 2202. These commercially-available radiatively cooled panels 2202 cool down liquid flowing through them by rejecting heat from the fluid to the environment by long wavelength radiation as well as convection. In this example application, the thermal energy storage system will be used for cold thermal energy storage. During the charge mode, cooled liquid 2204 from the radiatively cooled panels enters the internal passages of the disclosed polymer heat exchanger 1902 through the "cold" liquid inlet 1918. The cold liquid is routed through the heat exchanger where it cools down the thermal energy storage medium 1904. The liquid gets warmer in the process and exits the polymer heat exchanger through the "warm" liquid outlet 1920 and the warm liquid 2206 is routed to the radiative cooling panels 2202 in a closed loop.

During the discharge mode illustrated in FIG. 22B, the cold thermal energy storage system 1900 is coupled to a process 2208 that requires cooling, such as, but not limited to, in food processing. Warm liquid 2210 from the process enters the charged cold thermal energy storage system 1900 through the "warm" liquid inlet 1918 of the polymer heat exchanger 1902. The liquid flows through the internal passages of the heat exchanger and rejects heat to the thermal energy storage medium 1904, thereby exiting as a cooler liquid 2212 through the "cool" liquid outlet 1920. The cool liquid is then routed through the process 2208 in a closed loop.

In an alternate discharge mode illustrated in FIG. 22C, the cold thermal energy storage system 1900 can be coupled to a liquid-to-air heart exchanger 2214 to cool down the air in a space such as a building, room, datacenter, server room, a compute rack (through a front or rear door heat exchanger), or a server within a compute rack. In one embodiment, the liquid-to-air heat exchanger 2214 could be the disclosed polymer heat exchanger. Warm air 2216 from the space such as a computer server, room or datacenter exchanges heat with the cool liquid in the liquid-to-air heat exchanger 2214 and gets discharged to the computer server, room, or datacenter as cool air 2218. Warm liquid 2220 exits the liquid-to-air heat exchanger and enters the thermal energy storage system 1900 through the "warm" liquid inlet 1918. The warm liquid rejects heat while flowing through the polymer heat exchanger 1902 and exits the thermal energy storage system as a cool liquid 2222 through the "cool" liquid outlet 1920.

Figure 23A:
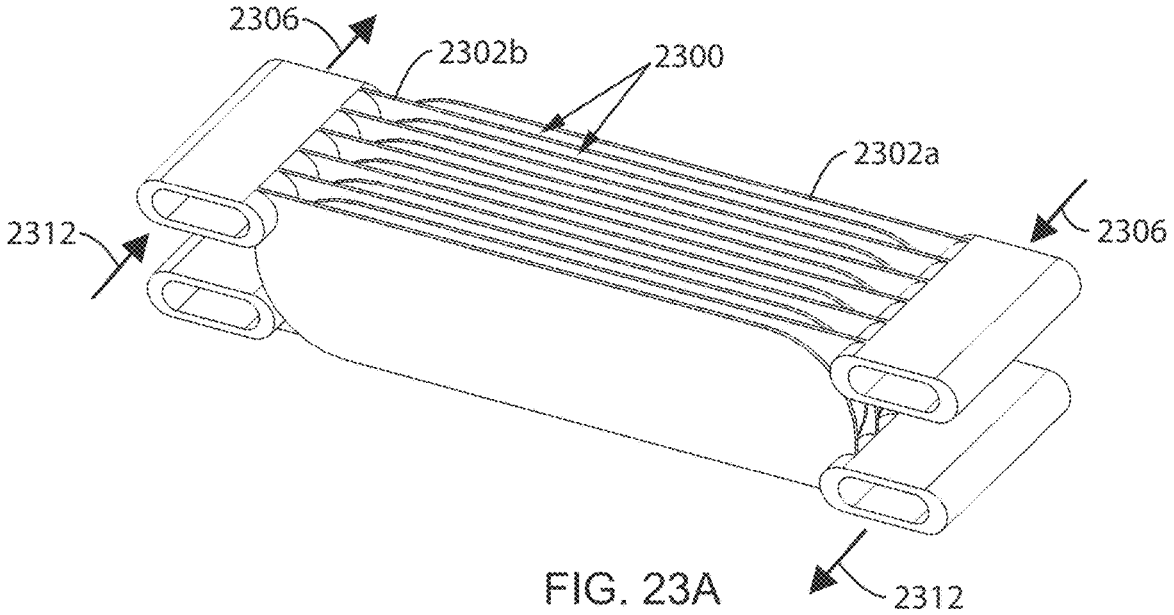
FIG. 23A through FIG. 23D illustrate interlayering of polymer heat exchangers according to an embodiment of the present disclosure.
Figure 23B:
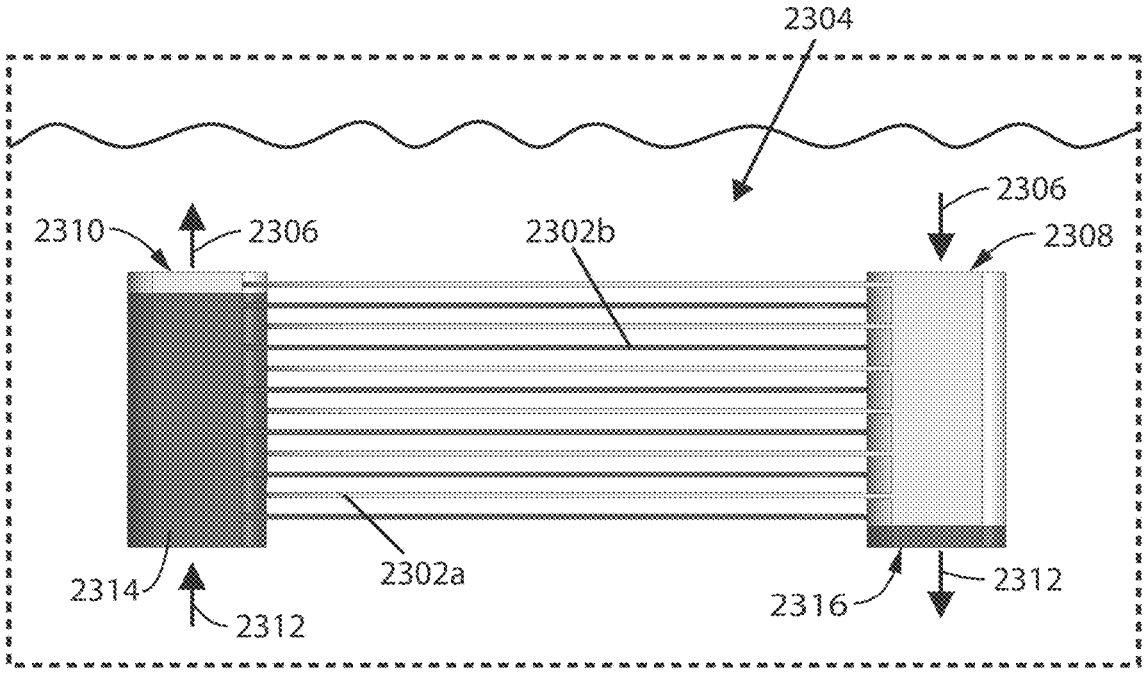
Figure 23C:
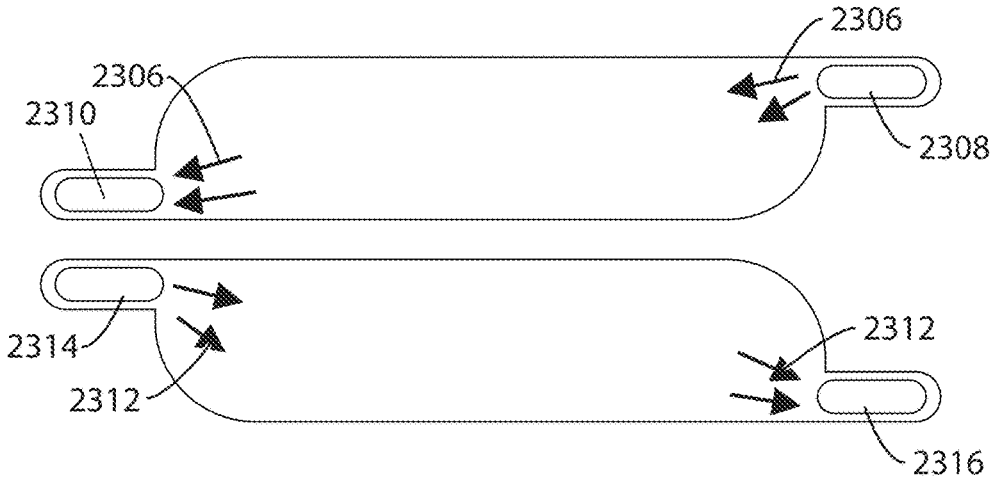
Figure 23D:
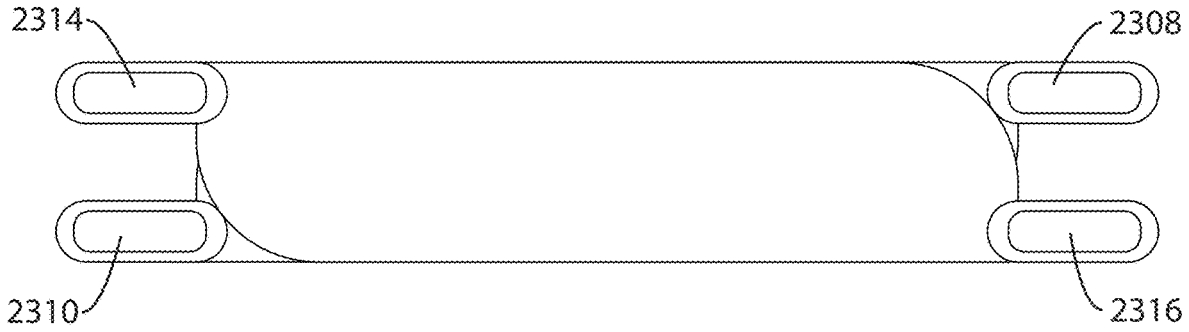

FIG. 23A through FIG. 23D illustrate an alternate embodiment of the thermal energy storage system that comprises an assembly 2300 of two interlayered polymer heat exchangers. The two interlayered polymer heat exchangers 2302*a*, 2302*b* can be placed within a thermal energy storage medium 2304 as shown in FIG. 23B (top view). Each of these polymer heat exchangers could be, for example, those illustrated in FIG. 19A and FIG. 19B and described above.

In operation, a first fluid 2306 enters through the first fluid inlet 2308 and is routed through the internal fluid flow passages of the first of the interlayered heat exchangers 2302*a* before exiting through the first fluid outlet 2310. The second fluid 2312 enters through the second fluid inlet 2314, flows in a counter-flow direction to the first fluid 2306 through the internal fluid flow passages of the second heat exchanger 2302*b*, and exits through the second fluid outlet 2316. The intervening passages of each of the intervening heat exchangers are filled with thermal energy storage medium 2304 as shown in FIG. 23B. The first heat exchanger 2302*a* might be used for charging the thermal energy storage medium 2304 while the second heat exchanger 2302*b* might be used to discharge the thermal energy storage medium 2304.

The use of two heat exchangers within the thermal storage medium allows for use of different fluids of different properties and at different pressures for charging and discharging. It also allows for simultaneous charging and discharging at the same rate or different rates.

To optimize the design of the thermal storage system, the heat exchangers are designed such that they can be interlayered. Referring to the side view of single liquid plates of the interlayered heat exchangers illustrated in FIG. 23C, the first fluid inlet 2308 is located on the top of the liquid plate of the first fluid heat exchanger 2302*a* while the second fluid outlet 2316 is located below the first fluid inlet 2308. Similarly, the first fluid outlet 2310 is located below the second fluid inlet 2314. When interlayered together as show, in FIG. 23D (side view), the inlets and outlets being offset from each other permits inter-layering of the liquid plates of the first and second heat exchangers. Once assembled the thermal energy storage medium 2304 can be filled in between the passages in between the two polymer heat exchangers.

Note that the three exemplary applications described in FIG. 20A through FIG. 22C hold equally for this alternate embodiment of thermal energy storage with interlayered heat exchangers 2300 described above.

Figure 24A:
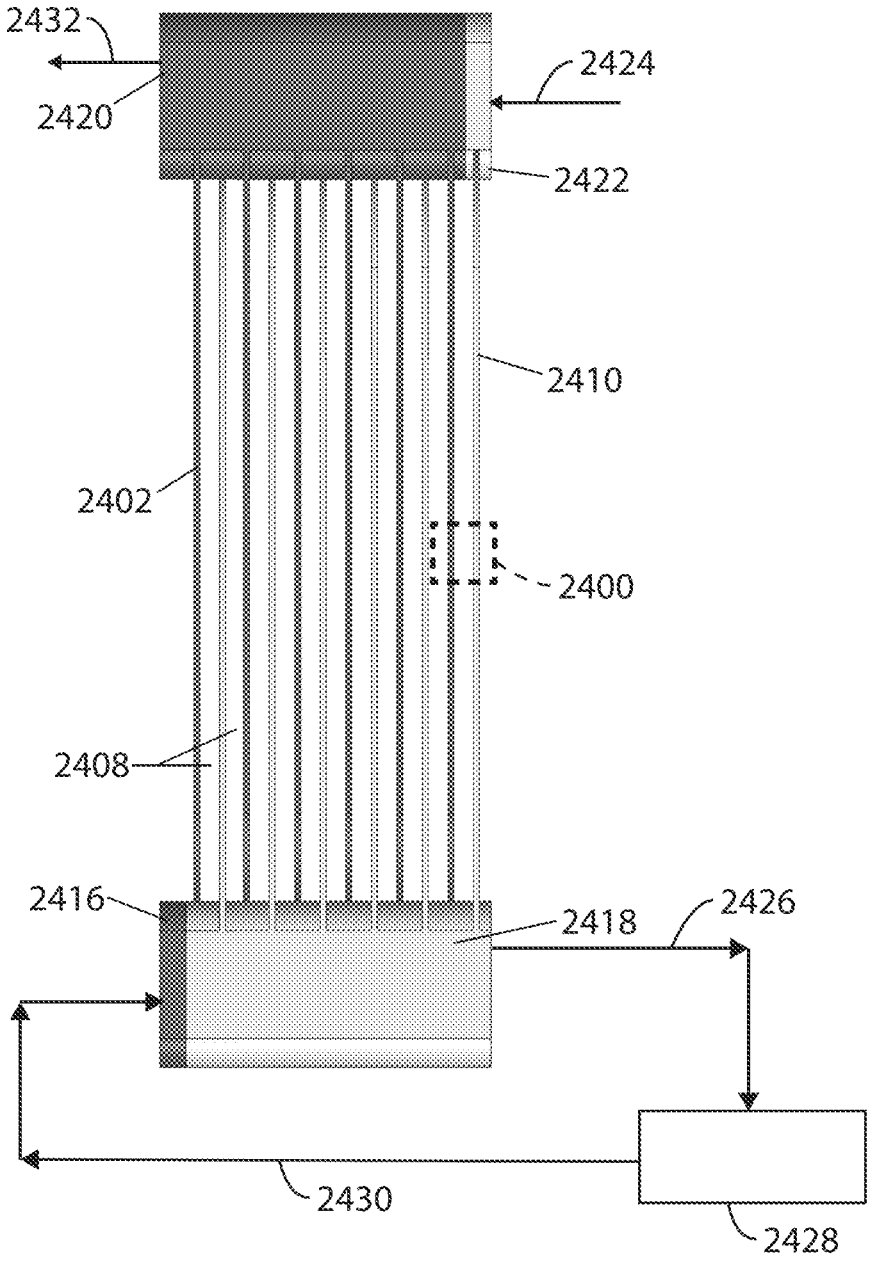
FIG. 24A and FIG. 24B illustrate an exemplary configuration for air-gap or vacuum membrane distillation using interlayered polymer heat exchangers according to an embodiment of the present disclosure.
Figure 24B:
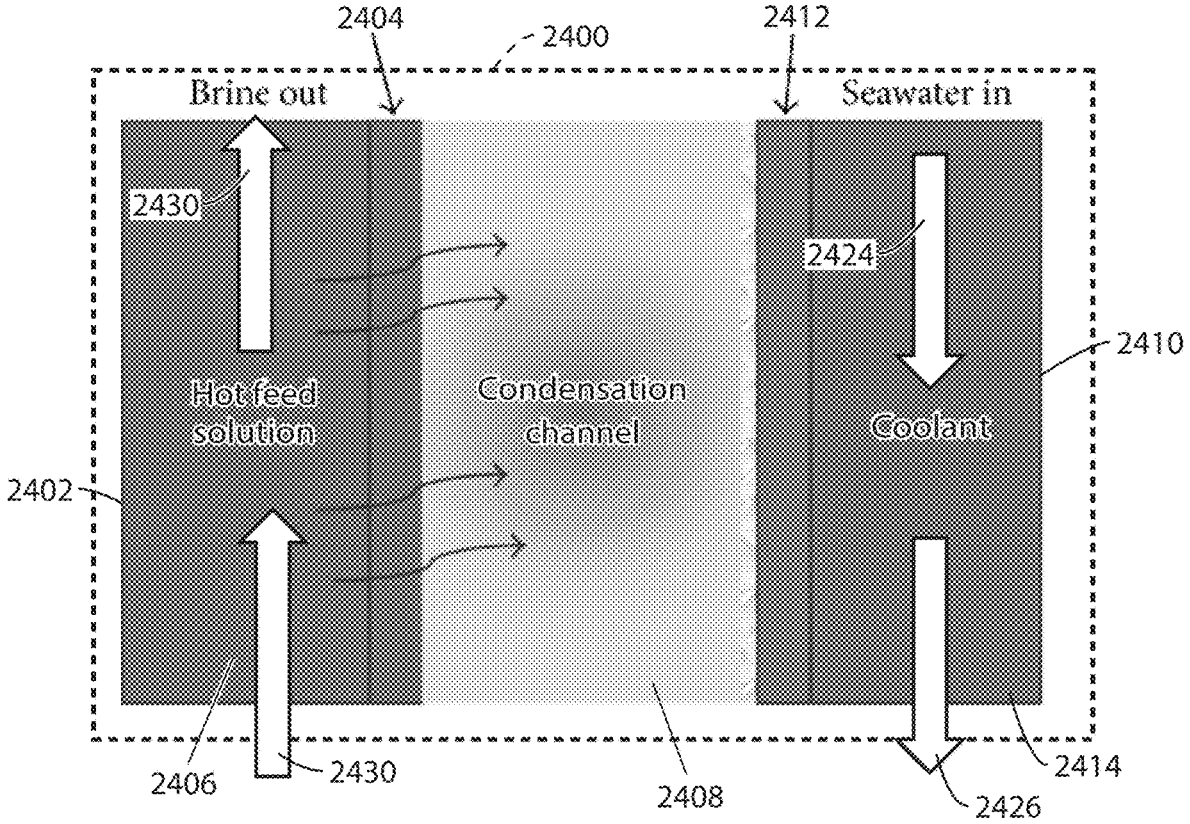

FIG. 24A and FIG. 24B illustrate an alternative embodiment of an interlayered polymer heat exchanger generally based on the assembly described above. FIG. 24A schematically illustrates the overall interlayered heat exchanger and FIG. 24B details a section 2400 of the interlayered heat exchanger. In this embodiment, the interlayered polymer heat exchanger configuration described above is modified to make it well-suited for applications such as, but not limited to, Air Gap Membrane Distillation or Vacuum Membrane Distillation. Here, a first heat exchanger 2402 has porous hydrophobic membranes 2404 separating its liquid passages 2406 from the intervening passages 2408. The intervening passages 2408 are either filled with air (for Air Gap Membrane Distillation) or are in a partial vacuum (for Vacuum Membrane Distillation). The second polymer heat exchanger 2410 has non-porous walls 2412 (e.g., condensation plates) separating its liquid passages 2414 from the intervening passages 2408. The fluid inlet 2416 of the first heat exchanger and the fluid outlet 2418 of the second heat exchanger are located at the same end of the interlayered heat exchanger and offset from each other to permit interlayering of the two heat exchangers. The fluid outlet 2420 of the first heat exchanger and the fluid inlet 2422 of the second heat exchanger are located at the other end of the interlayered heat exchanger. The fluid outlet 2420 and the fluid inlet 2422 are offset from each other to permit inter-layering of the two heat exchangers.

In a Membrane Distillation application, cool brine or seawater 2424 enters the second heat exchanger 2410 through the fluid inlet 2422 and exchanges heat as it flows along the liquid passages 2414 to exit the liquid passages as a warmer brine or seawater 2426 at fluid outlet 2418 of the second heat exchanger. The warm brine or seawater 2426 is then heated further by a heater 2428 and the further heated brine or seawater 2430 is routed into the fluid inlet 2416 of the first heat exchanger. While heated brine flows through the first heat exchanger 2402, the hydrophobic membrane 2404 permits water vapor to pass through the membrane and restricts brine from going through it. The water vapor is transported across the intervening passages 2408 and is condensed on the non-porous walls 2412 of the second heat exchanger 2410. The condensate is drained by gravity along the non-porous wall within the intervening passages 2408. Concentrated brine 2432 exits the first heat exchanger through the fluid outlet 2420.

Figure 25A:
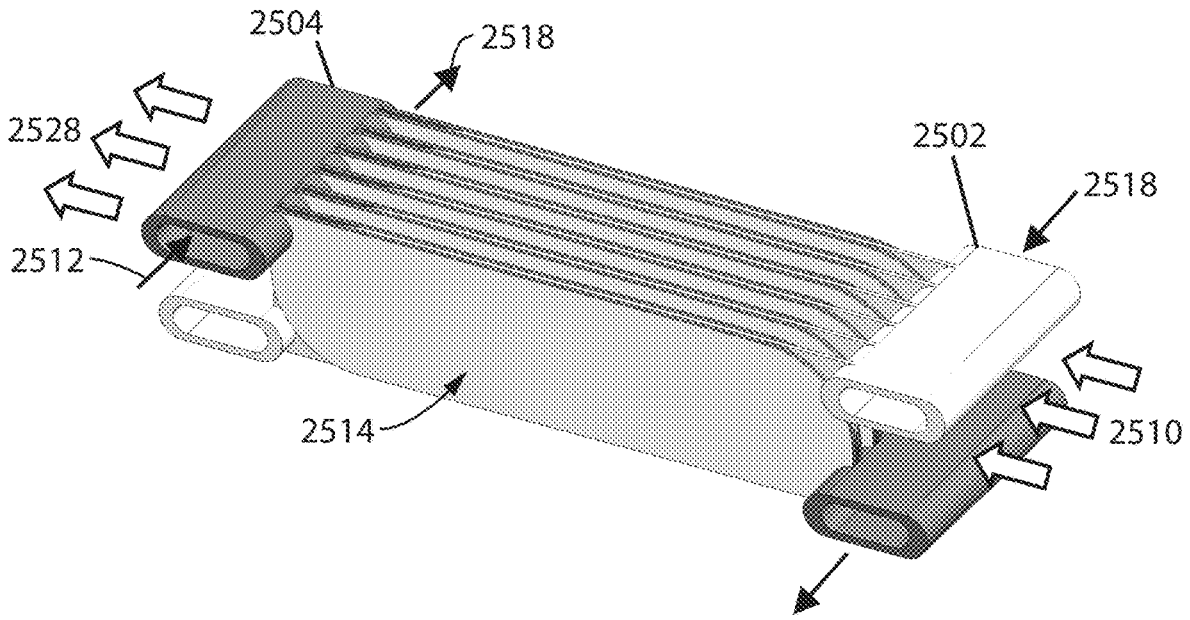
FIG. 25A through FIG. 25C illustrate an exemplary configuration employing interlayered polymer heat exchangers as an absorber of a thermally driven refrigeration system according to an embodiment of the present disclosure.
Figure 25B:
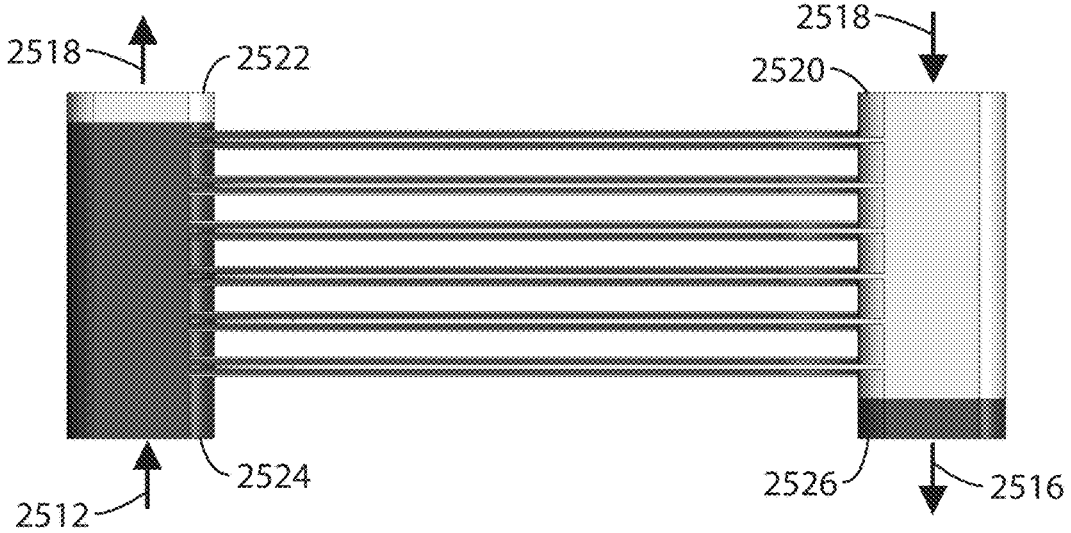
Figure 25C:
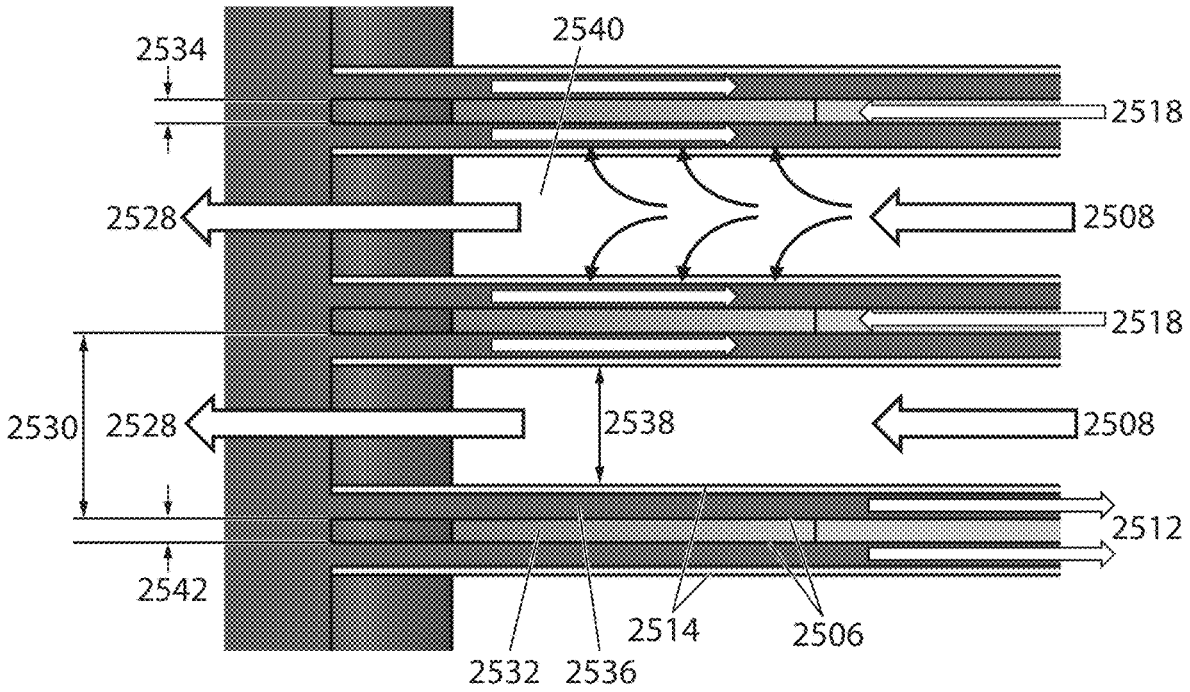

FIG. 25A through FIG. 25C illustrate another embodiment of a interlayered polymer heat exchanger. In this embodiment, two heat exchangers 2502, 2504 touch each other and share a common nonporous wall 2506. This embodiment is well-suited for use as an absorber in a thermally activated refrigeration cycle where refrigerant vapor 2508 will enter the intervening gas passage inlet 2510 and flow in the opposite direction of a binary fluid mixture 2512 flowing through the second heat exchanger 2504. The refrigerant vapor is absorbed through the porous wall 2514, located between the internal flow passages of the second heat exchanger and the refrigerant vapor stream, to form a strong solution of the binary mixture 2516 that exits the second heat exchanger. The heat released during absorption process is removed by a coolant 2518 which is a counter-flowing coolant flowing through the first heat exchanger 2502. The first fluid 2518 enters first heat exchanger 2502 at the first fluid inlet 2520, flows through the first heat exchanger internal flow passages in a counter flow direction to the second fluid 2512, and exits the internal flow passages at the first heat exchanger outlet 2522. The second fluid, which is the binary mixture, enters the second heat exchanger 2504 as weak solution 2512 at the inlet 2524, and flows through the internal flow passages of the second heat exchanger 2504, while absorbing refrigerant vapor through the porous membrane 2514 before exiting as a strong solution of the binary mixture 2516 at the outlet 2526.

If the vapor refrigerant 2508 is completely absorbed within the binary fluid mixture 2512 flowing through the second heat exchanger 2504, no vapor refrigerant exits the device through the gas outlet 2528. If not all of the refrigerant vapor 2508 is absorbed into the binary liquid mixture stream 2512, some of the refrigerant vapor 2508 exits through the gas outlet 2528. Since the absorption process of refrigerant vapor 2508 into the binary liquid mixture stream 2512 releases heat, the coolant 2518 exits the first heat exchanger 2502 at a higher temperature at the first fluid outlet 2522.

To create the interlayered design described above and shown in FIG. 25A through FIG. 25C, specific width dimensions between the liquid plates for the first heat exchanger 2502 and second heat exchanger 2504 are required as indicated in FIG. 25B. For the first heat exchanger 2502, the width dimension 2530 is required between the liquid plates 2532. This width dimension 2530 is the sum of two times the width dimension 2534 of the liquid plates 2536 of the second heat exchanger 2504 and the width dimension 2538 of the intervening gas passage 2540. For the second heat exchanger, two alternating width dimensions 2542 and 2538 are required between the liquid plates 2536. The width dimension 2542 corresponds to the width of the liquid plate 2532 of the first heat exchanger 2502. The width dimension 2538 corresponds to the intervening gas passage 2540.

Figure 26A:
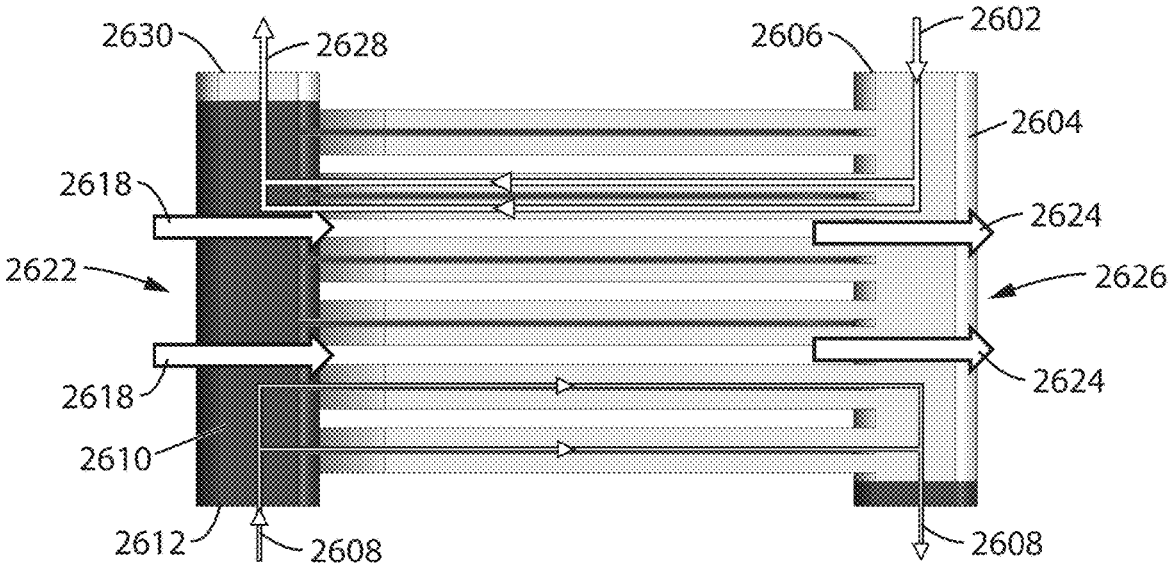
FIG. 26A and FIG. 26B illustrate an exemplary configuration employing interlayered polymer heat exchangers as a component of an indirect evaporative cooling system according to an embodiment of the present disclosure.
Figure 26B:
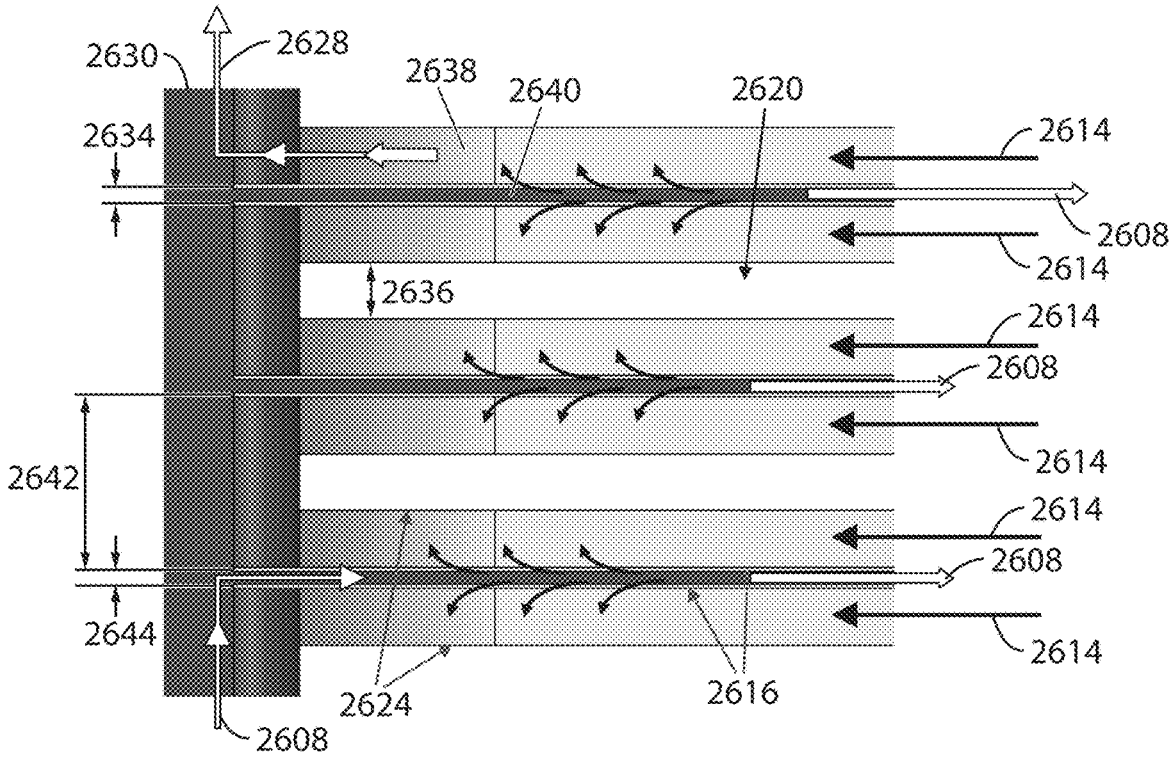

Referring now to FIG. 26A and FIG. 26B, the interlayered heat exchanger illustrated in FIG. 25A through FIG. 25C can be modified slightly for a different application pertaining to a heat and mass exchanger in an indirect evaporative cooler. The difference is that the common wall between the interlayered heat exchangers is porous. In this application, there are two air streams and one water stream. Hot dry air 2602 enters the first interlayered heat exchanger 2604 at the inlet 2606. Water 2608 enters the second interlayered heat exchanger 2610 at the inlet 2612. Water is circulated at a low flow rate through the second heat exchanger 2610. While flowing along this heat exchanger, water 2608 penetrates the porous wall 2614 and evaporates into the hot dry air 2602 of the first interlayered heat exchanger 2604, thereby cooling the air stream and increasing its humidity to form a cool moist air stream 2616. At the same time, hot dry air 2618 enters the intervening gas passages 2620 at the second air stream inlet 2622. The hot dry air stream 2618 exchanges heat with the cooler moist air stream 2616 flowing through the first interlayered heat exchanger 2604 through the non-porous wall 2624 which separated the two streams of 2616 and 2618. The hot dry air in the intervening passages 2620 thereby cools down and cool dry air stream 2624 exits the interlayered heat exchanger at the second air stream outlet 2626 to the building. The warm moist air stream 2628 is exhausted from the outlet 2630 of the first interlayered heat exchanger 2604. Water 2608 exits the second interlayered heat exchanger 2610 at the corresponding outlet 2632.

To create this interlayered design described above and shown in FIG. 26A and FIG. 26B, specific width dimensions between the plates for the first heat exchanger 2604 and second heat exchanger 2610 are required, as indicated in FIG. 26B. For the first heat exchanger 2604, two alternating width dimensions 2634 and 2636 are required between the first heat exchanger plates 2638. The width dimension 2634 corresponds to the liquid plate 2640 of the second heat exchanger 2610. The width dimension 2636 corresponds to the intervening gas passage 2620.

For the second heat exchanger 2610, the width dimension 2642 is required between the liquid plates 2640. This width dimension 2642 is the sum of two times the width dimension 2644 of the plates 2638 of the first heat exchanger 2604 and the width dimension 2636 of the intervening gas passage 2620.

Figure 27:
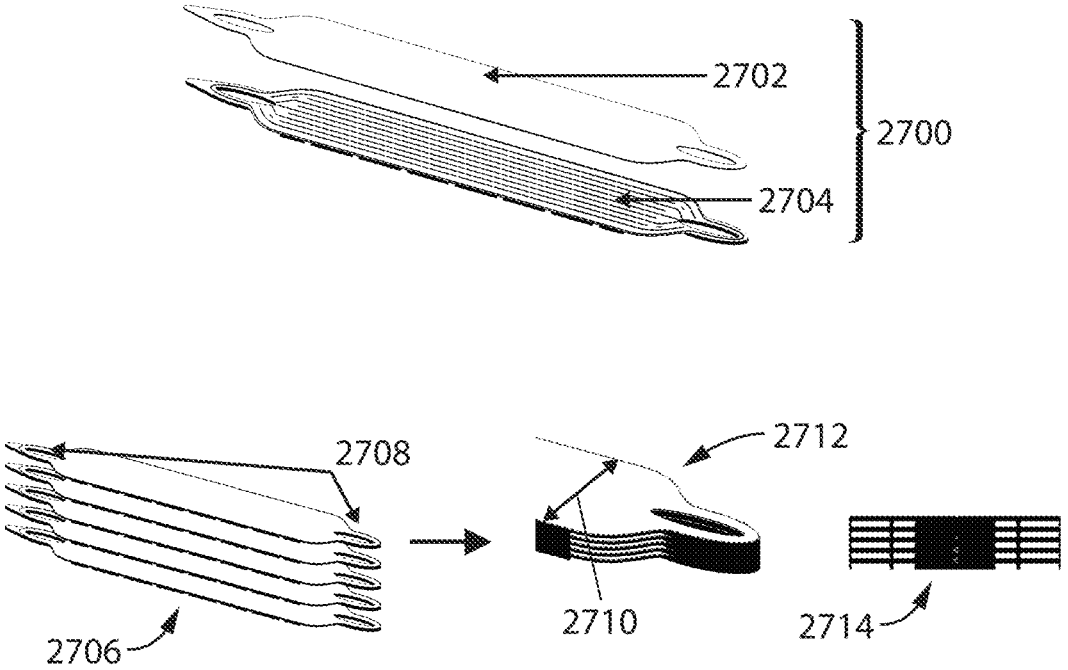
FIG. 27 and FIG. 28 illustrate exemplary methods of fabricating polymer heat exchangers according to embodiments of the present disclosure.
Figure 28:
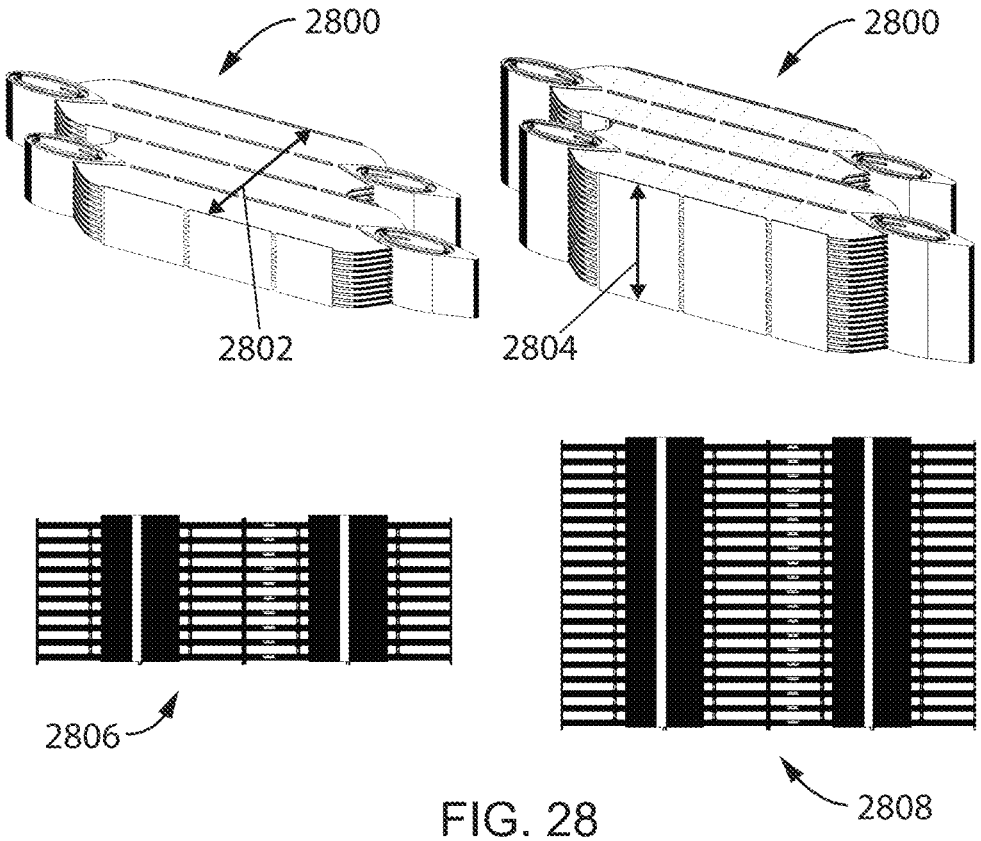

Further exemplary fabrication techniques and steps for the disclosed polymer heat exchanger are illustrated in FIG. 27 (Method A) and FIG. 28 (Method B).

Referring first to FIG. 27, Method A includes injection molding of half liquid plates. A complete liquid plate 2700 is formed by adhering two injection molded half liquid plates, the top laminate 2702 and the bottom laminate 2704, which are of the same design or different designs. Each half liquid plate can have part of the fins needed to form liquid flow passages and intervening gas flow passages. Alternately, all the fins required to form both fluid passages can be made on one half liquid plate, with the other half plate cut to size and shape from a plain and flat polymer film. The polymer film can be porous or non-porous depending on the various embodiments described. The injection molded half plate and the polymer film may have additives such as glass, metal particles, carbon nanotubes or fibers in some cases.

The adhesion of the two half liquid plates, or of the plate and the polymer film can be achieved by, for example, laser welding or by using solvents and/or adhesives. The sealed liquid plates can then be stacked 2706, where only the liquid plena regions 2708 need to be further bonded using solvent or adhesive application. The number of sealed liquid plates in the stack can be determined based on the required heat exchanger block dimension across the width of the gas and liquid flow passages. Several of these heat exchanger blocks can be placed next to each other to achieve the required assembly width 2710. An isometric view 2712 and front view 2714 parallel to the gas stream of a 5-plate stack of injection molded disclosed polymer heat exchanger are provided for context.

Referring to FIG. 28, Method B involves stereolithography (SLA) printing several sealed liquid plates and intervening gas passages together as a monolithic block 2800 using certain polymeric resins that may or may not have other additives. The resin selection is based on the operating service temperature and pressure required for the disclosed polymer heat exchanger to function. In this approach, liquid plates with twice or greater width 2802 compared to the injection mold approach can be printed all at once. The number of plates determines the height 2804 of the heat exchanger block. FIG. 28 also shows front views of two examples of 10-plate 2806 and 20-plate 2808 SLA polymer heat exchanger blocks with twice the width of the injection mold design 2714.

From the description herein, it will be appreciated that the present disclosure encompasses multiple implementations of the technology which include, but are not limited to, the following:

A humidification/de-humidification thermal desalination system, comprising: (a) a polymer heat exchanger; (b) a humidification chamber; (c) a dehumidification chamber; (d) a porous medium within the humidification chamber; (e) the polymer heat exchanger positioned within the dehumidification chamber; (f) a heater; (g) a blower; (h) the polymer heat exchanger comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form intervening gas flow passages, and wherein the stack has a depth; a liquid flow pathway from a liquid inlet, through the internal liquid flow passages in the stack of plates, to a liquid outlet; a gas flow pathway from a gas flow inlet, through the intervening gas flow passages between the consecutive plates in the stack of plates, to a gas flow outlet; wherein the liquid flow pathway flows in a direction opposite to a direction of the gas flow pathway to provide a counterflow design that optimizes heat transfer between the liquid flow pathway and the gas flow pathway; wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet in a counterflow design, and wherein the liquid plena extend within and across the intervening gas flow passages to allow gas flow around and between the liquid plena; (i) wherein seawater or brine is pumped through the internal liquid flow passages and wherein humid air flows through the intervening gas flow passages in a counterflow direction in relation to direction of flow of the seawater or brine; (j) wherein the humid air is cooled by the seawater or brine and condenses to form desalinated water in a lower portion of the dehumidification chamber; (k) wherein dehumidified air exits the dehumidification chamber and is directed to the blower; (l) wherein the seawater or brine is warmed by the humid air and exits the liquid outlet and flows through the heater where the warmed seawater or brine is heated; (m) wherein the heated seawater or brine flows out of the heater and is sprayed onto the porous medium in the humidification chamber; (n) wherein water evaporates from the porous medium, is mixed with the dehumidified air, and is directed back into the dehumidification chamber using the blower; (o) wherein concentrated brine is collected in the lower portion of the humidification chamber.

A polymer heat exchanger, comprising: (a) a set of plates comprised of a polymer that includes internal flow passages which are configured to carry a first gas or a first liquid, wherein the internal flow passages within the set of plates include arrays of fins of uniform height; (b) wherein the set of plates is organized into a stack, wherein consecutive plates in the stack are separated by fins of uniform height to form intervening passages for a second gas or a second liquid, and wherein the stack has a depth; (c) wherein the polymer heat exchanger includes a first flow pathway from a first inlet, through the internal flow passages in the stack of plates, to a first outlet, wherein said first flow pathway is configured for the first gas or the first liquid; (d) wherein the polymer heat exchanger includes a second flow pathway from a second inlet, through the intervening passages between the consecutive plates in the stack of plates, to a second outlet, wherein said second flow pathway is configured for the second gas or the second liquid; (e) wherein gas or liquid in the first flow pathway flows in a direction opposite to direction of gas or liquid flow in the second flow pathway to provide a counterflow design that optimizes heat and mass transfer between the first flow pathway and the second flow pathway; (f) wherein each plate in the set of plates includes a plurality of plena for the first gas or the first liquid positioned in a lateral direction in relation to the first flow pathway, wherein the plena in individual plates form continuous plena for the first gas or the first liquid in the depth of the stack, wherein the plena are configured to carry the first gas or the first liquid from the first inlet to the internal flow passages and from the internal flow passages to the first outlet in a counterflow design, and wherein said plena extend within and across the intervening passages for the second gas or the second liquid to allow the second gas or the second liquid to flow around and between the plena; (g) wherein one or more of the plates that separate the first flow pathway and the second flow pathway comprise a hydrophobic porous membrane, the membrane having a thickness from about 10 micrometers to about 1000 micrometers, the membrane having a pore size from about 1 nanometer to about 50 micrometers.

The polymer heat exchanger of any following or preceding implementation, wherein the first gas or the second gas comprises moist air or water vapor.

The polymer heat exchanger of any following or preceding implementation, wherein the first liquid or the second liquid comprises a liquid selected from the group consisting of brine, seawater, and water.

The polymer heat exchanger of any following or preceding implementation: (a) wherein the polymer heat exchanger is part of a direct contact membrane distillation system used for purifying brine or seawater; (b) wherein a heated seawater or brine solution flows through the internal flow passages; (c) wherein water vapor flows through the porous membrane; (d) wherein purified water is collected in the intervening passages.

The polymer heat exchanger of any following or preceding implementation: (a) wherein a first gas stream with a first moisture content and/or first temperature flows through the internal flow passages; (b) wherein water vapor passes through the porous membrane; (c) wherein a second gas stream with a moisture content lower than the first moisture content or with a temperature lower than the first temperature enters the intervening passages, absorbs water vapor from the membrane, and exits the intervening passages at higher moisture content; (d) wherein moisture and heat are exchanged between the first and second gas streams; (e) wherein the polymer heat exchanger can be used independently or in conjunction with a building heating or cooling system to reduce energy demand of the building heating or cooling system.

A polymer heat exchanger, comprising: (a) a set of plates comprised of a polymer that includes internal gas flow passages which are configured to carry a first gas, wherein the internal gas flow passages within the set of plates include arrays of fins of uniform height; (b) wherein the set of plates is organized into a stack, wherein consecutive plates in the stack are separated by fins of uniform height to form intervening gas flow passages which are configured to carry a second gas, and wherein the stack has a depth; (c) wherein the polymer heat exchanger includes a first gas flow pathway from a first gas inlet, through the internal gas flow passages in the stack of plates, to a first gas outlet; (d) wherein the polymer heat exchanger includes a second gas flow pathway from a second gas inlet, through the intervening gas flow passages between the consecutive plates in the stack of plates, to a second gas flow outlet; (e) wherein the first gas flow pathway flows in a direction opposite to a direction of the second gas flow pathway to provide a counterflow design that optimizes heat transfer between the first gas flow pathway and the second gas flow pathway; (f) wherein each plate in the set of plates includes a plurality of first gas plena positioned in a lateral direction in relation to the first gas flow pathway, wherein the first gas plena in the individual plates form continuous first gas plena in the depth of the stack, wherein the first gas plena are configured to carry the first gas from the first gas inlet to the internal gas flow passages and from the internal gas flow passages to the first gas outlet in a counterflow configuration; (g) wherein the first gas plena extend within and across the intervening gas flow passages to allow the second gas to flow around and between the first gas plena.

The polymer heat exchanger of any following or preceding implementation: (a) wherein a first gas stream enters and flows through the internal gas flow passages or the intervening gas flow passages; (b) wherein a second gas stream having a temperature lower than temperature of the first gas stream enters and flows through the internal gas flow passages or the intervening gas flow passages; (c) wherein the second gas stream absorbs heat from the first gas stream; (d) wherein the polymer heat exchanger can be used independently or in conjunction with a building heating or cooling system to reduce energy demand of the building heating or cooling system.

A thermal energy storage system, the system comprising: (a) a set of plates comprised of a polymer that includes internal liquid flow passages which are configured to carry a liquid, wherein the internal liquid flow passages within the set of plates include arrays of fins of uniform height; (b) wherein the set of plates is organized into a stack, wherein consecutive plates in the stack are separated by fins of uniform height to form thermal energy storage medium gaps/regions, and wherein the stack has a depth; (c) a liquid flow pathway from a liquid inlet, through the internal liquid flow passages in the stack of plates, to a liquid outlet; (d) a thermal energy storage medium in the gaps/regions located between the consecutive plates in the stack of plates; (e) wherein one or more fluids flow through the liquid flow pathway sequentially, to inject heat into, or extract heat from, the thermal energy storage medium; (f) wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet, and wherein the liquid plena extend within and across the thermal energy storage medium to allow for the thermal energy storage medium to be distributed around and between the liquid plena and plates.

A heating and/or cooling system for a building, comprising: (a) a thermal energy storage system comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form thermal energy storage medium gaps/regions, and wherein the stack has a depth; a liquid flow pathway from a liquid inlet, through the internal liquid flow passages in the stack of plates, to a liquid outlet; a thermal energy storage medium in the gaps/regions located between the consecutive plates in the stack of plates; wherein one or more fluids flow through the liquid flow pathway sequentially, to inject heat into, or extract heat from, the thermal energy storage medium; wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet, and wherein the liquid plena extend within and across the thermal energy storage medium to allow for the thermal energy storage medium to be distributed around and between the liquid plena and plates; (b) a heat pump or chiller; (c) a refrigerant-to-liquid heat exchanger which exchanges heat between the refrigerant from the heat pump or chiller and a heat-transfer liquid; (d) a liquid-to-air heat exchanger located within the building and which exchanges heat between the heat-transfer liquid, directed from the thermal energy storage medium or directly from the refrigerant-to-liquid heat exchanger and air; (e) wherein a heat-transfer liquid from the refrigerant-to-liquid heat exchanger flows through the liquid flow passages of the thermal energy storage system, and either heats or cools the thermal energy storage medium during a charging mode of the thermal energy storage system; (f) wherein heat-transfer liquid is routed from the thermal energy storage system through the liquid flow passages to the liquid-to-air heat exchanger located within the building during a discharging mode of the thermal energy storage system, and either cools or heats the thermal energy storage medium during the discharge mode.

A solar heating system for a built environment or process, comprising: (a) a thermal energy storage system comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form thermal energy storage medium gaps/regions, and wherein the stack has a depth; a liquid flow pathway from a liquid inlet, through the internal liquid flow passages in the stack of plates, to a liquid outlet; a thermal energy storage medium in the gaps/regions located between the consecutive plates in the stack of plates; wherein one or more fluids flow through the liquid flow pathway sequentially, to inject heat into, or extract heat from, the thermal energy storage medium; wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet, and wherein the liquid plena extend within and across the thermal energy storage medium to allow for the thermal energy storage medium to be distributed around and between the liquid plena and plates; (b) a solar fluid heater panel; (c) a process load or a built environment that needs to be heated; (d) wherein in a charging mode heat-transfer liquid that is heated within the solar fluid heater panel is directed from the solar fluid heater panel to the thermal energy storage system causing heat to be stored in the thermal energy storage medium; (e) wherein in a discharge mode hot heat-transfer liquid is extracted from the thermal energy storage medium and directed from the thermal energy storage system to the process load or the built environment.

A radiatively cooled fluid system, comprising: (a) a thermal energy storage system comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form thermal energy storage medium gaps/regions, and wherein the stack has a depth; a liquid flow pathway from a liquid inlet, through the internal liquid flow passages in the stack of plates, to a liquid outlet; a thermal energy storage medium in the gaps/regions located between the consecutive plates in the stack of plates; wherein one or more fluids flow through the liquid flow pathway sequentially, to inject heat into, or extract heat from, the thermal energy storage medium; wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet, and wherein the liquid plena extend within and across the thermal energy storage medium to allow for the thermal energy storage medium to be distributed around and between the liquid plena and plates; wherein the thermal energy storage medium has a temperature range between about −200° C. to about 250° C.; wherein the thermal energy storage medium is selected from the group of materials consisting of solid material, a liquid material, a phase change material that transitions from solid to liquid, and a phase change material that transitions from liquid to solid; (b) a liquid-to-gas polymer heat exchanger, comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form intervening gas flow passages, and wherein the stack has a depth; a liquid flow pathway from a liquid inlet, through the internal liquid flow passages in the stack of plates, to a liquid outlet; a gas flow pathway from a gas flow inlet, through the intervening gas flow passages between the consecutive plates in the stack of plates, to a gas flow outlet; wherein the liquid flow pathway flows in a direction opposite to a direction of the gas flow pathway to provide a counterflow design that optimizes heat transfer between the liquid flow pathway and the gas flow pathway wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet in a counterflow design, and wherein the liquid plena extend within and across the intervening gas flow passages to allow gas flow around and between the liquid plena; (c) a radiatively cooled fluid panel; (d) wherein, in a charging mode, heat-transfer liquid that is cooled within the radiatively cooled fluid panel is directed from the panel to the thermal energy storage system causing cooling of the thermal energy storage medium; (e) wherein, in a discharge mode, cool heat-transfer liquid from the thermal energy storage medium is directed to the liquid-to-air polymer heat exchanger; (f) wherein the liquid-to-air polymer heat exchanger is located within a computer server, a room, a building or a datacenter.

A thermal energy storage system, comprising: (a) a first polymer heat exchanger; (b) a second polymer heat exchanger; (c) each said polymer heat exchanger comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form thermal energy storage medium gaps/regions, and wherein the stack has a depth; a liquid flow pathway from a liquid inlet, through the internal liquid flow passages in the stack of plates, to a liquid outlet; a thermal energy storage medium in the gaps/regions located between the consecutive plates in the stack of plates; wherein one or more fluids flow through the liquid flow pathways sequentially or simultaneously, to inject heat into, and/or extract heat from, the thermal energy storage medium; wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet, and wherein the liquid plena extend within and across the thermal energy storage medium to allow for the thermal energy storage medium to be distributed around and between the liquid plena and plates; (d) wherein the liquid plates of the second polymer heat exchanger are interlayered with the liquid plates of the first polymer heat exchanger such that the thermal storage material is distributed in between and around the liquid plates of both heat exchangers, thereby establishing first and second interlayered polymer heat exchangers; (e) wherein the liquid plena of the two interlayered polymer heat exchangers are offset in a direction perpendicular to liquid flow direction to permit interlayering of the liquid plates of both polymer heat exchangers; (f) wherein each polymer heat exchanger is configured to allow a separate liquid stream to pass through it, wherein one liquid stream is used to heat the thermal energy storage medium and wherein a separate liquid stream is used to cool the thermal energy storage medium, sequentially or simultaneously.

A heating and/or cooling system for a building, comprising: (a) a thermal energy storage system comprising: a first polymer heat exchanger; a second polymer heat exchanger; each said polymer heat exchanger comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form thermal energy storage medium gaps/regions, and wherein the stack has a depth; a liquid flow pathway from a liquid inlet, through the internal liquid flow passages in the stack of plates, to a liquid outlet; a thermal energy storage medium in the gaps/regions located between the consecutive plates in the stack of plates; wherein one or more fluids flow through the liquid flow pathways sequentially or simultaneously, to inject heat into, and/or extract heat from, the thermal energy storage medium; wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet, and wherein the liquid plena extend within and across the thermal energy storage medium to allow for the thermal energy storage medium to be distributed around and between the liquid plena and plates; wherein the liquid plates of the second polymer heat exchanger are interlayered with the liquid plates of the first polymer heat exchanger such that the thermal storage material is distributed in between and around the liquid plates of both heat exchangers, thereby establishing first and second interlayered polymer heat exchangers; wherein the liquid plena of the two interlayered polymer heat exchangers are offset in a direction perpendicular to liquid flow direction to permit inter-layering of the liquid plates of both polymer heat exchangers; wherein each polymer heat exchanger is configured to allow a separate liquid stream to pass through it, wherein one liquid stream is used to heat the thermal energy storage medium and wherein a separate liquid stream is used to cool the thermal energy storage medium, sequentially or simultaneously; (b) a heat pump or chiller; (c) a refrigerant-to-liquid heat exchanger which exchanges heat between the refrigerant from the heat pump or chiller and a heat-transfer liquid; (d) a liquid-to-air heat exchanger located within the building and which exchanges heat between the heat-transfer liquid, directed from the thermal energy storage medium or directly from the refrigerant-to-liquid heat exchanger and air; (e) wherein a heat-transfer liquid from the refrigerant-to-liquid heat exchanger flows through the liquid flow passages of the thermal energy storage system, and either heats or cools the thermal energy storage medium during a charging mode of the thermal energy storage system; (f) wherein heat-transfer liquid is routed from the thermal energy storage system through the liquid flow passages to the liquid-to-air heat exchanger located within the building during a discharging mode of the thermal energy storage system, and either cools or heats the thermal energy storage medium during the discharge mode.

A solar heating system for a built environment or process, comprising: (a) a thermal energy storage system, comprising: a first polymer heat exchanger; a second polymer heat exchanger; each said polymer heat exchanger comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form thermal energy storage medium gaps/regions, and wherein the stack has a depth; a liquid flow pathway from a liquid inlet, through the internal liquid flow passages in the stack of plates, to a liquid outlet; a thermal energy storage medium in the gaps/regions located between the consecutive plates in the stack of plates; wherein one or more fluids flow through the liquid flow pathways sequentially or simultaneously, to inject heat into, and/or extract heat from, the thermal energy storage medium; wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet, and wherein the liquid plena extend within and across the thermal energy storage medium to allow for the thermal energy storage medium to be distributed around and between the liquid plena and plates; wherein the liquid plates of the second polymer heat exchanger are interlayered with the liquid plates of the first polymer heat exchanger such that the thermal storage material is distributed in between and around the liquid plates of both heat exchangers, thereby establishing first and second interlayered polymer heat exchangers; wherein the liquid plena of the two interlayered polymer heat exchangers are offset in a direction perpendicular to liquid flow direction to permit inter-layering of the liquid plates of both polymer heat exchangers; wherein each polymer heat exchanger is configured to allow a separate liquid stream to pass through it, wherein one liquid stream is used to heat the thermal energy storage medium and wherein a separate liquid stream is used to cool the thermal energy storage medium, sequentially or simultaneously; (b) a solar fluid heater panel; (c) a process load or a built environment that needs to be heated; (d) wherein in a charging mode heat-transfer liquid that is heated within the solar fluid heater panel is directed from the solar fluid heater panel to the thermal energy storage system causing heat to be stored in the thermal energy storage medium; (e) wherein in a discharge mode hot heat-transfer liquid is extracted from the thermal energy storage medium and directed from the thermal energy storage system to the process load or the built environment.

A radiatively cooled fluid system, comprising: (a) a thermal energy storage system, comprising: a first polymer heat exchanger; a second polymer heat exchanger; each said polymer heat exchanger comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form thermal energy storage medium gaps/regions, and wherein the stack has a depth; a liquid flow pathway from a liquid inlet, through the internal liquid flow passages in the stack of plates, to a liquid outlet; a thermal energy storage medium in the gaps/regions located between the consecutive plates in the stack of plates; wherein one or more fluids flow through the liquid flow pathways sequentially or simultaneously, to inject heat into, and/or extract heat from, the thermal energy storage medium; wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet, and wherein the liquid plena extend within and across the thermal energy storage medium to allow for the thermal energy storage medium to be distributed around and between the liquid plena and plates; wherein the liquid plates of the second polymer heat exchanger are interlayered with the liquid plates of the first polymer heat exchanger such that the thermal storage material is distributed in between and around the liquid plates of both heat exchangers, thereby establishing first and second interlayered polymer heat exchangers; wherein the liquid plena of the two interlayered polymer heat exchangers are offset in a direction perpendicular to liquid flow direction to permit inter-layering of the liquid plates of both polymer heat exchangers; wherein each polymer heat exchanger is configured to allow a separate liquid stream to pass through it, wherein one liquid stream is used to heat the thermal energy storage medium and wherein a separate liquid stream is used to cool the thermal energy storage medium, sequentially or simultaneously; (b) a liquid-to-gas polymer heat exchanger, comprising: a set of plates comprised of a polymer that includes internal liquid flow passages which are configured to carry a liquid, wherein the internal liquid flow passages within the set of plates include arrays of fins of uniform height; wherein the set of plates is organized into a stack, wherein consecutive plates in the stack are separated by fins of uniform height to form intervening gas flow passages, and wherein the stack has a depth; a liquid flow pathway from a liquid inlet, through the internal liquid flow passages in the stack of plates, to a liquid outlet; a gas flow pathway from a gas flow inlet, through the intervening gas flow passages between the consecutive plates in the stack of plates, to a gas flow outlet; wherein the liquid flow pathway flows in a direction opposite to a direction of the gas flow pathway to provide a counterflow design that optimizes heat transfer between the liquid flow pathway and the gas flow pathway, and wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet in a counterflow design, and wherein the liquid plena extend within and across the intervening gas flow passages to allow gas flow around and between the liquid plena; (c) a radiatively cooled fluid panel; (d) wherein, in a charging mode, heat-transfer liquid that is cooled within the radiatively cooled fluid panel is directed from the panel to the thermal energy storage system causing cooling of the thermal energy storage medium; (e) wherein, in a discharge mode, cool heat-transfer liquid from the thermal energy storage medium is directed to the liquid-to-air polymer heat exchanger; (f) wherein the liquid-to-air polymer heat exchanger is located within a computer server, a room, a building or a datacenter.

As used herein, the term "implementation" is intended to include, without limitation, embodiments, examples, or other forms of practicing the technology described herein.

As used herein, the singular terms "a," "an," and "the" may include plural referents unless the context clearly dictates otherwise. Reference to an object in the singular is not intended to mean "one and only one" unless explicitly so stated, but rather "one or more."

Phrasing constructs, such as "A, B and/or C", within the present disclosure describe where either A, B, or C can be present, or any combination of items A, B and C. Phrasing constructs indicating, such as "at least one of" followed by listing a group of elements, indicates that at least one of these groups of elements is present, which includes any possible combination of the listed elements as applicable.

References in this disclosure referring to "an embodiment", "at least one embodiment" or similar embodiment wording indicates that a particular feature, structure, or characteristic described in connection with a described embodiment is included in at least one embodiment of the present disclosure. Thus, these various embodiment phrases are not necessarily all referring to the same embodiment, or to a specific embodiment which differs from all the other embodiments being described. The embodiment phrasing should be construed to mean that the particular features, structures, or characteristics of a given embodiment may be combined in any suitable manner in one or more embodiments of the disclosed apparatus, system, or method.

As used herein, the term "set" refers to a collection of one or more objects. Thus, for example, a set of objects can include a single object or multiple objects.

Relational terms such as first and second, top and bottom, upper and lower, left and right, and the like, may be used solely to distinguish one entity or action from another entity or action without necessarily requiring or implying any actual such relationship or order between such entities or actions.

The terms "comprises," "comprising," "has", "having," "includes", "including," "contains", "containing" or any other variation thereof, are intended to cover a non-exclusive inclusion, such that a process, method, article, apparatus, or system, that comprises, has, includes, or contains a list of elements does not include only those elements but may include other elements not expressly listed or inherent to such process, method, article, apparatus, or system. An element proceeded by "comprises . . . a", "has . . . a", "includes . . . a", "contains . . . a" does not, without more constraints, preclude the existence of additional identical elements in the process, method, article, apparatus, or system, that comprises, has, includes, contains the element.

As used herein, the terms "approximately", "approximate", "substantially", "substantial", "essentially", and "about", or any other version thereof, are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to ±10°, such as less than or equal to 5°, less than or equal to 4°, less than or equal to 3°, less than or equal to ±2°, less than or equal to 1°, less than or equal to 0.5°, less than or equal to 0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

The term "coupled" as used herein is defined as connected, although not necessarily directly and not necessarily mechanically. A device or structure that is "configured" in a certain way is configured in at least that way, but may also be configured in ways that are not listed.

Benefits, advantages, solutions to problems, and any element(s) that may cause any benefit, advantage, or solution to occur or become more pronounced are not to be construed as a critical, required, or essential feature or element of the technology described herein or any or all the claims.

In addition, in the foregoing disclosure various features may be grouped together in various embodiments for the purpose of streamlining the disclosure. This method of disclosure is not to be interpreted as reflecting an intention that the claimed embodiments require more features than are expressly recited in each claim. Inventive subject matter can lie in less than all features of a single disclosed embodiment.

The abstract of the disclosure is provided to allow the reader to quickly ascertain the nature of the technical disclosure. It is submitted with the understanding that it will not be used to interpret or limit the scope or meaning of the claims.

It will be appreciated that the practice of some jurisdictions may require deletion of one or more portions of the disclosure after the application is filed. Accordingly, the reader should consult the application as filed for the original content of the disclosure. Any deletion of content of the disclosure should not be construed as a disclaimer, forfeiture, or dedication to the public of any subject matter of the application as originally filed.

All text in a drawing figure is hereby incorporated into the disclosure and is to be treated as part of the written description of the drawing figure.

The following claims are hereby incorporated into the disclosure, with each claim standing on its own as a separately claimed subject matter.

Although the description herein contains many details, these should not be construed as limiting the scope of the disclosure, but as merely providing illustrations of some of the presently preferred embodiments. Therefore, it will be appreciated that the scope of the disclosure fully encompasses other embodiments which may become obvious to those skilled in the art.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A heat exchanger, comprising:

a set of plates that include internal liquid flow passages which are configured to carry a liquid, wherein the internal liquid flow passages within the set of plates include arrays of fins of uniform height;

wherein the set of plates is organized into a stack, wherein consecutive plates in the stack are separated by fins of uniform height to form intervening gas flow passages, and wherein the stack has a depth;

a liquid flow pathway from a liquid inlet, through the internal liquid flow passages in the stack of plates, to a liquid outlet;

a gas flow pathway from a gas flow inlet, through the intervening gas flow passages between the consecutive plates in the stack of plates, to a gas flow outlet;

wherein the liquid flow pathway flows in a direction opposite to a direction of the gas flow pathway to provide a counterflow design that optimizes heat transfer between the liquid flow pathway and the gas flow pathway;

wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet in a counterflow design, and wherein the liquid plena extend within and across the intervening gas flow passages to allow gas flow around and between the liquid plena.

2. The heat exchanger of claim 1, wherein said gas comprises air.

3. The heat exchanger of claim 1, wherein said gas comprises flue gas.

4. A heat exchanger, comprising:

a set of plates that include internal flow passages which are configured to carry a first gas or a first liquid, wherein the internal flow passages within the set of plates include arrays of fins of uniform height;

wherein the set of plates is organized into a stack, wherein consecutive plates in the stack are separated by fins of uniform height to form intervening passages for a second gas or a second liquid, and wherein the stack has a depth;

wherein the heat exchanger includes a first flow pathway from a first inlet, through the internal flow passages in the stack of plates, to a first outlet, wherein said first flow pathway is configured for the first gas or the first liquid;

wherein the heat exchanger includes a second flow pathway from a second inlet, through the intervening passages between the consecutive plates in the stack of plates, to a second outlet, wherein said second flow pathway is configured for the second gas or the second liquid;

wherein gas or liquid in the first flow pathway flows in a direction opposite to direction of gas or liquid flow in the second flow pathway to provide a counterflow design that optimizes heat and mass transfer between the first flow pathway and the second flow pathway;

wherein each plate in the set of plates includes a plurality of plena for the first gas or the first liquid positioned in a lateral direction in relation to the first flow pathway, wherein the plena in individual plates form continuous plena for the first gas or the first liquid in the depth of the stack, wherein the plena are configured to carry the first gas or the first liquid from the first inlet to the internal flow passages and from the internal flow passages to the first outlet in a counterflow design, and wherein said plena extend within and across the intervening passages for the second gas or the second liquid to allow the second gas or the second liquid to flow around and between the plena;

wherein one or more of the plates that separate the first flow pathway and the second flow pathway comprise a hydrophobic porous membrane, the membrane having a thickness from about 10 micrometers to about 1000 micrometers, the membrane having a pore size from about 1 nanometer to about 50 micrometers.

5. The heat exchanger of claim 4, wherein the first gas or the second gas comprises moist air or water vapor.

6. The heat exchanger of claim 4, wherein the first liquid or the second liquid comprises a liquid selected from the group consisting of brine, seawater, and water.

7. The heat exchanger of claim 4:

wherein the heat exchanger is part of a direct contact membrane distillation system used for purifying brine or seawater;

wherein a heated seawater or brine solution flows through the internal flow passages;

wherein water vapor flows through the porous membrane;

wherein purified water is collected in the intervening passages.

8. The heat exchanger of claim 4:

wherein a first gas stream with a first moisture content and/or first temperature flows through the internal flow passages;

wherein water vapor passes through the porous membrane;

wherein a second gas stream with a moisture content lower than the first moisture content or with a temperature lower than the first temperature enters the intervening passages, absorbs water vapor from the membrane, and exits the intervening passages at higher moisture content;

wherein moisture and heat are exchanged between the first and second gas streams;

wherein the heat exchanger can be used independently or in conjunction with a building heating or cooling system to reduce energy demand of the building heating or cooling system.

9. A thermal energy storage system, comprising:

(a) a first heat exchanger;

(b) a second heat exchanger;

(c) each said heat exchanger comprising:

a set of plates that include internal liquid flow passages which are configured to carry a liquid, wherein the internal liquid flow passages within the set of plates include arrays of fins of uniform height;

wherein the set of plates is organized into a stack, wherein consecutive plates in the stack are separated by fins of uniform height to form thermal energy storage medium gaps/regions, and wherein the stack has a depth;

a liquid flow pathway from a liquid inlet, through the internal liquid flow passages in the stack of plates, to a liquid outlet;

a thermal energy storage medium in the gaps/regions located between the consecutive plates in the stack of plates;

wherein one or more fluids flow through the liquid flow pathways sequentially or simultaneously, to inject heat into, and/or extract heat from, the thermal energy storage medium;

wherein each plate in the set of plates includes a plurality of liquid plena positioned in a lateral direction in relation to the liquid flow pathway, wherein the liquid plena in the individual plates form continuous liquid plena in the depth of the stack, wherein the liquid plena are configured to carry liquid from the liquid inlet to the internal liquid flow passages and from the internal liquid flow passages to the liquid outlet, and wherein the liquid plena extend within and across the thermal energy storage medium to allow for the thermal energy storage medium to be distributed around and between the liquid plena and plates;

(d) wherein the liquid plates of the second heat exchanger are interlayered with the liquid plates of the first heat exchanger such that the thermal storage material is distributed in between and around the liquid plates of both heat exchangers, thereby establishing first and second interlayered heat exchangers;

(e) wherein the liquid plena of the two interlayered heat exchangers are offset in a direction perpendicular to liquid flow direction to permit inter-layering of the liquid plates of both heat exchangers;

(f) wherein each heat exchanger is configured to allow a separate liquid stream to pass through it, wherein one liquid stream is used to heat the thermal energy storage medium and wherein a separate liquid stream is used to cool the thermal energy storage medium, sequentially or simultaneously.

* * * * *